US006081680A

United States Patent [19]

Nomura et al.

[11] Patent Number: 6,081,680

[45] Date of Patent: Jun. 27, 2000

[54] IMAGE FORMING APPARATUS WHICH PREVENTS PERMANENT DEFORMATION AND EXCESSIVE VIBRATION OF THE IMAGE SUPPORTER AND IMAGE FORMATION UNIT USING THE SAME

[75] Inventors: Yujiro Nomura; Saburo Furukawa; Kaneo Yoda; Kuniaki Tanaka, all of Nagano, Japan

[73] Assignee: Seiko Epson Corporation, Tokyo, Japan

[21] Appl. No.: 09/017,154

[22] Filed: Feb. 2, 1998

[30] Foreign Application Priority Data

| | | | |
|---|---|---|---|
| Jan. 31, 1997 | [JP] | Japan | 9-032677 |
| Feb. 24, 1997 | [JP] | Japan | 9-055541 |
| May 30, 1997 | [JP] | Japan | 9-157518 |
| May 30, 1997 | [JP] | Japan | 9-157519 |
| May 30, 1997 | [JP] | Japan | 9-157520 |
| May 30, 1997 | [JP] | Japan | 9-157521 |
| May 30, 1997 | [JP] | Japan | 9-157522 |
| May 30, 1997 | [JP] | Japan | 9-157523 |
| May 30, 1997 | [JP] | Japan | 9-157524 |
| May 30, 1997 | [JP] | Japan | 9-157525 |
| May 30, 1997 | [JP] | Japan | 9-157526 |
| May 30, 1997 | [JP] | Japan | 9-157527 |

[51] Int. Cl.[7] ..... G03G 15/00

[52] U.S. Cl. ..... 399/159; 399/176; 399/279; 399/357

[58] Field of Search ..... 399/116, 117, 399/159, 162, 164, 176

[56] References Cited

U.S. PATENT DOCUMENTS

| | | | |
|---|---|---|---|
| 3,887,278 | 6/1975 | Kolibas | 399/116 |
| 4,076,402 | 2/1978 | Kanno et al. | 399/116 |
| 4,113,372 | 9/1978 | Kimura et al. | 399/117 X |
| 4,527,883 | 7/1985 | Kamiyama | 399/117 |
| 5,483,330 | 1/1996 | Ogiyama et al. | 399/159 X |
| 5,537,199 | 7/1996 | Takai et al. | 399/159 X |
| 5,604,570 | 2/1997 | Jeran et al. | 399/116 |
| 5,671,467 | 9/1997 | Katsumata et al. | 399/164 |
| 5,790,927 | 8/1998 | Ando et al. | 399/176 |
| 5,937,244 | 8/1999 | Yoda et al. | 399/159 |

FOREIGN PATENT DOCUMENTS

| | | |
|---|---|---|
| 577318 | 1/1994 | European Pat. Off. . |
| 589777 | 3/1994 | European Pat. Off. . |
| 698828 | 2/1996 | European Pat. Off. . |
| 814384 | 12/1997 | European Pat. Off. . |
| 56-135861 | 10/1981 | Japan . |
| 58-86550 | 5/1983 | Japan . |
| 58-90655 | 5/1983 | Japan . |
| 60-170883 | 9/1985 | Japan . |
| 62-021168 | 1/1987 | Japan . |
| 4-188164 | 7/1992 | Japan . |
| 4-69383 | 11/1992 | Japan . |
| 5-173401 | 7/1993 | Japan . |
| 6-27859 | 2/1994 | Japan . |
| 6-258989 | 9/1994 | Japan . |
| 8-160709 | 6/1996 | Japan . |

*Primary Examiner*—Susan S. Y. Lee

*Attorney, Agent, or Firm*—Sughrue, Mion, Zinn, Macpeak & Seas, PLLC

[57] ABSTRACT

An image support apparatus including a pair of rotatable disk shaped members, a cylindrical member supported and fixed at both ends by the pair of disk shaped members, a flexible image supporter shaped like a thin cylinder and formed with a photosensitive layer at the outer peripheral surface, support members being disposed on an outer peripheral surface of the cylindrical member for supporting the image supporter, a charge roller abutting the outer peripheral surface of the image supporter for uniformly charging the outer peripheral surface, and a frame. A distance between a portion of the image supporter supported by the support member and an end of the charge roller is set to a length to prevent the image supporter, which is bent as the charge roller abuts the image supporter, from becoming permanently deformed.

51 Claims, 46 Drawing Sheets

2151a
2151 (2152, 2153)
2161a
2161
2162
2160
2110
2111
2176
2175
2113

2151
2151a
2161a
2161
2162
2160
2172
2172a
2170
2171

8151 (8152, 8153)
(8190)
8151a
8161a
8163
8161
8162
8160
8110
8111
8176
8175
8113

8151
8151a
8161a
8161
8162
8160
8163
8172
8172a
8170
8171

IMAGE FORMING APPARATUS WHICH PREVENTS PERMANENT DEFORMATION AND EXCESSIVE VIBRATION OF THE IMAGE SUPPORTER AND IMAGE FORMATION UNIT USING THE SAME

BACKGROUND OF THE INVENTION

1. Technical Field of the Invention

This invention relates to an image formation system such as a printer, a facsimile, or a copier for forming an image using an electrophotographic technology and an image support apparatus used with the image formation system.

2. Related Art

Generally, an image formation system using electrophotographic technology comprises a image supporter having a photosensitive layer on an outer peripheral surface, charge means for uniformly charging the outer peripheral surface of the image supporter, exposure mechanisms for selectively exposing the outer peripheral surface uniformly charged by the charge means for forming an electrostatic latent image, developing means for giving toner of a developer to the electrostatic latent image formed by the exposure mechanisms for rendering the image visible as a toner image, and transfer means for transferring the toner image developed by the developing means to a transfer medium such as paper.

A hard photosensitive drum formed with a photosensitive layer on an outer peripheral surface and a flexible photosensitive drum formed with a photosensitive layer on a surface are generally known as the photosensitive bodies.

Roller-like means brought into contact with the surface of the image supporter are known as the charge means, the developing means, and the transfer means. Hard rollers and soft rubber rollers are known as the rollers.

In using a hard photosensitive drum as the image supporter and a hard roller as the roller brought into contact with the hard photosensitive drum, there are limits in manufacturing the hard photosensitive drum and the hard roller with high accuracy, such that an error always occurs, and it is difficult to bring both the drum and roller into uniform contact with each other. If they do not come in uniform contact with each other, a local gap occurs, causing charge, developing, or transfer unevenness, or the photosensitive drum and the hard roller are pressed against each other more strongly than necessary so as to be damaged.

Therefore, usually if the image supporter or the roller brought into contact with it is made of a hard substance, the other is not made of a hard substance. That is, for a hard photosensitive drum as the image supporter, the roller is made of soft rubber; and for a hard roller as the roller, a flexible photosensitive belt is used as the photosensitive body.

However, if the roller brought into contact with the image supporter is made of soft rubber, there are other problems.

Specifically, to make a charge roller, which is to be brought into contact with an image supporter, out of a rubber roller, conductive particles of carbon, etc., are dispersed to make the roller conductive. However, the rubber hardness changes due to unevenness or variations in the carbon dispersion degree, and the hardness on the roller surface varies, so that an intimate contact state with the image supporter is not produced.

In contrast, if the carbon dispersion amount is lessened to produce the intimate contact state with the image supporter, conductivity varies, causing charge unevenness.

If a roller to which a plasticizing agent is added as a compounding agent is used to enhance flexibility, the plasticizing agent may seep out to the surface because of long-term use or the use environment. The plasticizing agent is deposited on a photosensitive body, changing the characteristic of a photoconductive material in the photosensitive body or causing the photosensitive body stick to the roller and the surface of the photosensitive body to peel off.

Such problems can be solved by using a hard roller as the roller and a flexible photosensitive belt as the photosensitive body.

However, to use a photosensitive belt as the photosensitive body, at least two support rollers are required to support the photosensitive belt, thus the structure becomes complicated and in addition the system is larger in size.

Previously, a photosensitive drum described in Japanese Patent Publication No. Hei 4-69383 has been known as means for solving all the problems described above.

FIGS. 48–50 show the photosensitive drum described in Japanese Patent Publication No. Hei 4-69383.

The photosensitive drum 1 comprises a rotation shaft 2, an elastically-deformable, elastic material layer 3 supported on the rotation shaft 2 and taking the shape of a cylinder in a free state, and an outer layer 4 attached surrounding the elastic material layer 3. The outer layer 4 comprises a photosensitive body support layer 5 that can be elastically deformed and a photosensitive layer 6 supported on a surface of the support layer 5. The elastic material layer 3 fills the space between the rotation shaft 2 and the outer layer 4 without forming any substantial gap.

Since the photosensitive drum 1 has the outer layer 4 and the elastic material layer 3 that can be elastically deformed, when an external force is exerted on the surface of the photosensitive drum 1, the surface can be elastically deformed.

In FIG. 48, numeral 7 is a charger, numeral 10 is a developing roller, and numeral 13 is a transfer charger.

At the image formation time, the photosensitive drum 1 is rotated clockwise in FIG. 48 and the photosensitive layer 6 of the drum 1 is charged to a predetermined polarity by the charger 7. The charge area is irradiated with light 8 for forming an electrostatic latent image on the drum 1. The latent image is developed with toner supported on the developing roller 10 rotating in the arrow direction in FIG. 48 as a visible image and is transferred to transfer paper 12 by the transfer charger 13.

In FIG. 48, numeral 14 is a separation charger, numeral 15 is a cleaning blade, and numeral 16 is a static elimination charger.

According to this configuration, since the surface of the photosensitive drum 1 can be elastically deformed, the developing roller 10 can be pressed against the photosensitive drum 1 for elastically deforming the surface of the photosensitive drum 1 in the radial direction thereof. Thus, if the peripheral surfaces of the photosensitive drum 1 and the developing roller 10 are a little eccentric relative to the center axis, the outer diameters of the photosensitive drum 1 and the developing roller 10 vary a little on manufacturing, or at least the surface of the developing roller 10 is made of a rigid body, toner on the developing roller 10 can be brought into contact with the photosensitive drum 1 in a more reliable and stable state than was previously possible without involving trouble of damaging the drum surface, the developing roller, etc., and degradation of image quality of a visible image caused by a large gap produced between the toner on the developing roller 10 and the surface of the photosensitive drum 1 can be suppressed.

That is, according to the photosensitive drum 1, even if a hard developing roller is used, damage to the photosensitive drum or the developing roller can be prevented and the system can also be prevented from being too large.

A photosensitive drum like the photosensitive drum described above is also disclosed in Unexamined Japanese Patent Publication No. Sho 58-90655.

On the other hand, Unexamined Japanese Patent Publication No. Sho 58-86550 discloses a drum-like photosensitive member comprising an endless belt made of a nonmagnetic metal 0.01–2 mm thick prepared by an electric casting method as a drum base body 31 (see FIG. 51), an image support layer (photoconductive material layer) 32 formed on the drum base body 31, and disk-like end plates 33 for supporting the drum base body 31 at both ends thereof, for saving weight and preventing an inductive eddy current from occurring.

The photosensitive drum 1 described in Japanese Patent Publication No. Hei 4-69383 (see FIGS. 48–50) has the following problem due to the fact that the elastic material layer 3 fills the space between the rotation shaft 2 and the outer layer 4 without forming any substantial gap.

The photosensitive layer 6, which is formed on the elastic material layer 3, is axially displaced by a minute force. Press members such as the developing roller 10 and the cleaning blade 15 pressed against the photosensitive layer 6 are disposed on the photosensitive layer 6. Thus, if the rotation axis of the photosensitive layer 6, the axes of the press members, etc., are inclined or the press force is uneven in the axial direction, the photosensitive layer 6 is subjected to an axial thrust force and is axially displaced by the thrust force. Since the thrust force fluctuates, an image formed on the photosensitive layer 6 is also axially displaced. Axial image position accuracy is therefore degraded. Particularly, to superimpose multiple colors, degradation of color superimposing accuracy results in a hue shift, causing an image to be degraded significantly.

The photosensitive drum 1 can be manufactured by alternative methods of:

(1) first preparing the outer layer 4 formed with the photosensitive layer 6 on the photosensitive body support layer 5, next placing the rotation shaft 2 and the outer layer 4 with a predetermined spacing therebetween and pouring a heated elastic material into the space between the rotation shaft 2 and the outer layer 4 for forming the elastic material layer 3;

(2) first placing the rotation shaft 2 and the photosensitive body support layer 5 with a predetermined spacing therebetween and pouring a heated elastic material into the space between the rotation shaft 2 and the photosensitive body support layer 5 for forming the elastic material layer 3, next forming the photosensitive layer 6 on the photosensitive body support layer 5; or (3) preparing a tubular elastic member having an outer diameter a little larger than the inner diameter of the outer layer 4 and inserting the tubular elastic member into the outer layer 4 in diametrically compressed relation, thereby forming the elastic material layer 3.

However, in method (1), a heated elastic material is poured into the outer layer 4 with the photosensitive layer 6 formed on the surface of the outer layer 4, thus the photosensitive body characteristics are degraded due to heat, etc. There is a fear of damage to the surface of the photosensitive layer 6 and deposition of a foreign material of elastic material, etc., thereon.

In method (2), the elastic material layer 3 is formed before the photosensitive layer 6 is formed. Thus, the elastic material layer 3 swells, melts, or hardens because of a cleaning fluid and a coating liquid at the photosensitive layer coating time. As a result, it is feared that the elastic material layer may not function properly.

Therefore, it is extremely difficult to provide a desired photosensitive drum 1 by method (1) or (2).

In method (3), when the tubular elastic member is released from the compression state and swells to the outer layer 4, it is feared that the tubular elastic member swells nonuniformly. Thus, it is feared that the concentric degree of the rotation shaft 2 and the outer layer 4 with each other may be impaired and that when the photosensitive body 1 rotates, it may shake or swing very largely. In the image formation system, the photosensitive body is surrounded by the abutment members such as the charge means, the developing means, the transfer means, and the cleaning means abutting the photosensitive body. Thus, if the photosensitive body shakes or swings largely, the contact state between the photosensitive body and the abutment members becomes unstable and image unevenness occurs.

In recent years, the main components of the image formation system have been put into units, but this is not mentioned at all in Japanese Patent Publication No. Hei 4-69383.

On the other hand, in the drum-like image support member disclosed in Unexamined Japanese Patent Publication No. Sho 58-86550 (see FIG. 51), if the drum base body 31 can be easily bent inwardly, the drum base body 31 can be used as artificial soft material; it can be expected that the problems in the photosensitive drum 1 described in Japanese Patent Publication No. Hei 4-69383 (see FIGS. 48–50) are solved.

However, use of the drum base body 31 as artificial soft material is not mentioned at all in Unexamined Japanese Patent Publication No. Sho 58-86550.

Moreover, the drum-like image support member (see FIG. 51) has a structure directly supporting the drum base body 31 at both ends thereof simply on the disk-like end plates 33. Thus, if an attempt is made to use the drum base body 31 as artificial soft material, the following problem arises:

Fit tolerance exists between the drum base body 31 and the disk-like end plates 33. If an attempt is made to fix the drum base body 31 to the end plates 33 by bonding, etc., the drum base body 31 floats partially from the peripheral surfaces of the end plates 33 by the tolerance. Thus, if the peripheral surfaces of the end plates 33 are high in roundness, the roundness of the drum base body 31 is degraded and the image support layer (photoconductive material layer) 32 shakes or swings largely, making it extremely difficult to provide a reliable and stable contact state with an abutment member such as a hard roller. If the fit tolerance is made extremely small, the problem is corrected somewhat. However, if the fit tolerance is made extremely small, it becomes extremely difficult to fit the drum base body 31 to the end plates 33, namely, to manufacture the unit.

A photosensitive body drive as described in Unexamined Japanese Patent Publication No. Hei 4-188164 in known as a means for meeting such demands.

FIG. 52 shows the photosensitive body drive; FIG. 52 (*a*) is a side view and FIG. 52 (*b*) is a perspective view.

The photosensitive body drive comprises a photosensitive belt 20 formed as a tubular thin sheet, a drive roller 21 having an outer diameter peripheral length shorter than the inner diameter peripheral length of the photosensitive drum 20 and being placed inside the photosensitive belt 20 for rotating, and press members 22 having a coefficient of friction with the photosensitive belt 20 set smaller than the coefficient of friction between the drive roller 21 and the photosensitive belt 20 for pressing the photosensitive belt 20 slidably while bringing the photosensitive belt 20 into intimate contact with the drive roller 21 in a predetermined range in the circumferential direction of the drive roller 21. In FIG. 52, numeral 24 is a charger, numeral 25 is an exposure device, numeral 26 is a developing roller, numeral 27 is a transfer charger, and numeral 28 is a cleaning roller.

According to the photosensitive body drive, the photosensitive belt 20 is driven in a state in which it is brought partially into intimate contact with the surface of the drive roller 21 by the press members 22, and warp 23 is formed in the portion where the press members 22 do not exist because of the peripheral length difference from the drive roller 21.

Thus, the photosensitive belt 20 can be used as a hard material in the intimate contact portion produced by the press members 22 because the hardness of the photosensitive belt 20 is simulated by the hardness of the drive roller 21, and can be used as an elastic body in the portion where the press members 22 do not exist because the warp 23 is formed.

Therefore, according to the drive, the cleaning roller 28 made of an elastic body can be brought into contact with the intimate contact portion of the photosensitive belt 20 with the press member 22 and the developing roller 26 made of a hard material can be brought into contact with the warp 23 portion.

If the developing roller 26 is made of a hard material, it is brought into contact with the warp 23 portion stably with a sufficient nip width and by a very low press contact force because the warp 23 acts as an elastic body.

That is, according to the drive, even if a hard developing roller is used, damage to the photosensitive body or the developing roller is prevented and the drive can also be prevented from being too large.

Drives similar to the drive described above are also disclosed in Unexamined Japanese Patent Publication Nos. Hei 6-27859 and 6-258989, for example.

In the photosensitive body drive described in Unexamined Japanese Patent Publication No. Hei 4-188164, the photosensitive belt 20 is guided by the press members 22 disposed partially in the margins of the photosensitive belt 20. Thus, when the photosensitive belt 20 enters the press member 22, a bend stress easily occurs in the margin (end margin) of the photosensitive belt 20 at an entrance portion 22*a*, whereby a break, a crack, or peeling-off of a photosensitive layer easily occurs in the end margin of the photosensitive belt 20 (inferior durability). Thus, it is feared that the photosensitive belt 20 may be destroyed from the end margin or that a fatal image defect may be caused even if the photosensitive belt 20 is not destroyed.

The photosensitive belt 20 must be handled as a single unit until it is built in the drive in a state as shown in FIG. 52. However, the photosensitive belt 20 is formed like a tubular thin sheet as described above and does not have sufficient rigidity, thus it is difficult to handle.

Further, in the drive, the warp 23 is formed in the portion where the press members 22 for pressing both ends of the photosensitive belt 20 do not exist. Thus, openings 29 are made between the photosensitive belt 20 and the drive roller 21 at both ends of the warp 23 formation portion.

Thus, foreign materials such as a toner, a toner external additive, paper powder, etc., floating in the drive easily enter the space between the photosensitive belt 20 and the drive roller 21 through the openings 29, 29. As the foreign materials enter, the friction force between the photosensitive belt 20 and the drive roller 21 lowers and it is feared that the photosensitive belt 20 will not be driven.

On the other hand, in the photosensitive body drive described above, the developing roller 26 is brought into contact with the in the warp 23 portion where the press members 22 do not exist. Thus, the drive roller 21 or any other vibration source causes the photosensitive belt 20 to vibrate, particularly in the radial direction of the photosensitive belt 20 in the abutment portion against the developing roller 26. When the photosensitive belt 20 vibrates, the abutment state against the developing roller 26 becomes unstable, causing jitter or inconsistencies in density in a formed image.

Since the conventional drive drives the photosensitive belt 20 by the friction force between the photosensitive belt 20 and the drive roller 21 placed in the photosensitive belt 20, it is feared that the photosensitive belt 20 will not necessarily be driven reliably.

SUMMARY OF THE INVENTION

It is therefore an object of the present invention to provide an image support apparatus that can be improved in roundness, can come in reliable and stable contact with an abutment member even if the abutment member is a hard member such as a hard roller, can be driven reliably, is excellent in durability and handling, and can be manufactured easily. It is also an object to provide an image formation system using this image support apparatus.

To achieve the above objects, according to a first aspect of the present invention, there is provided an image support apparatus comprising:

a pair of rotatable disk-like members;

a cylindrical member supported and fixed at both ends by the pair of disk-like members;

an image supporter like a thin cylinder having flexibility which is formed with a photosensitive layer on an outer peripheral surface;

support members being disposed on an outer peripheral surface of the cylindrical member for supporting the image supporter;

a charge roller abutting the outer peripheral surface of the image supporter for uniformly charging the outer peripheral surface; and a frame for holding said all the member, wherein a distance between a supported part of the image supporter supported by the support member and an end of the charge roller is set to a length to prevent the image supporter bent as the charge roller abuts the image supporter from becoming permanently deformed.

The support members are spacers having elastic projections, and a spacing between the outer peripheral surface of the cylindrical member and an inner surface of the image supporter when the spacers support the image supporter is set smaller than the allowable deformation amount in which the image supporter is destroyed when it is deformed inwardly.

The spacers are disposed on the outer peripheral surface of the cylindrical member being equally spaced from each other in its circumferential direction.

The charge roller is chamfered at outer peripheral end parts.

The image support apparatus further comprises:

a exposure mechanism for selectively exposing the outer peripheral surface of the image supporter uniformly charged by the charge roller for forming an electrostatic latent image, a developing roller for developing the electrostatic latent image formed by the exposure mechanism, and a transfer mechanism for transferring the image developed by the developing roller to a transfer medium.

According to a second aspect of the present invention, one of the pair of the disk-like members is fitted slidably into an inner peripheral surface of the cylindrical member.

According to a third aspect of the present invention, there is provided an image support apparatus comprising:

a shaft not rotated by itself;

a pair of disk-like members attached rotatably to the shaft;

an image supporter like a thin cylinder having flexibility which is formed with a photosensitive layer on an outer peripheral surface and being supported and fixed at both ends by the pair of disk-like members and rotated together with the disk-like members;

support members being disposed in the disk-like members for supporting the image supporter at both ends thereof, the support members being concentric with the image support;

image supporter image supporter fixation structures being disposed facing the support members with the image supporter between regarding in the circumferential direction of the cylindrical member;

a backup mechanism being attached to the shaft inside the image supporter for supporting the image supporter from the inside thereof at an abutment position where an abutment member is abutted against the image supporter from the outside thereof.

The abutment member is a cleaning member for removing a developer remaining on an outer peripheral surface of the image supporter.

The backup mechanism is a rotatable roller.

The image supporter is a photosensitive body which is exposed on a surface for forming an electrostatic latent image, a developing roller being attached to and detached from the photosensitive body, and comprises a backup mechanism for supporting the image supporter from the inside thereof at the exposure position.

The backup mechanism supports the image supporter at least at the exposure position toward the outside slightly from a rotation path of the image supporter formed if the backup mechanism does not exist.

The pair of disk-like members are rotated at the same time.

A gang mechanism for ganging together the pair of disk-like members is disposed inside the image supporter.

The gang mechanism comprises a gang shaft placed in parallel with the shaft inside the image supporter and a pair of gears fixed to the gang shaft at both ends thereof and meshing with gears disposed in the pair of disk-like members.

The gang mechanism is provided with backlash prevention mechanisms.

The image support apparatus further comprises:

a exposure mechanism for selectively exposing the outer peripheral surface of the image supporter uniformly charged by the charge roller for forming an electrostatic latent image, a developing roller for developing the electrostatic latent image formed by the exposure mechanism, and a transfer mechanism for transferring the image developed by the developing roller to a transfer medium.

According to a fourth aspect of the present invention, there is provided an image support apparatus wherein the backup mechanism is a member coming in sliding contact with an inner peripheral surface of the image supporter.

The image supporter is a photosensitive body which is exposed on a surface for forming an electrostatic latent image, a developing roller being attached to and detached from the photosensitive body, and the backup mechanism supports the image supporter from the inside thereof at the exposure position.

The backup mechanism supports the image supporter at least at the exposure position toward the outside slightly from a rotation path of the image supporter formed if the backup mechanism does not exist.

According to a fifth aspect of the present invention, there is provided an image support apparatus wherein the backup mechanism is a rotatable roller.

The image support apparatus further comprising an urging mechanism for urging the backup mechanism, the urging mechanism positions the backup mechanism in the supporting direction thereof.

The support members support at both ends thereof from the inside in the circumferential direction, and each of the support member has a cylindrical face and a truncated cone face adjoining the cylindrical face.

An outer diameter of the cylindrical face is larger than an inner diameter of said image supporter before supported on the support member, and a tip diameter of the truncated cone face is smaller than the inner diameter of said image supporter before supported on the support member.

The image support apparatus further comprising positioning rollers for positioning the backup roller disposed at the shaft ends of the backup roller.

According to a sixth aspect of the present invention, there is provided an image support apparatus comprising:

a shaft not rotated by itself;

a pair of disk-like members attached rotatably to the shaft;

an image supporter like a thin cylinder having flexibility which is formed with a photosensitive layer on an outer peripheral surface and being supported and fixed at both ends by the pair of disk-like members and rotated together with the disk-like members;

support members being disposed in the disk-like members for supporting the image supporter at both ends thereof, the support members being concentric with the image support;

image supporter image supporter fixation structures being disposed facing the support members with the image supporter between regarding in the circumferential direction of the cylindrical member;

fixation support mechanisms deforming the image supporter image supporter fixation structures such that both ends of the image supporter are pressed by the image supporter image supporter fixation structures;

backup mechanisms being attached to the shaft inside the image supporter for supporting the image supporter from the inside thereof at near an abutment position where an abutment member is abutted against the image supporter from the outside thereof; and urging mechanisms for urging the backup mechanisms, the urging mechanisms position the backup mechanism in the supporting direction thereof.

The abutment member is a cleaning member for removing a developer remaining on an outer peripheral surface of the image supporter.

The backup mechanism is a rotatable roller.

The image supporter image supporter fixation structures are elastic rings made of a elastic body.

The support members support both ends of the image supporter from inside thereof, the elastic rings are disposed facing the support members with the image supporter between.

The elastic rings are deformed such that both ends of the image supporter are pressed from outside thereof by the elastic rings.

The fixation support mechanism comprises:

press members pressing the elastic rings in the axial direction of the shaft; and regulators regulating in the deformation of the elastic rings other than deformation toward the support members, the regulators are disposed facing support members with the elastic rings between.

The image support apparatus further comprises:

a exposure mechanism for selectively exposing the outer peripheral surface of the image supporter uniformly charged by the charge roller for forming an electrostatic latent image, a developing roller for developing the electrostatic latent image formed by the exposure mechanism, and a transfer mechanism for transferring the image developed by the developing roller to a transfer medium.

According to a seventh aspect of the present invention, there is provided the image support apparatus further comprising positioning rollers for positioning the backup rollers disposed at the shaft ends of the backup rollers.

According to an eighth aspect of the present invention, there is provided the image support apparatus wherein the support members support both ends of the image supporter from outside thereof, the elastic rings are disposed facing the support members with the image supporter between.

The elastic rings are deformed such that both ends of the image supporter are pressed from inside thereof by the elastic rings.

The fixation support mechanisms comprises:

press members pressing the elastic rings in the axial direction of the shaft; and regulators regulating in the deformation of the elastic rings other than deformation toward the support members, the regulators are disposed facing support members with the elastic rings between.

According to a ninth aspect of the present invention, there is provided the image support apparatus wherein the image supporter image supporter fixation structures are C-shaped elastic ring opened at both ends thereof.

The support members support both ends of the image supporter from outside thereof, the C-shaped elastic rings are disposed facing the support members with the image supporter between.

A gap between the open ends of the C-shaped elastic rings is widened by the fixation support mechanisms.

According to a tenth aspect of the present invention, there is provided the image support apparatus wherein the support members support both ends of the image supporter from inside thereof, the C-shaped elastic rings are disposed facing the support members with the image supporter between.

A gap between the open ends of the C-shaped elastic rings is tightened by the fixation support mechanisms.

The image support apparatus further comprising positioning rollers for positioning the backup rollers disposed at the shaft ends of the backup rollers.

According to an eleventh aspect of the present invention, there is provided the image support apparatus wherein the abutment members are a cleaning member for removing a developer remaining on an outer peripheral surface of the image supporter and developing rollers.

The backup mechanisms is rotatable rollers.

The backup mechanisms abutting the developing rollers are made of elastic body.

The image support apparatus further comprising positioning rollers for positioning the backup rollers disposed at the shaft ends of the backup rollers.

According to a twelfth aspect of the present invention, there is provided the image support apparatus wherein there are a plurality of the developing roller abutment positions and the backup mechanisms are placed the abutment positions.

The backup mechanisms is rotatable rollers.

The backup mechanisms abutting the developing rollers are made of elastic body.

The image support apparatus further comprising positioning rollers for positioning the backup rollers disposed at the shaft ends of the backup rollers.

The image support apparatus according to the first aspect of the present invention can produce the following functions and effects:

(a) The image supporter is shaped like a thin cylinder having flexibility formed with a photosensitive layer on the outer peripheral surface and is supported at both ends by the support members, thus the center portion of the image supporter not supported by the support members can be deformed inwardly.

Therefore, the center portion of the image supporter can be used as an artificial soft material. Even if the charge roller abutted against it is a hard roller, a reliable and stable contact state can be provided and an image can be formed or supported reliably on the image supporter.

(b) The image supporter is shaped like a thin cylinder having flexibility, the support members for supporting the image supporter at both ends thereof, and the charge roller abutting the outer peripheral surface of the image supporter for uniformly charging the outer peripheral surface are held on the frame as a unit, thus facilitating handling of the image supporter, etc.

When the image supporter and the charge roller abutting it are put into a unit, if no means are provided, it is feared that the image supporter is pressed by the charge roller and may be bent and become permanently deformed. However, according to the configuration as claimed in claim 1, the distance between the supported part of the image supporter supported by the support member and the end of the charge roller is set to the length to prevent the image supporter bent as the charge roller 120 abuts the image supporter from becoming permanently deformed. Thus, it is not feared that the image supporter may become permanently deformed although the image supporter and the charge roller are put into a unit.

(c) The image supporter is supported at both ends on the support members and need not be filled with an elastic material layer as in the photosensitive drum 1 (see FIGS. 15–17) described in Japanese Patent Publication No. Hei 4-69383, thus it can be manufactured easily.

(d) The charge roller is chamfered at the outer peripheral end parts, so that the image supporter can be more reliably prevented from becoming permanently deformed.

(e) The image support apparatus further comprises the exposure mechanisms for selectively exposing the outer peripheral surface of the image supporter uniformly charged by the charge roller of the image support apparatus for forming an electrostatic latent image, the developing roller for developing the electrostatic latent image formed by the exposure mechanisms, and the transfer means for transferring the image developed by the developing roller to a transfer medium, thus can form an image on the image supporter, support the image thereon, and transfer the image to a transfer medium.

The image support apparatus according to the second aspect of the present invention can produce the following functions and effects:

Deformation of the image supporter due to temperature change is prevented. Therefore, a reliable and stable contact state can be provided and an image can be formed or supported reliably on the image supporter.

The image support apparatus according to the third aspect of the present invention can produce the following functions and effects:

(a) The image supporter like a thin cylinder is supported and fixed at both ends by the disk-like members attached rotatably to the shaft. Thus, when the disk-like members are rotated, the image support is rotated reliably.

Since the image supporter is supported and fixed at both ends by the disk-like members, excellent durability is also provided.

(b) The image supporter is shaped like a thin cylinder having flexibility and is supported at both ends by the disk-like members, thus the center portion of the image supporter not supported by the disk-like members can be deformed inwardly.

Therefore, the portion of the center portion of the image supporter where the backup mechanism is not disposed can be used as an artificial soft material. Even if the member abutted against it is a hard roller, a reliable and stable contact state can be provided and an image can be formed or supported reliably on the image support.

On the other hand, the abutment members such as so-called process members (the charge member, the developing member, etc.,) are abutted against the outer peripheral surface of the image supporter. At the abutment positions, the image supporter is supported from the inside by the backup mechanisms, so that the abutment members can be abutted reliably.

Moreover, assuming that the abutment member is abutted against the image supporter in a state in which the backup mechanisms do not exist, it is feared that the image supporter like a thin cylinder may become creep-deformed. However, the image support apparatus of the present invention also eliminates such a fear.

(c) The image supporter is supported and fixed at both ends by the disk-like members attached rotatably to the shaft and the backup mechanisms are attached to the shaft inside the image supporter, whereby the peripheral surface of the image supporter, so that the image supporter can be supported in the rotation direction thereof in a wider range.

Thus, the image support apparatus of the present invention can provide a reliable and stable contact state with the abutment members, is excellent in durability and handleability, and can be driven reliably.

(d) The abutment member is a cleaning member for removing the developer remaining on the outer peripheral surface of the image supporter. Thus, the cleaning member can be reliably abutted against the image supporter for reliably removing the developer (for example, toner) remaining on the outer peripheral surface of the image supporter.

(e) The backup mechanism is made of a rotatable roller, so that the load on the image supporter can be lessened and therefore the drive torque of the image support can be decreased.

(f) The backup mechanism is made of a member coming in sliding contact with the inner peripheral surface of the image support, so that the image support can be supported in the rotation direction thereof in a wider range.

(g) The image supporter is a photosensitive body which is exposed on a surface for forming an electrostatic latent image, a developing roller being attached to and detached from the photosensitive body, and comprises a backup mechanism for supporting the image supporter from the inside thereof at the exposure position. Thus, the behavior of the image supporter at the exposure position becomes stable and therefore an accurate exposure state can be provided.

More particularly, the image supporter is a photosensitive body which is exposed on a surface for forming an electrostatic latent image and the developing roller is attached to and detached from the image supporter (photosensitive body). In this configuration, assuming that there is no member for supporting the image support from the inside at the exposure position, the image supporter, which is like a thin cylinder having flexibility, is affected by the attachment or detachment operation of the developing roller and becomes deformed delicately and it is feared that the exposure position to the image supporter, namely, the photosensitive body may vary. If the exposure position to the photosensitive body varies, an image is not formed at the position where it is originally to be formed, causing image quality to be degraded. Particularly, to superimpose images of a number of colors for forming a color image, a shift occurs among the images of colors and a fine color image cannot be provided.

In contrast, the image support apparatus of the present invention is provided with the backup mechanism for supporting the image supporter from the inside at the exposure position, so that the behavior of the image supporter at the exposure position becomes stable and therefore exposure position variations are decreased; as a result, a high-quality image, particularly a high-quality color image can be provided.

(h) The disk-like members are rotated at the same time. Thus, a twist force does not act on the image supporter like a thin cylinder or becomes extremely small if it acts on the image supporter. As a result, the image supporter can be well rotated without laboring although it is shaped like a thin cylinder.

(i) Gang mechanisms for ganging together the disk-like members is disposed inside the image supporter, so that the disk-like members can be driven in a simple composition as compared with the case where they are driven separately.

Moreover, the gang mechanisms are disposed inside the image support, thus an increase in the size of the unit can be prevented.

(j) The gang mechanisms comprise a gang shaft placed in parallel with the shaft inside the image supporter and a pair of gears fixed to the gang shaft at both ends thereof and meshing with gears disposed in the disk-like members, thus the disk-like members can be ganged together reliably.

(k) The gang mechanisms are provided with backlash prevention means, thus the disk-like members can be ganged together accurately.

The image support apparatus according to the fourth aspect of the present invention can produce the following functions and effects:

(a) The member coming in sliding contact with the inner peripheral surface of the image supporter, and one backup mechanism serves as both the backup mechanism at the abutment position of the abutment member and the backup mechanism at the exposure position. Thus, stable behavior of the image supporter from the abutment position of the abutment member to the exposure position is enabled and the structure can be simplified, resulting in cost reduction.

(b) The backup mechanism supports the image support at least at the exposure position toward the outside slightly from a rotation path of the image supporter formed if the backup mechanism does not exist. Thus, the behavior of the image supporter at the exposure position becomes still more stable and a still more accurate exposure state can be provided.

The image support apparatus according to the fifth aspect of the present invention can produce the following functions and effects:

In the image support apparatus, the disk-like members are formed with the support members for supporting the image support at the ends thereof from the inside in the circumferential direction. The support member has the cylindrical face having the outer diameter larger than the inner diameter of the image supporter before supported on the support member and the truncated cone face adjoining the cylindrical face. The truncated cone face has the tip diameter made smaller than the inner diameter of the image supporter before supported on the support member. Thus, if the support member is inserted into the end of the image supporter from the tip side of the truncated cone face, the end of the image supporter first comes in contact with the truncated cone face of the support member. Then, if inserting of the support member is continued, the end of the image supporter is pressed and widened equally throughout in the circumferential direction along the truncated cone face, arrives at the cylindrical face of the support member and is supported on the cylindrical face with the end coming in intimate contact with the cylindrical face of the support member because of the elasticity of the image support itself.

That is, if there is tolerance between the support member and the image supporter, the cylindrical face of the support member has the outer diameter larger than the inner diameter of the image supporter before supported on the support member and the tip diameter of the truncated cone face of the support member is made smaller than the inner diameter of the image supporter before supported on the support member thus the support member is inserted into the end of the image supporter from the tip side of the truncated cone face, whereby the end of the image supporter can be supported on the cylindrical face smoothly and reliably with the end coming in intimate contact with the cylindrical face of the support member.

The cylindrical faces can be worked with high accuracy as compared with the truncated cone face and high roundness can be provided. As a result, the roundness of the image support supported on the cylindrical faces in the intimate contact state can also be improved.

The image support apparatus can be manufactured by inserting the support members into the ends of the image supporter. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image support member described in Unexamined Japanese Patent Publication No. Sho 58-86550 (see FIG. 51) are also eliminated, so that the image support apparatus 100 can be manufactured easily.

Thus, the image support apparatus of the present invention can produce the effects of improving the roundness, providing a reliable and stable contact state with the abutment members such as the hard roller, and easy manufacturing.

The image support apparatus according to the sixth and eighth aspects of the present invention can produce the following functions and effects:

(a) The image supporter like a thin cylinder is supported and fixed at both ends by the disk-like members attached rotatably to the shaft. Thus, when the disk-like members are rotated, the image supporter is rotated reliably.

Since the image supporter is supported and fixed at both ends by the disk-like members, excellent durability is also provided.

(b) The image supporter is shaped like a thin cylinder having flexibility and is supported at both ends by the disk-like members, thus the center portion of the image supporter not supported by the disk-like members can be deformed inwardly.

Therefore, the portion of the center portion of the image supporter where the backup mechanism is not disposed can be used as an artificial soft material. Even if the member abutted against it is a hard roller, a reliable and stable contact state can be provided and an image can be formed or supported reliably on the image supporter.

On the other hand, the abutment members such as so-called process members (the charge member, the developing member, etc.,) are abutted against the outer peripheral surface of the image supporter. At the abutment positions, the image supporter is supported from the inside by the backup mechanisms, so that the abutment members can be abutted reliably.

Moreover, assuming that the abutment member is abutted against the image supporter in a state in which the backup mechanisms do not exist, it is feared that the image supporter like a thin cylinder may become creep-deformed. However, the image support apparatus of the present invention also eliminates such a fear.

(c) The image supporter is supported and fixed at both ends by the disk-like members attached rotatably to the shaft and the backup mechanisms are attached to the shaft inside the image supporter, whereby they are put into a unit for easy handling.

(d) The backup mechanisms support the image supporter from the inside thereof with the backup mechanisms urged by the urging means, so that positional accuracy between the image supporter and the backup mechanisms is enhanced.

Moreover, the disk-like members are provided with the positioning parts for positioning the backup mechanism in the support direction and the image supporter in the radial direction at the same time, namely, the image supporter and the backup mechanism are positioned by the common positioning parts, so that positional accuracy between the image supporter and the backup mechanism is more enhanced.

Further, the urging force of the urging means is received at the positioning parts, so that an unnecessary force can be prevented from acting on the image supporter. Therefore, wear of the inner face of the image supporter can be decreased.

Thus, the image support apparatus of the present invention can provide a reliable and stable contact state with the abutment members, is excellent in durability and handleability, and can be driven reliably.

(e) The abutment member is a cleaning member for removing the developer remaining on the outer peripheral surface of the image supporter. Thus, the cleaning member can be reliably abutted against the image supporter for reliably removing the developer (for example, toner) remaining on the outer peripheral surface of the image supporter.

(f) The backup mechanism is made of a rotatable roller, so that the load on the image supporter can be lessened and therefore the drive torque of the image supporter can be decreased.

(g) In the image support apparatus, the disk-like members are formed with the support members concentric with the image supporter for supporting the image supporter at the ends thereof and the elastic rings each made of an elastic body are placed via the ends of the image supporter on the support members. The regulation parts for regulating deformation other than deformation of the elastic rings toward the support members are disposed on the opposite side to the support members with respect to the elastic rings and the ring-like press members for pressing the elastic rings axially are provided. Thus, when the elastic rings are pressed by the press members, they become deformed so as to swell to the support members almost equally in the circumferential direction, causing the ends of the image supporter to be sandwiched and fixed between the elastic rings and the support members.

Therefore, the ends of the image supporter fixed become parallel to the support members, which are concentric with the image supporter and can be prepared with high roundness. As a result, the roundness of the image supporter supported and fixed at both ends by the support members of the disk-like members can also be improved.

Moreover, the support members are adapted to support the ends of the image supporter from the outside in the circumferential direction and the elastic rings are placed inside in the circumferential direction via the ends of the image supporter on the support members. Thus, when the elastic rings are pressed by the press members, they become deformed so as to swell outward in the circumferential direction, causing the ends of the image supporter to be widened outward in the circumferential direction and sandwiched between the elastic rings and the support members.

Therefore, asperities viewed from the axial direction do not occur at the ends of the image supporter, resulting in more improvement in the roundness of the image supporter.

The image support apparatus can be manufactured by placing the members as described above and pressing the elastic rings by the press members for fixing the ends of the image supporter. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image supporter member described in Unexamined Japanese Patent Publication No. Sho 58-86550 (see FIG. 51) are also eliminated, so that the image support apparatus 100 can be manufactured easily.

That is, the image support apparatus of the present invention can produce the effects of improving the roundness, providing a reliable and stable contact state with the abutment members such as the hard roller, and easy manufacturing.

Moreover, pressing of the elastic rings by the press members is released, whereby the ends of the image supporter can be unfixed and the image supporter, a consumable article, and the disk-like members, etc., that can be used for a long term can be disassembled, so that the effect of recycling the parts other than the image supporter can also be produced.

The image support apparatus according to the seventh aspect of the present invention can produce the following functions and effects:

The positioning rollers abut the inner peripheral surfaces of the support members of the disk-like members, thereby positioning the backup roller. That is, the urging force of urging mechanism is received by the support members, so that an unnecessary force can be prevented from acting on an image supporter. Therefore, wear of the inner face of the image supporter can be decreased. The need for producing excessive fixation strength of the image supporter to the support members is eliminated and cost reduction is also enabled.

The image support apparatus according to the ninth aspect of the present invention can produce the following functions and effects:

In the image support apparatus, the disk-like members are formed with the support members concentric with the image supporter for supporting the image supporter at the ends thereof and the elastic rings each shaped like C opened at both ends are placed via the ends of the image supporter on the support members. The press and widening mechanisms for pressing and widening the gap between the open ends of the elastic ring is provided. Thus, if the gap between the open ends of the elastic ring is pressed and widened by the press and widening mechanisms, the elastic ring widens to the support member almost equally in the circumferential direction, causing the end of the image supporter to be sandwiched and fixed between the support member and the elastic ring.

Therefore, the ends of the image supporter fixed become parallel to the support members, which are concentric with the image supporter and can be prepared with high roundness. As a result, the roundness of the image supporter supported and fixed at both ends by the support members of the disk-like members can also be improved.

Moreover, the support members are adapted to support the ends of the image supporter from the outside in the circumferential direction and the elastic rings are placed inside in the circumferential direction via the ends of the image supporter on the support members. Thus, the elastic ring is widened, whereby the end of the image supporter is pressed and widened outward in the circumferential direction and is sandwiched between the elastic ring and the support member.

Therefore, asperities viewed from the axial direction do not occur at the ends of the image supporter, resulting in more improvement in the roundness of the image supporter.

Further, the image support apparatus can be manufactured by placing the members as described above and widening the elastic rings by the press and widening mechanisms members for fixing the ends of the image supporter. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image supporter member described in Unexamined Japanese Patent Publication No. Sho 58-86550 (see FIG. 51) are also eliminated, so that the image support apparatus can be manufactured easily.

That is, the image support apparatus of the present invention can produce the effects of improving the roundness, providing a reliable and stable contact state with the abutment members such as the hard roller, and easy manufacturing.

Moreover, widening of the elastic rings by the press and widening mechanisms is released, whereby the ends of the image supporter can be unfixed and the image supporter, a consumable article, and the disk-like members, etc., that can be used for a long term can be disassembled, so that the effect of recycling the parts other than the image supporter can also be produced.

Further, since the elastic rings can be made of material other than rubber, such as metal, there is no fear of contaminating the surface of the image supporter because of an exuding plasticizing agent, etc.

The image support apparatus according to the tenth aspect of the present invention can produce the following functions and effects:

In the image support apparatus, the disk-like members are formed with the support members concentric with the image supporter for supporting the image supporter at the ends thereof and the elastic rings each shaped like C opened at both ends are placed via the ends of the image supporter on the support members. The tightening mechanisms for tightening the elastic ring in the direction narrowing the gap between the open ends of the elastic ring is provided. Thus, if the elastic ring is tightened in the direction narrowing the gap between the open ends of the elastic ring by the tightening mechanisms, the elastic ring contracts to the support member almost equally in the circumferential direction, causing the end of the image supporter to be sandwiched and fixed between the support member and the elastic ring.

Therefore, the ends of the image supporter fixed become parallel to the support members, which are concentric with the image supporter and can be prepared with high roundness. As a result, the roundness of the image supporter supported and fixed at both ends by the support members of the disk-like members can also be improved.

Further, the image support apparatus can be manufactured by placing the members as described above and tightening the elastic rings by the tightening mechanisms for fixing the ends of the image supporter. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image supporter member described in Unexamined Japanese Patent Publication No. Sho 58-86550 (see FIG. 51) are also eliminated, so that the image support apparatus can be manufactured easily.

That is, the image support apparatus of the present invention can produce the effects of improving the roundness, providing a reliable and stable contact state with the abutment members such as the hard roller, and easy manufacturing.

Moreover, tightening of the elastic rings by the tightening mechanisms is released, whereby the ends of the image supporter can be unfixed and the image supporter, a consumable article, and the disk-like members, etc., that can be used for a long term can be disassembled, so that the effect of recycling the parts other than the image supporter can also be produced.

Further, since the elastic rings can be made of material other than rubber, such as metal, there is no fear of contaminating the surface of the image supporter because of an exuding plasticizing agent, etc.

Since the support members are adapted to support the ends of the image supporter from the inside in the circumferential direction and the elastic rings are placed outside in the circumferential direction via the ends of the image supporter on the support members, the effective use of the space inside the support members in the circumferential direction can also be made.

The image support apparatus according to the eleventh aspect of the present invention can produce the following functions and effects:

(a) Since the backup mechanisms made of elastic substance support the image supporter from the inside thereof at near the abutment positions where the developing rollers are abutted against the image supporter from the outside thereof, vibration of the image supporter is suppressed and a stable contact state with the developing rollers can be provided, resulting in suppression of jitter and inconsistencies in density.

The backup mechanisms, which are made of elastic substance, do not block inward deformation of the center portion of the image supporter.

Thus, the image support apparatus of the present invention can provide a reliable and stable abutment state against the hard developing rollers and can be driven reliably.

(b) The image support apparatus further includes the urging means for urging the backup mechanism in the support direction thereof and the positioning parts being disposed in the disk-like members for positioning the backup mechanism in the support direction in the image support apparatus of the present invention, so that positional accuracy between the image supporter and the backup mechanism is enhanced.

That is, the disk-like members are provided with the positioning parts for positioning the backup mechanisms in the support direction and the urging force of the urging means is received at the positioning parts, so that an unnecessary force can be prevented from acting on the image supporter.

Therefore, the image support apparatus of the present invention can decrease the drive torque of the image supporter while suppressing vibration of the image supporter.

(c) The backup mechanism is made of a rotatable roller, thus a smooth rotation state of the image supporter can be provided and the load on the image supporter can be lessened.

Therefore, the image support apparatus of the present invention can more decrease the drive torque of the image supporter while suppressing vibration of the image supporter.

The image support apparatus according to the twelfth aspect of the present invention can produce the following functions and effects:

(a) Since the backup mechanisms made of elastic substance support the image supporter from the inside thereof near the abutment positions where the developing rollers are abutted against the image supporter from the outside thereof, vibration of the image supporter is suppressed and a stable contact state with the developing rollers can be provided, resulting in suppression of jitter and inconsistencies in density.

For the backup mechanisms made of elastic substance to support the image supporter from the inside thereof, it is also possible that the backup mechanisms are placed at the abutment positions of the developing rollers. In doing so, if the backup mechanisms are not placed correctly in parallel with the axis of the image supporter or are uneven in softness (hardness), it is feared that the contact force between the developing rollers and the image supporter may become uneven, causing image unevenness.

In contrast, according to the image support apparatus of the present invention, the backup mechanisms made of elastic substance are placed near the abutment positions of the image supporter and the developing rollers rather than at the abutment positions. Thus, if the backup mechanisms are not placed correctly in parallel with the axis of the image supporter or are uneven in softness (hardness), an influence is hard to exert upon the abutment positions of the image supporter and the developing rollers and therefore the contact force between the developing rollers and the image supporter easily becomes even at the abutment positions of the image supporter and the developing rollers.

Therefore, according to the image support apparatus of the present invention, image unevenness becomes harder to occur.

Thus, the image support apparatus of the present invention can provide a reliable and stable abutment state against the hard developing rollers and can be driven reliably.

(b) If there are a plurality of the developing roller abutment positions in the image support apparatus, the backup mechanisms are placed each between the abutment positions of the developing rollers, so that the number of the backup mechanisms can be decremented by one as compared with placement of the backup mechanisms at the abutment positions in a one-to-one correspondence with each other.

BRIEF DESCRIPTION OF THE DRAWINGS

FIG. 4 (*a*) is a frontal sectional view to show a state before a image supporter 110 is attached; FIG. 4(*c*) is a partial left side view of FIG. 4 (*a*); FIG. 4(*e*) is a schematic representation of function; FIG. 4(*b*) is a frontal sectional view to show a state after the image supporter 110 is attached; FIG. 4(*d*) is a partial left side view of FIG. 4(*b*); and FIG. 4(*f*) is a left side view to show a state after the image supporter 110 is attached;

FIG. 5(*a*) is a side view and FIG. 5(*b*) is a plan view;

FIG. 29(*a*) is an exploded part front view and FIG. 29(*b*) is an exploded side view;

FIG. 30(*a*) is a transverse sectional view (sectional view taken on line 30*a*–30*a* in FIG. 30(*b*)) and FIG. 30(*b*) is a fragmentary side view;

FIG. 44(*a*) is an exploded part front view and FIG. 44(*b*) is a side view;

FIG. 46(*a*) is an exploded part front view and FIG. 46(*b*) is a side view;

DETAILED DESCRIPTION OF THE PREFERRED EMBODIMENTS

Referring now to the accompanying drawings, there are shown preferred embodiments of the present invention.

First Embodiment

Figure 1:
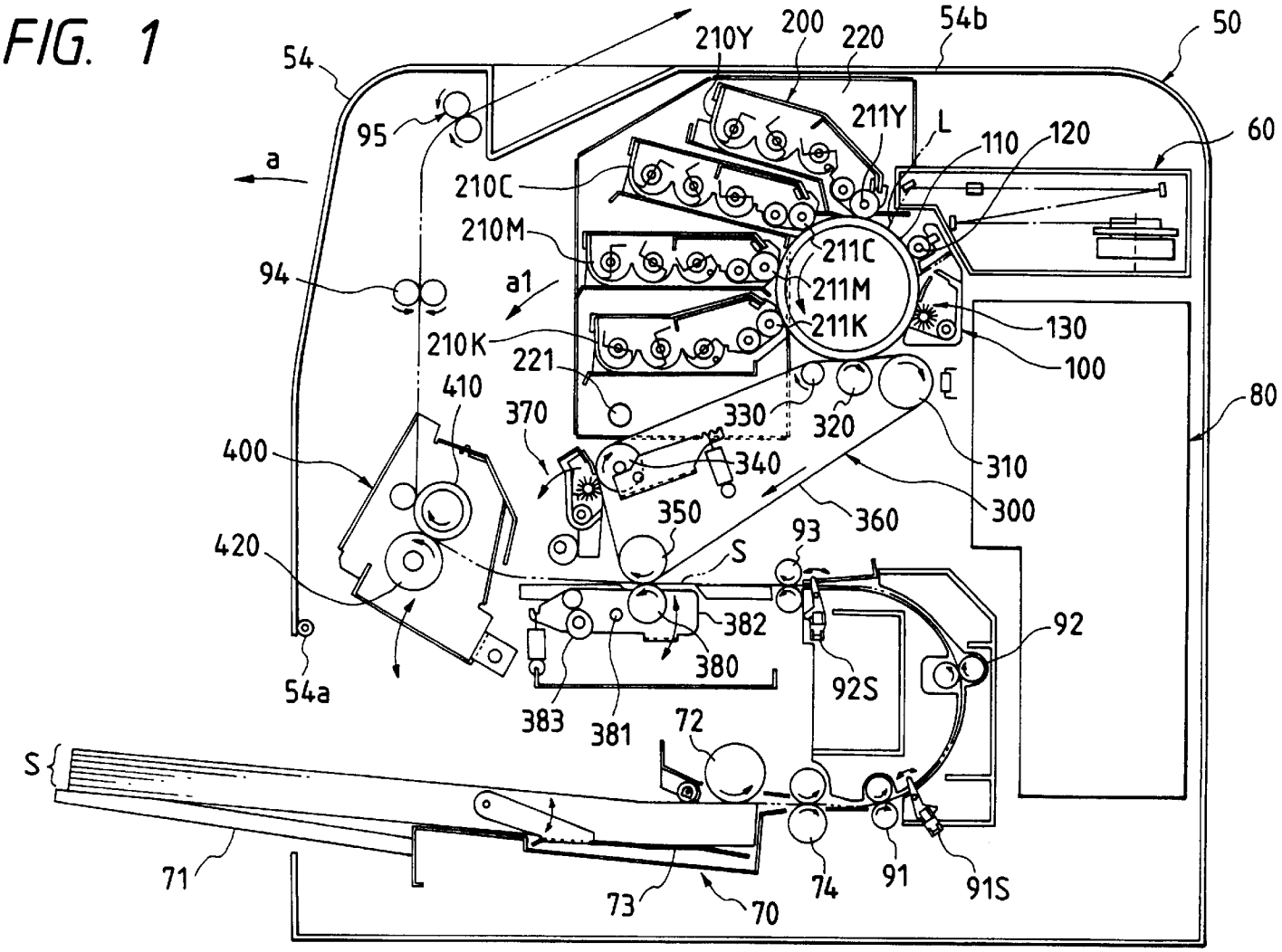
FIG. 1 is a schematic drawing to show a first embodiment of a image support apparatus and an image formation system according to the present invention.

FIG. 1 is a schematic drawing to show a first embodiment of an image support apparatus and an image formation system according to the present invention.

First, the image formation system will be outlined, next the image support apparatus will be mainly discussed in detail.

The image formation system can form a full color image with four color toners of yellow, cyan, magenta, and black.

In FIG. 1, numeral 50 is a case of the system main body. The case 50 contains an exposure unit 60, a paper feeder 70, an image support apparatus 100, a developing unit 200, an intermediate transfer unit 300, a fixing unit 400, a control unit 80 for controlling the whole system, etc.

The image support apparatus 100, discussed later in detail, comprises a image supporter 110, a charge roller 120 as charge means abutting the outer peripheral surface of the image supporter 110 for uniformly charging the outer peripheral surface, and cleaning means 130.

The developing unit 200 comprises yellow developing means 210Y, cyan developing means 210C, magenta developing means 210M, and black developing means 210K. The developing means 210Y, 210C, 210M, and 210K contain yellow, cyan, magenta, and black toners respectively and only any one of the developing means can abut the image supporter 110. Numeral 211 (Y, M, C, K) is a developing roller abutting the image supporter 110; it is made of a metal roller having a roughed surface or a hard resin roller.

The intermediate transfer unit 300 comprises a drive roller 310, a primary transfer roller 320, a smoothing roller 330, a tension roller 340, a backup roller 350, an endless intermediate transfer belt 360 placed on the rollers, and cleaning means 370 that can be attached to and detached from the intermediate transfer belt 360.

A secondary transfer roller 380 is placed facing the backup roller 350. It is supported rotatably on an arm 382 supported swingably with a support stem 381; the arm 382 swings by the action of a cam 383, whereby the secondary transfer roller 380 is attached to or detached from the intermediate transfer belt 360.

A gear 311 (see FIG. 8) is fixed to the drive roller 310 at one end and meshes with a gear (144 in FIG. 8) of the image support apparatus 100, whereby the drive roller 310 is rotated substantially at the same peripheral speed as the image supporter 110 and therefore the intermediate transfer belt 360 is circulated substantially at the same peripheral speed as the image supporter 110.

While the intermediate transfer belt 360 is circulated, a toner image on the image supporter 110 is transferred onto the intermediate transfer belt 360 between the primary transfer roller 320 and the image supporter 110 and the toner image transferred onto the intermediate transfer belt 360 is transferred a recording medium S such as paper supplied between the intermediate transfer belt 360 and the secondary transfer roller 380. The recording medium S is supplied from the paper feeder 70.

The paper feeder 70 comprises a tray 71 on which sheets of recording media S are piled up, a pick-up roller 72, a hopper 73 for urging the recording media S stacked on the tray 71 toward the pick-up roller 72, and a separation roller pair 74 for reliably separating paper fed by the pick-up roller 72 into one sheet at a time.

The recording medium S fed by the paper feeder 70 is passed through a first transport roller pair 91, a first paper sensor 91S, a second transport roller pair 92, a second paper sensor 92S, and a gate roller pair 93 and is supplied to a second transfer section, namely, between the intermediate transfer belt 360 and the secondary transfer roller 380, then is passed through the fixing unit 400, a first paper discharge roller pair 94, and a second paper discharge roller pair 95 and is discharged onto the case 50.

The fixing unit 400 comprises a fixing roller 410 having a heat source and a pressurization roller 420 pressed against the fixing roller 410.

The operation of the image formation system is as follows:

(i) When a print command signal (image formation signal) from a host computer, such as a personal computer, (not shown) is input to the control unit 80, the image supporter 110 and the intermediate transfer belt 360 are rotated.

(ii) The outer peripheral surface of the image supporter 110 is uniformly charged by the charge roller 120.

(iii) The outer peripheral surface of the image supporter 110 uniformly charged is selectively exposed to light L in response to image information of the first color (for example, yellow) by the exposure unit 60 for forming a yellow electrostatic latent image.

(iv) Only the developing means 210Y for the first color (in this case, yellow) comes in contact with the image supporter 110, whereby the electrostatic latent image is developed and a toner image of the first color (in this case, yellow) is formed on the image supporter 110.

(v) The toner image formed on the image supporter 110 is transferred onto the intermediate transfer belt 360 in a primary transfer section, namely, between the image supporter 110 and the primary transfer roller 320. At this time, the cleaning means 370 and the secondary transfer roller 380 are detached from the intermediate transfer belt 360.

Figure 6:
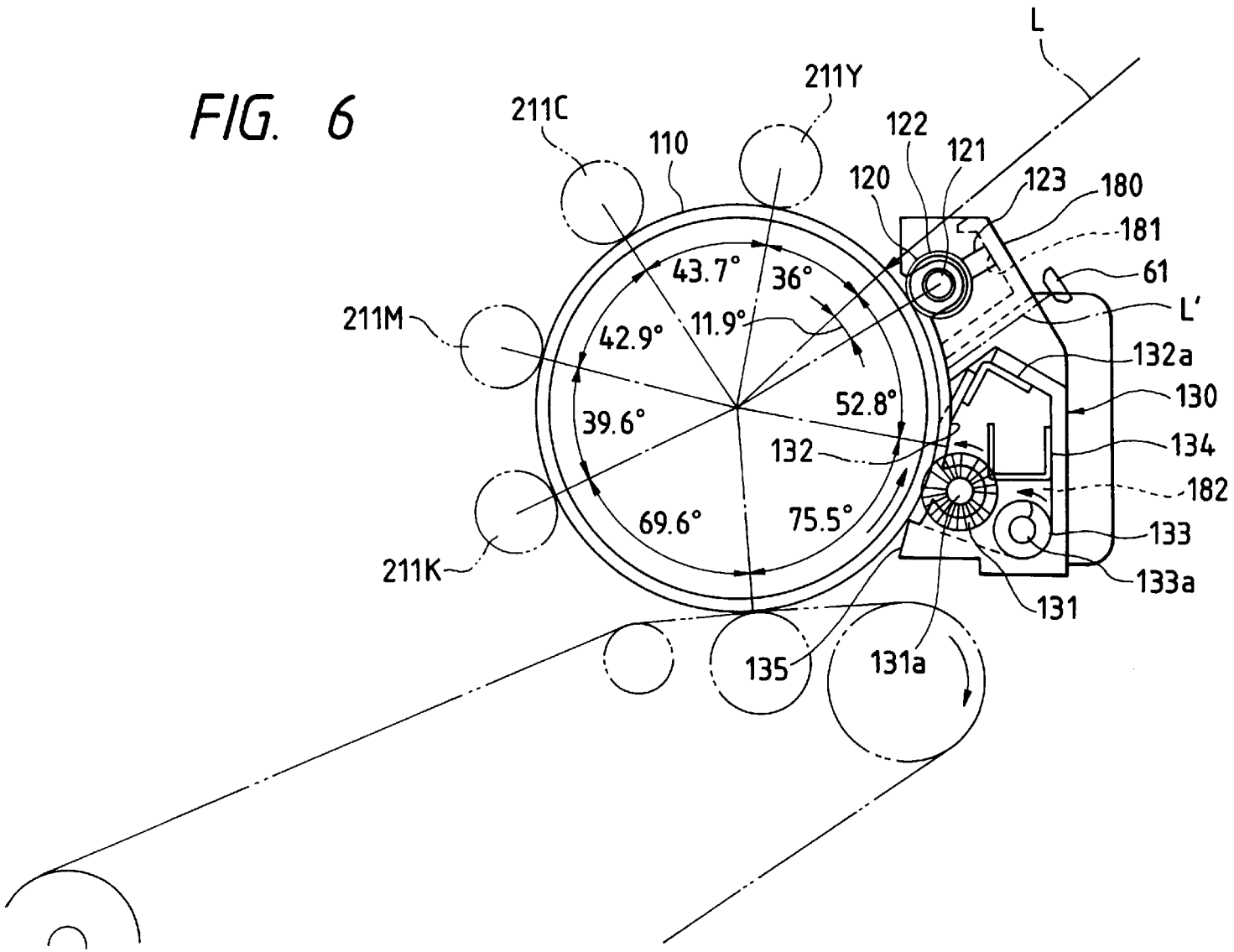
FIG. 6 is a partial side view of the image support apparatus 100.

(vi) The toner remaining on the image supporter 110 is removed by the cleaning means 130, then electricity of the image supporter 110 is eliminated by static elimination means (61 in FIG. 6).

(vii) The operation in (ii) to (vi) is repeated as required. That is, the operation is repeated for the second color, the third color, and the fourth color in response to the contents of the print command signal and the toner images responsive to the contents of the print command signal are superimposed on the intermediate transfer belt 360.

(viii) A recording medium S is supplied from the paper feeder 70 at a predetermined timing and just before or after the tip of the recording medium S arrives at the second transfer section (in short, at the timing at which the toner image on the intermediate transfer belt 360 is transferred to a desired position on the recording medium S), the secondary transfer roller 380 is pressed against the intermediate transfer belt 360 and the toner image on the intermediate transfer belt 360 (basically, a full color image) is transferred onto the recording medium S. The cleaning means 370 abuts the intermediate transfer belt 360 and removes the toner left on the intermediate transfer belt 360 after the secondary transfer.

(ix) The recording medium S is passed through the fixing unit 400, whereby the toner image is fixed on the recording medium S, then the recording medium S is discharged through the paper discharge roller pairs 94 and 95 onto the case 50.

We have outlined the image formation system. Next, the image support apparatus 100 will be discussed in detail.

The image support apparatus 100 comprises the image supporter 110, the charge roller 120 as charge means abutting the outer peripheral surface of the image supporter 110 for uniformly charging the outer peripheral surface, and the cleaning means 130, as described above. It further includes support members for supporting the image supporter 110 at both ends thereof and a frame, as described later.

Figure 2:
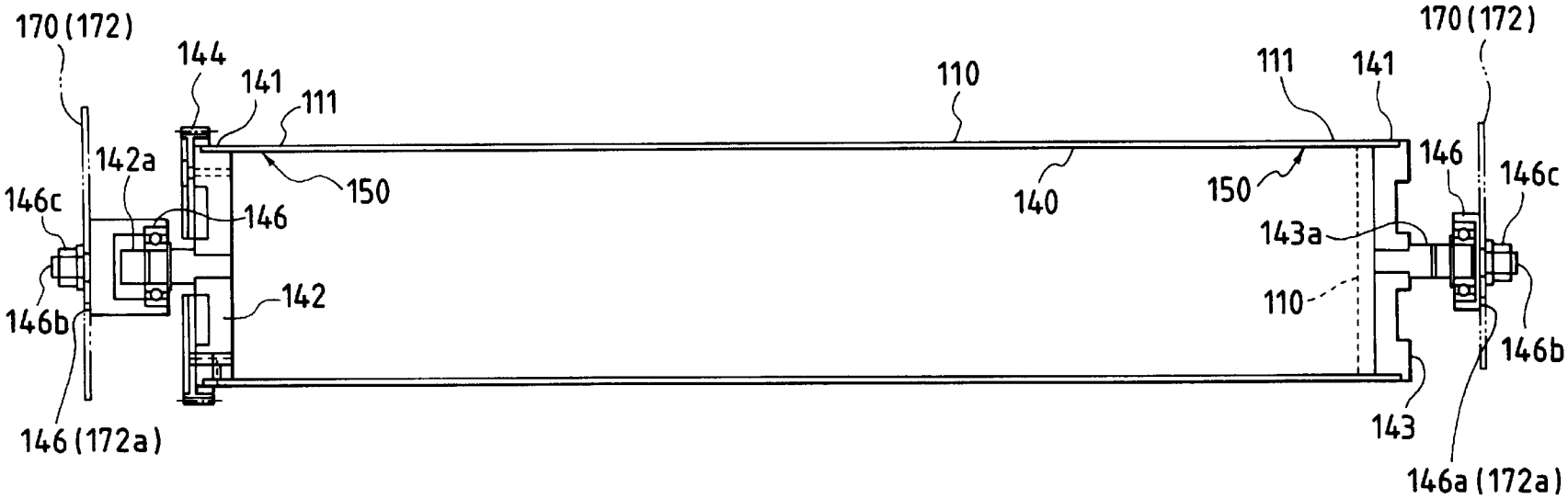
FIG. 2 is a frontal sectional view to show a first example of a image supporter and support members thereof.
Figure 3:
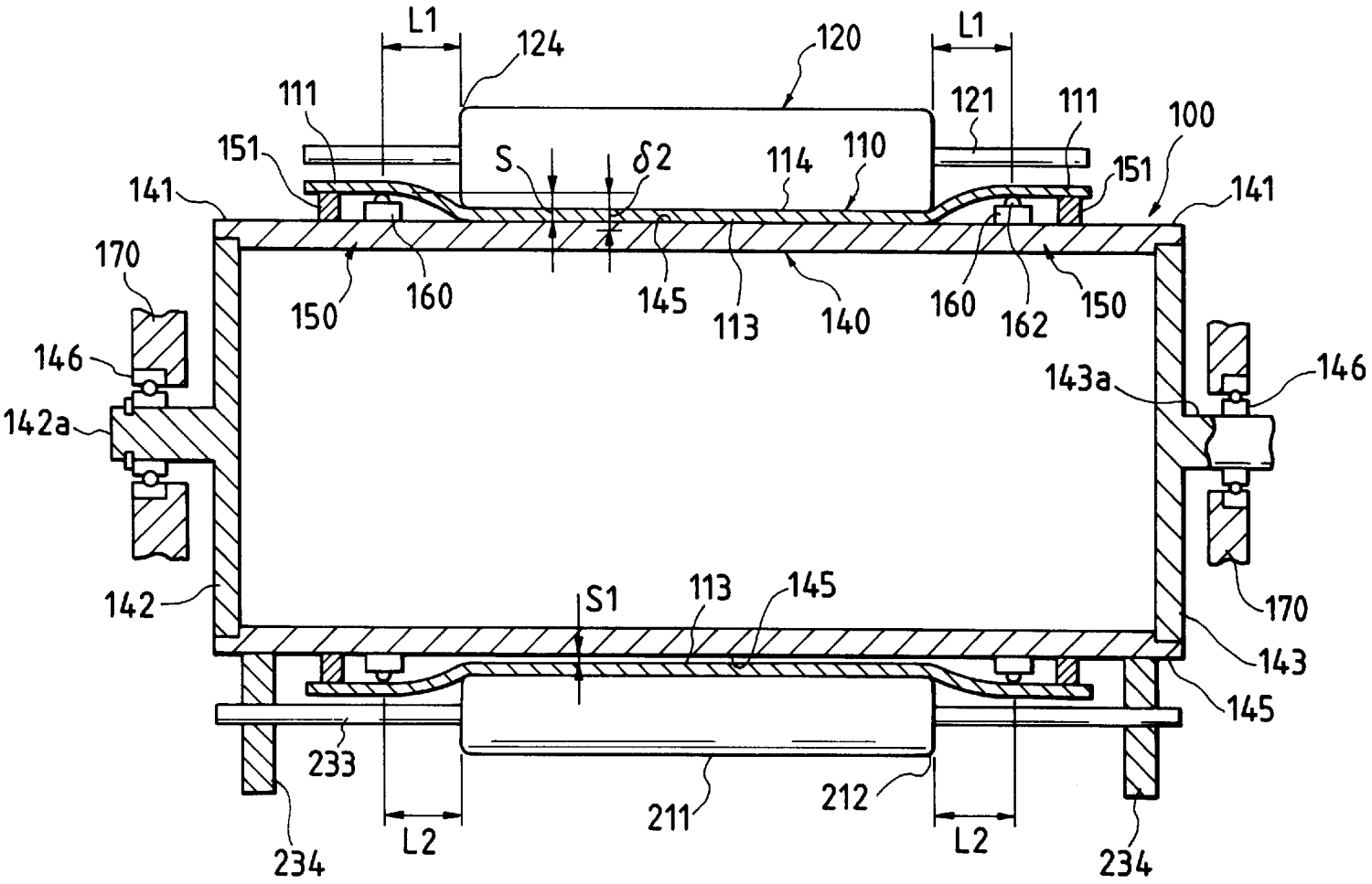
FIG. 3 is a schematic diagram to show the image supporter and the support members, also showing a charge roller 120 and a developing roller 211.
Figure 4A:
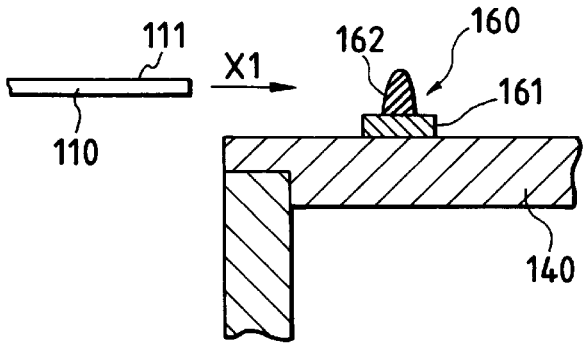
FIGS. 4(*a*)–4(*f*) relate to a spacer 160.
Figure 4B:
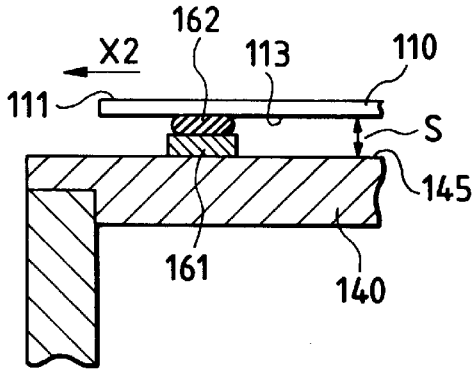
Figure 4C:
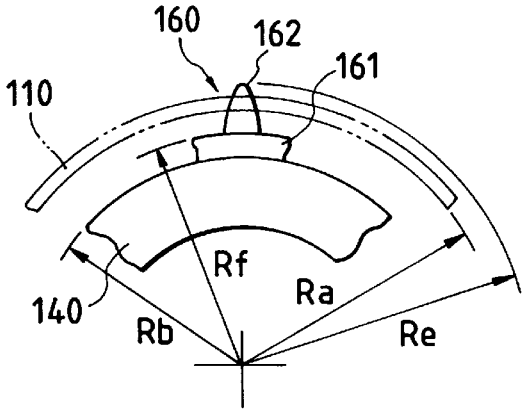
Figure 4D:
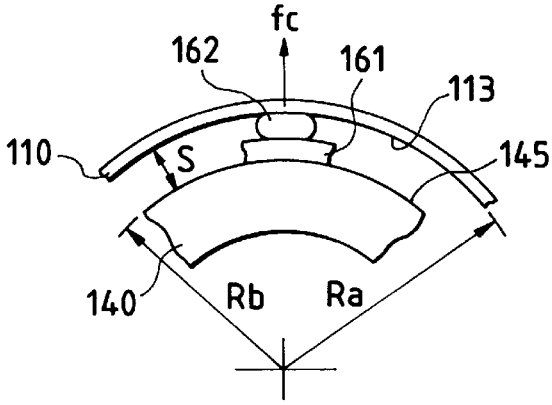
Figure 4E:
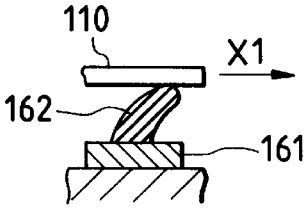
Figure 4F:
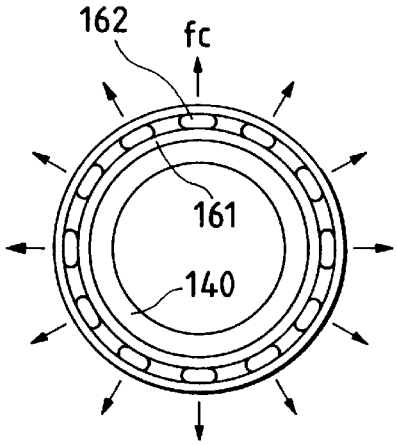

FIG. 2 is a frontal sectional view to show a first example of the image supporter and the support members thereof. FIG. 3 is a schematic diagram to show the image supporter and the support members, also showing the charge roller 120 and the developing roller 211 of the developing means (see FIG. 1).

In the figures, numeral 140 is a cylindrical member having an outer diameter smaller than the inner diameter of the image supporter 110; it is placed inside the image supporter 110.

Numeral 150 is a pair of support members being disposed between the cylindrical member 140 and the image supporter 110 for supporting the image supporter 110 at both ends 111 and 111 on the cylindrical member 140.

The image supporter 110 is formed like a thin cylinder having flexibility; it comprises a photosensitive layer formed on the surface (outer peripheral surface) of a base material having flexibility. For example, a nickel seamless pipe prepared by an electric casting method can be used as the base material. The photosensitive layer can be formed of a so-called OPC (organic photo-conductor) by a dipping method. The flexibility of the image supporter 110 can be determined by adjusting the thickness and diameter of the base material, thus can be set appropriately in response to the image formation system using the image supporter 110. For example, it is set appropriately so that allowable deformation amount δ2 (described later) becomes about 20–500 μm in the ranges of 20–200 μm as the base material thickness and 10–300 mm as the base material diameter. The OPC, which consists essentially of a resin, is excellent in flexibility, but it is desirable to form an underlaying layer between the base material and the OPC to provide intimate contact with the base material and take interference countermeasures against a laser beam. Preferably, the underlaying layer is a layer formed by dispersing particles of zinc oxide, titanium oxide, etc., that can absorb a laser beam in a resin such as a nylon resin.

The support member 150 comprises a fixation member 151 and a spacer 160. The fixation member 151 and the spacer 160 are placed each like an annular ring on the outer peripheral surface of the cylindrical member 140 and disposed between the cylindrical member 140 and the image supporter 110.

In the embodiment, the fixation member 151 is made of a conductive bonding agent comprising conductive particles dispersed in an epoxy-family, cyano-family, or acrylic-family resin boding agent, for example. Metal (silver, aluminum, etc.,), carbon, etc., can be used as the conductive particles.

FIGS. 4(*a*)–4(*f*) show an example of the spacer 160. FIG. 4 (*a*) is a frontal sectional view to show a state before the image supporter 110 is attached; FIG. 4(*c*) is a partial left side view of FIG. 4(*a*); FIG. 4(*e*) is a schematic representation of function; FIG. 4(*b*) is a frontal sectional view to show a state after the image supporter 110 is attached; FIG. 4(*d*) is a partial left side view of FIG. 4(*b*); and FIG. 4(*f*) is a left side view to show a state after the image supporter 110 is attached.

As shown in FIGS. 4(*a*)–4(*f*), the spacer 160 in the embodiment comprises a base 161 like a thin ring fixedly secured to an outer peripheral surface 145 of the cylindrical member 140 and elastic projections from the outer peripheral surface of the base 161. The base 161 is made of a metal or a synthetic resin, for example, and the elastic projections 162 are made of silicone rubber, for example. As shown in FIG. 4(f), a number of elastic projections 162 (in the figure, 12 projections) are equally spaced from each other in the circumferential direction of the base 161. As shown in FIG. 4(*c*), an outer diameter Rf of the base 161 is set smaller than an inner diameter Ra of the image supporter 110 and a radius of a circle connecting the tips of the elastic projections 162 before the image supporter 110 is attached (distance between the center of the image supporter 110 and the tip of the elastic projection 162), Re, is set larger than the inner diameter Ra of the image supporter 110. The base 161 is about 100 μm thick and the elastic projections 162 are about 100 μm high with the image supporter 110 attached as shown in FIGS. 4(*b*) and (*d*). For example, the elastic projections 162 can be formed by printing silicone-family rubber paint on the surface of the base 161.

After the image supporter 110 is put over the cylindrical member 140 or after the cylindrical member 140 is inserted into the image supporter 110, the bonding agent 151 is poured between both ends 111 and the outer peripheral surface of the cylindrical member 140, thereby fixedly securing the image supporter 110 onto the cylindrical member 140.

At this time, the spacer 160 functions as follows:

When the image supporter 110 is put over the cylindrical member 140 as indicated by arrow X1 in FIG. 4(*a*) or the cylindrical member 140 is inserted into the image supporter 110, the tip of the spacer 160 comes in contact with the inner face of the image supporter 110, is pushed in the arrow X1 direction, and becomes deformed temporarily in the arrow X1 direction, as shown in FIG. 4(*e*).

Then, when the cylindrical member 140 is completely inserted into the image supporter 110 and the external force acting in the arrow X1 direction is lost, the spacer 160 pushes back a little the image supporter 110 in the arrow X2 direction as shown in FIG. 4(*b*) by the elastic force (restoring force) of the spacer itself and is crushed as shown here, supporting the image supporter 110 from the inside by the elasticity of the spacer itself.

Since a number of elastic projections 162 are equally spaced from each other in the circumferential direction of the base 161, as shown in FIG. 4(*f*), elastic force (restoring force) fc of the elastic projections 162 acts on the image supporter 110 almost evenly. As a result, the image supporter 110 is mounted on the cylindrical member 140 in a state in which spacing S between the image supporter 110 and the cylindrical member 140 becomes almost even (namely, in a substantially perfect circle state), as shown in FIG. 4(*d*). In such a state, the bonding agent 151 (see FIG. 3) is poured between both ends 111 of the image supporter 110 and the outer peripheral surface of the cylindrical member 140, thereby fixedly securing the image supporter 110 onto the cylindrical member 140.

The spacing S between the outer peripheral surface 145 of the cylindrical member 140 and an inner peripheral surface 113 of the image supporter 110 is set smaller than the allowable deformation amount of the image supporter 110, namely, the deformation amount $\delta 2$ (see FIG. 3) in which the image supporter 110 is destroyed when it is deformed inwardly.

As shown in FIGS. 2 and 3, the cylindrical member 140 is fixed at both ends 141 and 141 to disk-like side plates 142 and 143. The cylindrical member 140 and the side plates 142 and 143 are made of highly rigid material such as metal or synthetic resin extremely hard to deform. To make them of synthetic resin, a metal such as aluminum, nickel, or copper is evaporated on the synthetic resin, a conductive layer is formed by plating, etc., or a conductive material of carbon, etc., is entered in resin to give conductivity.

The cylindrical member 140 can be fixed to the side plates 142 and 143 by appropriate means, such as bonding, pressing, or crimping. The side plates 142 and 143 are integral with shafts 142*a* and 143*a*, which are supported rotatably on a frame 170 of the image support apparatus 100. Numerals 146 and 146 are bearings. A gear 144 fixed to one side plate 142, as shown in FIG. 2.

Figure 5A:
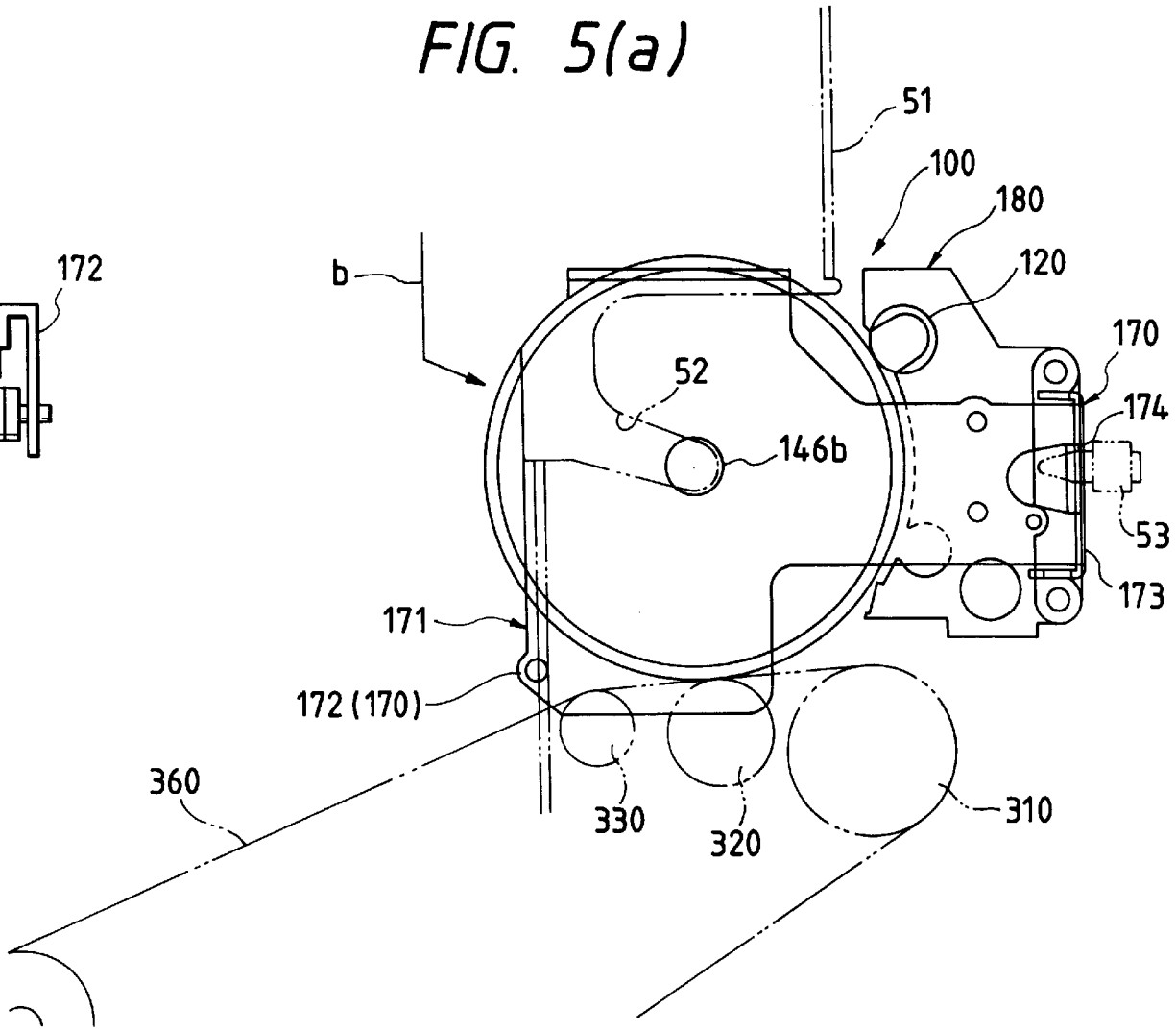
FIGS. 5(*a*) and 5(*b*) relate to a frame structure of the image support apparatus 100.
Figure 5B:
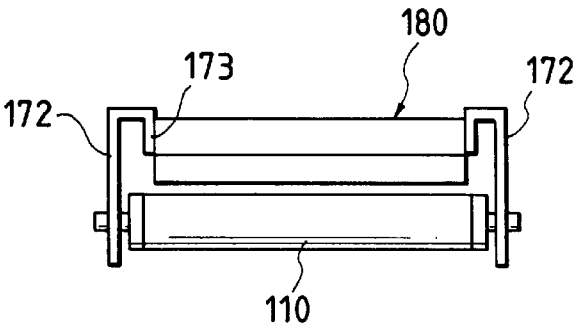

FIGS. 5(*a*) and 5(*b*) are a side view and a schematic plan view to mainly show a frame structure of the image support apparatus 100. FIG. 6 is a partially omitted side view of the image support apparatus 100.

As shown in FIGS. 5 (*a*) and (*b*), the main frame 170 of the image support apparatus 100 comprises two main frames 172 and 172 made of plates and a subframe 180 made of synthetic resin connecting the main frames 172 and 172.

The main frame 172 comprises a metal plate bent substantially U-shape on a plan view and is fixed to the subframe 180 at both ends.

The charge roller 120 and the cleaning means 130 are built in the subframe 180.

As shown in FIG. 6, the charge roller 120 has a shaft 121 supported at both ends of the shaft 121 (in FIG. 6, only the front end is shown) rotatably on the subframe 180 via a bearing member 122 and slidably to the center of the image supporter 110 and is urged toward the image supporter 110 by compressed coil springs 123 and 123 (in FIG. 6, only the front one is shown) as urging means disposed between the bearing member 122 and a rear plate 181 of the subframe 180 so as to abut the outer peripheral surface of the image supporter 110. The charge roller 120 is made of a hard high-resistance resin roller or a metal roller having a high-resistance layer on a surface.

The cleaning means 130 comprises a fur brush 131 for brushing off toner left and deposited on the outer peripheral surface of the image supporter 110, a cleaner blade 132 for scraping off toner still left and deposited on the outer peripheral surface of the image supporter 110, and a toner transport screw 133 as transport means for transporting the toner brushed off by the fur brush 131 or scraped off by the cleaner blade 132.

A toner collection chamber 182 is formed at the bottom of the subframe 180 and houses the fur brush 131, the cleaner blade 132, and the toner transport screw 133. Numeral 134 is a fur brush regulation plate and numeral 135 is a rake sheet for preventing the toner brushed off by the fur brush 131 or scraped off by the cleaner blade 132 from scattering.

The fur brush 131 is fixed to a shaft 131*a* penetrating the subframe 180 and the main frame 172 and the shaft 131*a* is driven by drive means described later, whereby the fur brush 131 is rotated in the arrow direction in FIG. 6.

The cleaner blade 132 is attached to the subframe 180 by an attachment plate 132*a* and the tip (lower end) of the cleaner blade 132 abuts the outer peripheral surface of the image supporter 110 for scraping off toner.

The toner transport screw 133 has a shaft 133*a* penetrating the subframe 180 and the main frame 172 (see FIG. 7) and the shaft 133*a* is rotated in the arrow direction in FIG. 6 by drive means described later for transporting the toner collected in the toner collection chamber 182 as waste toner to a waste toner box (not shown).

The image support apparatus 100 is assembled by attaching the subframe 180 incorporating the members to one main frame (side plate) 172, then attaching the image supporter 110 to the main frame 172, then attaching the other main frame 172 to the subframe 180 and the image supporter 110 so as to sandwich the members between the main frames 172 and 172.

As shown in FIG. 2, the image supporter 110 is attached to the main frames 172 with good positional accuracy by engaging projections 146*a* formed on the outer side faces of the bearing members 146 in holes 172*a* made in the main frames 172 and 172 of the frame 170.

A bolt 146*b* is projected from the outer side face of the bearing member 146 and penetrates the main frame 172. On the other hand, as shown in FIG. 5, a groove 52 for accepting the bolt 146*b* is made in a side plate of a frame 51 of the image formation system main body. A positioning pin 53 is disposed on the rear face of the main body frame 51 and a hole 174 accurately fitted to the positioning pin 53 is made in the rear of the main frame 172 and the subframe 180 of the image support apparatus 100. Further, in FIG. 1, a cover 54 of the case 50 can be opened in the arrow a direction by means of a hinge 54*a* (in FIG. 1, numeral 54*b* denotes the end of the cover 54) and the developing unit 200 also has a frame 220 that can be opened in the arrow a1 direction by means of a shaft 221.

Therefore, the image support apparatus 100 can be attached to and detached from the main body frame 51 as indicated by the arrow b in FIG. 5 in a state in which the cover 54 and the developing unit 200 are opened as described above. In FIG. 2, numeral 146*c* is a lock nut.

In FIG. 6, numeral 61 is discharging light irradiation means attached to the exposure unit 60 (see FIG. 1). Electricity of the image supporter 110 is eliminated by irradiation with discharging light L' from the discharging light irradiation means 61.

Figure 8:
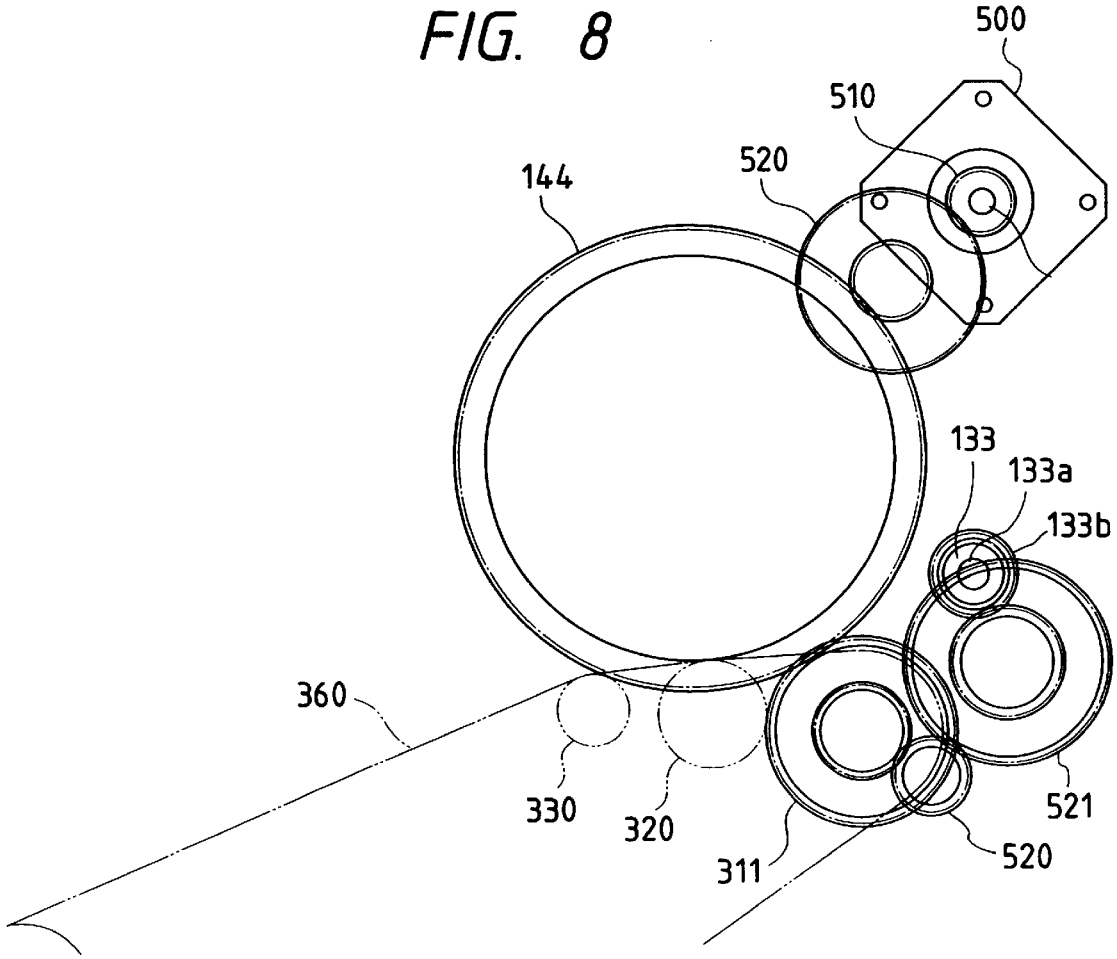
FIG. 8 is a drawing to show the main part of a gear train in a state in which the image support apparatus 100 is attached.

FIG. 8 is a drawing to show the main part of a gear train in a state in which the image support apparatus 100 is attached.

In the figure, numeral 500 is a drive motor and a pinion 510 fixed to an output shaft 501 of the drive motor 500 meshes with a gear 144 (see FIG. 2) at the end of the image supporter 110 via a reduction gear, whereby the image supporter 110 is rotated.

The gear 144 at the end of the image supporter 110 meshes with a gear 311 fixed to the end of the drive roller 310 (see FIG. 1) of the intermediate transfer belt 360, whereby the drive roller 310, namely, the intermediate transfer belt 360 is driven at substantially the same peripheral speed as the image supporter 110.

The gear 311 meshes with a gear 133*b* fixed to the end of the shaft 133*a* of the toner transport screw 133 via an intermediate gear 520 and a reduction gear 521, whereby the toner transport screw 133 is rotated.

Although not shown, the gear 133*b* meshes with a gear fixed to the end of the shaft 131*a* of the fur brush 131 via an intermediate gear, whereby the fur brush 131 is rotated.

When the image support apparatus 100 is attached and the image supporter 110, etc., is rotated as described above, the charge roller 120 and the developing roller 211 are abutted against the image supporter 110 as shown in FIG. 3.

In the embodiment, the distance L1 between the supported part of the image supporter 110 supported by the support member 150 (in this case, abutment part with the spacer 160) and the end of the charge roller 120 is set to such a length to prevent the image supporter 110 bent as the charge roller 120 is abutted against the image supporter 110 from becoming permanently deformed. The charge roller 120 is chamfered round at outer peripheral end parts 124.

Further, the distance L2 between the supported part of the image supporter 110 supported by the support member 150 and the end of the developing roller 211 is also set to such a length to prevent the image supporter 110 bent as the developing roller 211 is abutted against the image supporter 110 from becoming permanently deformed. An outer peripheral end part 212 of the developing roller 211 is also chamfered round.

The image support apparatus and the image formation system can produce the following functions and effects:

(a) The image supporter 110 is shaped like a thin cylinder having flexibility and is supported at both ends 111 by a pair of support members 150 and 150, thus a center portion 114 of the image supporter 110 not supported by the support members 150 can be deformed inwardly (see FIG. 3).

Therefore, the center portion 114 of the image supporter 110 can be used as an artificial soft material. Even if the charge roller 120 and any other roller abutted against the image supporter is a hard roller, a reliable and stable contact state can be provided and an image can be formed or supported reliably on the image supporter 110.

This point will be discussed in detail with reference to FIGS. 9–12.

Figure 9:
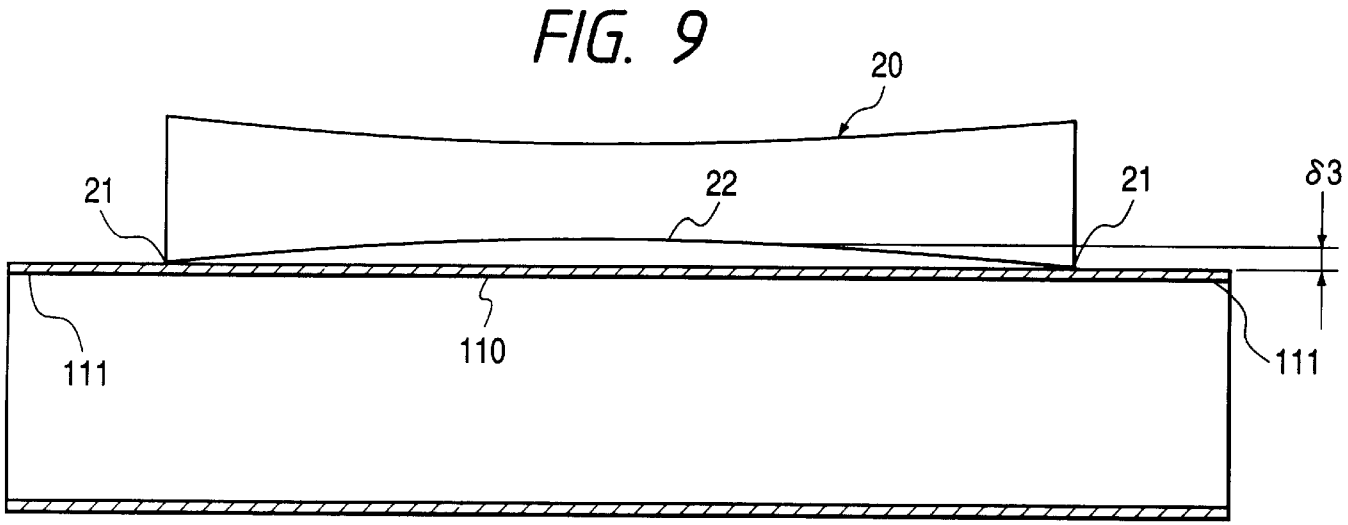
FIG. 9 is a schematic representation of function.

FIG. 9 shows a state in which a hard roller 20 is abutted lightly against the image supporter 110. For easy description, a roller 20 shaped like a reverse camber is used as an example of an incompletely columnar hard roller.

The image supporter 110 is supported at both ends 111 by a pair of support members 150 and 150, but not shown to avoid complication of the drawing.

As shown in FIG. 9, if the hard roller 20 is abutted only lightly against the image supporter 110, only both ends 21 and 21 come in contact with the image supporter 110 and a center portion 22 does not come in contact therewith. Therefore, in such a state, a good charge state, developing state, transfer state, etc., cannot be provided.

Figure 10:
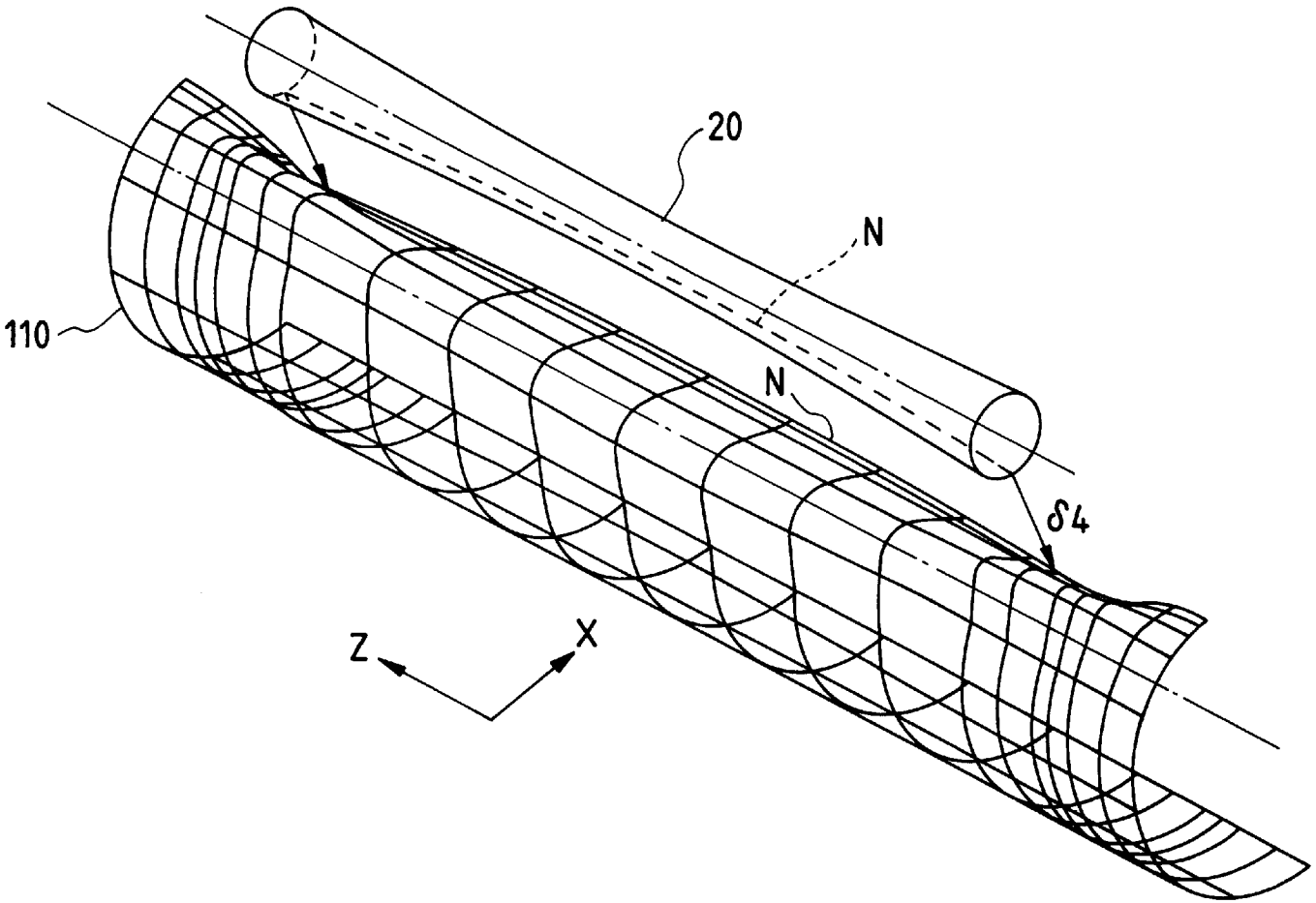
FIG. 10 is a schematic representation of function.

FIG. 10 is a perspective view of a wire frame to show the image supporter deformation amount at a magnification of 50 resulting from analyzing by an finite element method, the deformation state of the image supporter 110 when the hard roller 20 is pressed against the image supporter 110 from the state shown in FIG. 9 by larger amount $\delta 4$ than hard roller camber amount $\delta 3$ (see FIG. 9). Since the image supporter 110 becomes deformed symmetrically with respect to an axis, only a half is shown to avoid complication of the drawing.

Figure 11:
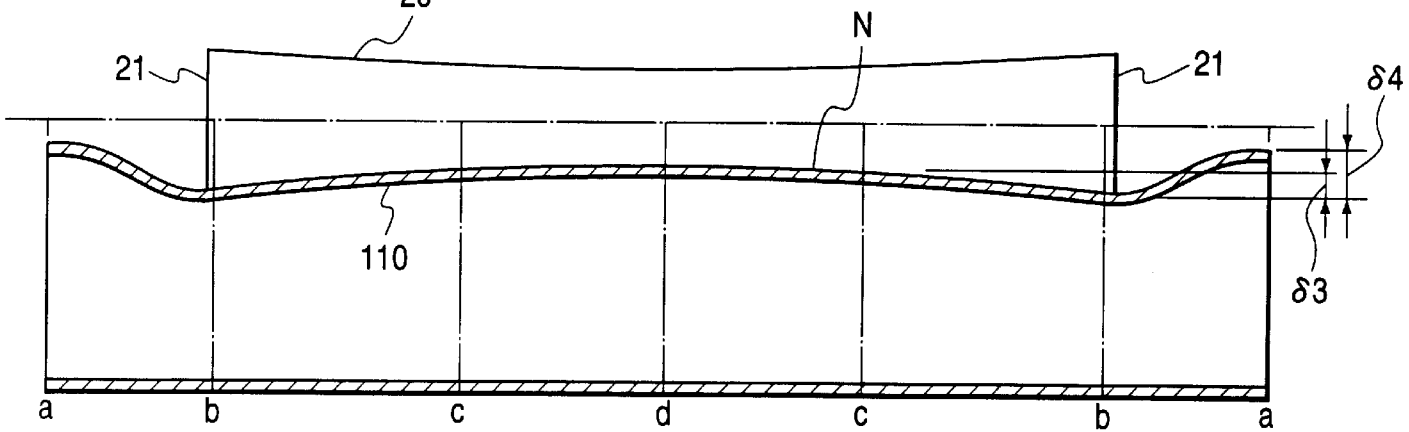
FIG. 11 is a schematic representation of function.
Figure 12:
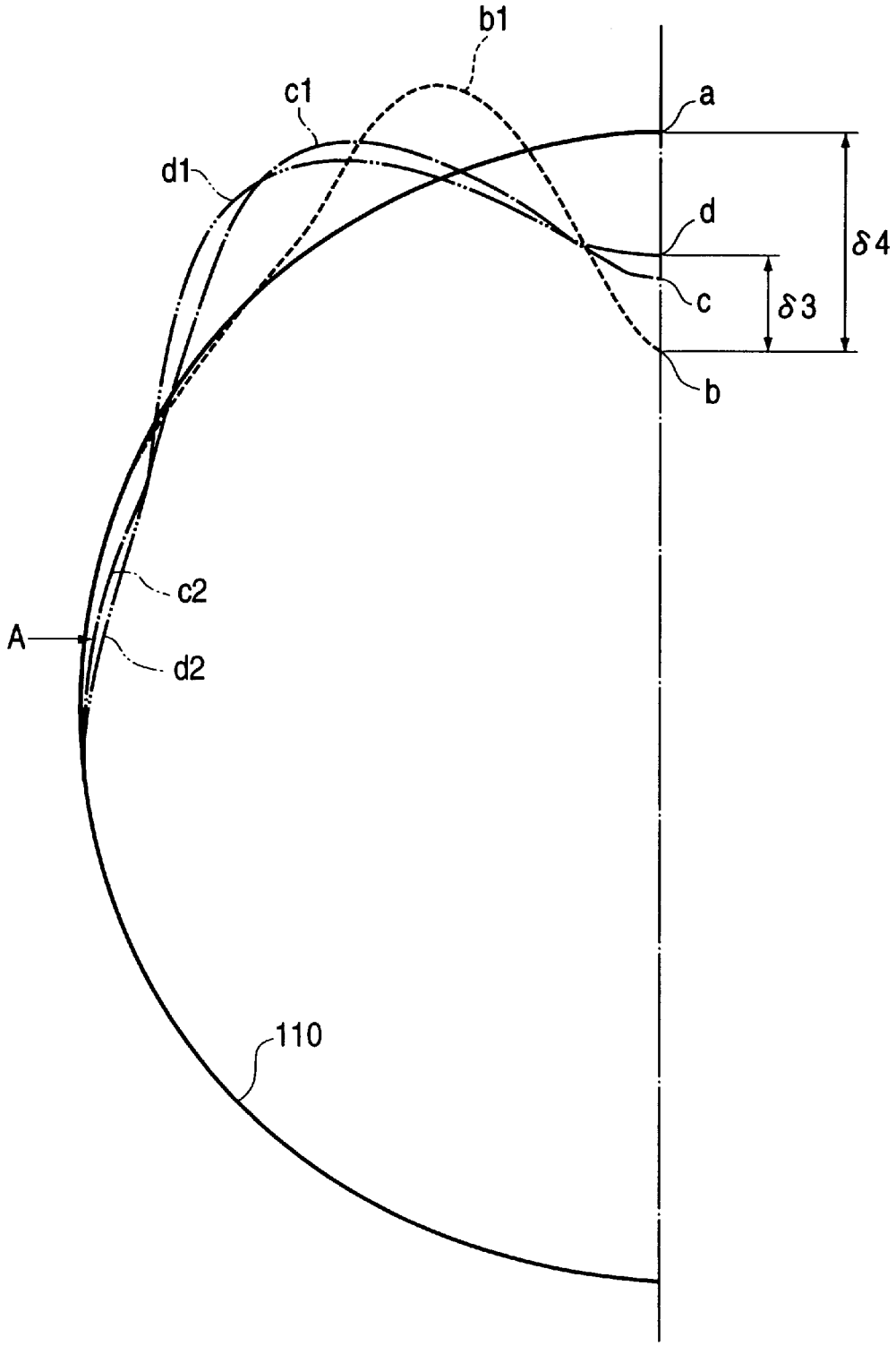
FIG. 12 is a schematic representation of function.

FIG. 11 is a view from the arrow X direction in FIG. 10. FIG. 12 is a drawing of superimposing the outer peripheral surfaces of the image supporter 110 at cross sections a, b, c, and d in FIG. 11, viewed from the arrow z direction in FIG. 10. In FIG. 12, solid line a, dashed line b, dot-dash line c, and phantom line d denote the outer peripheral surfaces of the image supporter 110 at the cross sections a, b, c, and d respectively.

As seen in FIGS. 10–12, if the hard roller 20 having the camber amount $\delta 3$ is pressed against the image supporter 110 in amount $\delta 4$ larger than the camber amount $\delta 3$, the image supporter 110 becomes deformed at the press part (so-called nip part) N faithfully along the shape of the hard roller 20 and comes in reliable contact with the hard roller 20 throughout the nip part N.

This action is enabled by the fact that the image supporter 110 is shaped like a thin cylinder having flexibility. The image supporter 110 shaped like a thin cylinder has very large flexibility in a plane direction perpendicular to the axial direction and changes the deformation shape continuously in the axial direction so as to follow the hard roller surface shaped like a reverse camber. Although microscopic deformation also occurs in the metal elasticity range in the axial direction of the thin cylinder, the axial rigidity is very high as compared with the rigidity in the cross-sectional direction perpendicular to the axial direction and does not much contribute to flexibility. Therefore, deformation of the image supporter is very much the result of the flexibility in the cross-sectional direction perpendicular to the axis. This is a deformation mode proper to the thin cylinder and this deformation is used to deform the image supporter, whereby the image supporter can follow the asperities of the hard roller and a stable contact therebetween can be provided.

The image supporter deformation state will be discussed in more detail with reference to FIGS. 11 and 12. In the a parts in FIG. 11 (both ends of the image supporter which are supported on the support members 150), the image supporter 110 basically is held in a perfect circle state as indicated by the solid line a in FIG. 12.

In the b parts (very close to the ends of the roller 20), the image supporter 110 becomes deformed inwardly by the maximum deformation amount, δ4, as indicated by the dashed line b in FIG. 12, but at the b1 point near the b point (nip part) in the circumferential direction, the image supporter 110 becomes deformed so as to largely swell to the outside.

In the d part, which is the center of the roller 20, the image supporter becomes deformed by (δ4−δ3), but at the d1 point near the d point in the circumferential direction, the image supporter becomes deformed so as to swell to the outside. In contrast, at the d2 point slightly distant from the d1 point, the image supporter becomes deformed so as to be dented a little to the inside.

In the portion from the b part to the d part, the image supporter changes continuously from the deformation state in the b part to that in the d part. As an example, the deformation state in the c part is indicated by the dot-dash line c. The c1 point swells more on the side to the b1 point than on the side to the d1 point and the dent amount at the c2 point is smaller than that at the d2 point.

As seen from the description made so far, the image supporter 110 shaped like a thin cylinder has very large flexibility in the plane direction perpendicular to the axial direction and changes the deformation shape continuously in the axial direction so as to follow the surface of the hard roller shaped like a reverse camber.

For easy description, the roller 20 shaped like a reverse camber is used as an example of an incompletely columnar hard roller. However, a slightly uneven roller is equivalent to a number of reverse camber rollers arranged continuously and a slightly tapered roller is equivalent to a part of a roller shaped like a reverse camber (or camber). Thus, the image supporter 110 also comes in good, reliable, and stable contact with an incompletely columnar hard roller (a roller having asperities or a taper in a manufacturing error range).

(b) The image supporter 110 shaped like a thin cylinder having flexibility, the support members 150 for supporting the image supporter 110 at both ends thereof, and the charge roller 120 abutting the outer peripheral surface of the image supporter 110 for uniformly charging the outer peripheral surface are held on the frame 170 as a unit, thus facilitating handling of the image supporter 110, etc.

When the image supporter 110 and the charge roller 120 abutting it are put into a unit, if no means are provided, it is feared that the image supporter 110 is pressed by the charge roller 120 and may be bent and become permanently deformed. However, according to the configuration of the embodiment, the distance between the supported part of the image supporter supported by the support member 150 and the end of the charge roller 120 is set to the length L1 to prevent the image supporter 110 bent as the charge roller 120 abuts the image supporter 110 from becoming permanently deformed. Thus, it is not feared that the image supporter 110 may become permanently deformed although the image supporter 110 and the charge roller 120 are put into a unit.

Figure 48:
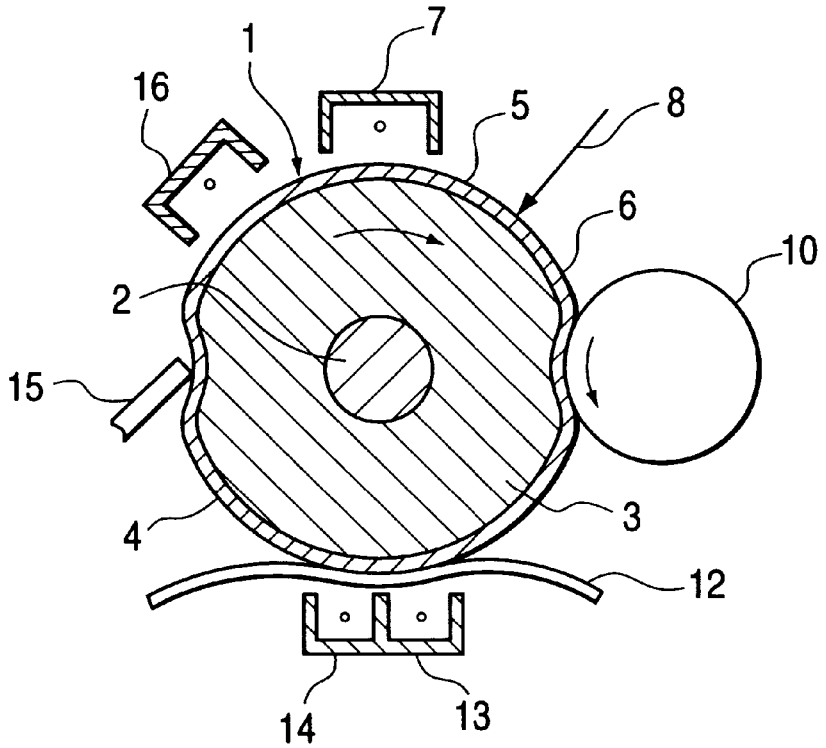
FIG. 48 is a schematic representation of related art.
Figure 49:
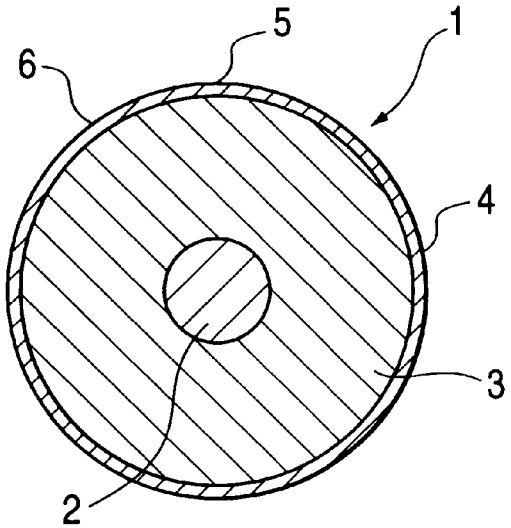
FIG. 49 is a schematic representation of related art.
Figure 50:
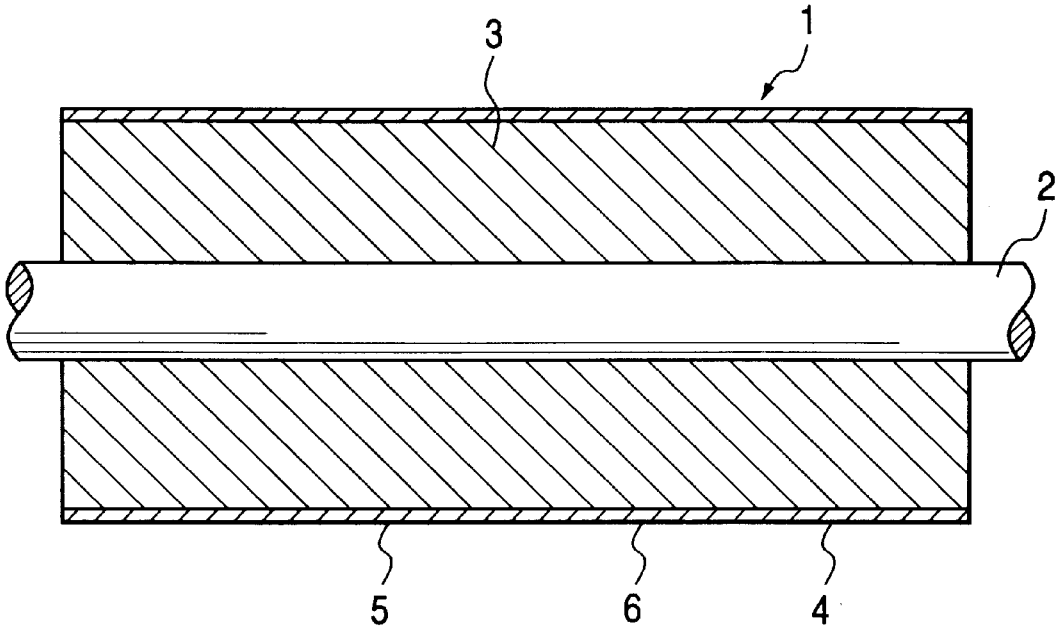
FIG. 50 is a schematic representation of related art.

(c) The image supporter 110 is supported at both ends on the support members 150 and need not be filled with an elastic material layer as in the photosensitive drum 1 (see FIGS. 48–50) described in Japanese Patent Publication No. Hei 4-69383, thus can be manufactured easily.

(d) Since the outer peripheral end part 124 of the charge roller 120 is chamfered, the image supporter 110 can be more reliably prevented from becoming permanently deformed.

(e) The distance between the supported part of the image supporter 110 supported by the support member 150 and the end of the developing roller 211 is set to the length L2 to prevent the image supporter 110 bent as the developing roller 211 abuts the image supporter 110 from becoming permanently deformed, so that the image supporter 110 can be more reliably prevented from becoming permanently deformed. Since the outer peripheral end part 212 of the developing roller 211 is chamfered, the image supporter 110 is furthermore reliably prevented from becoming permanently deformed.

Figure 51:
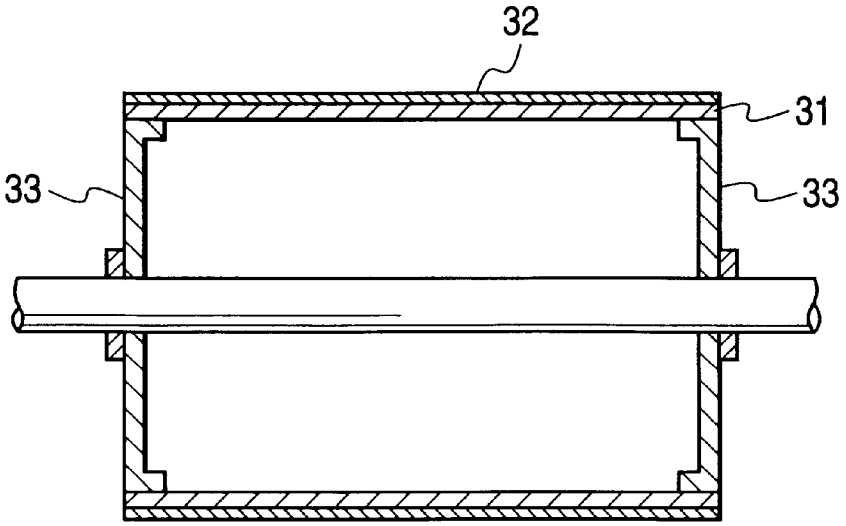
FIG. 51 is a schematic representation of related art.
Figure 52A:
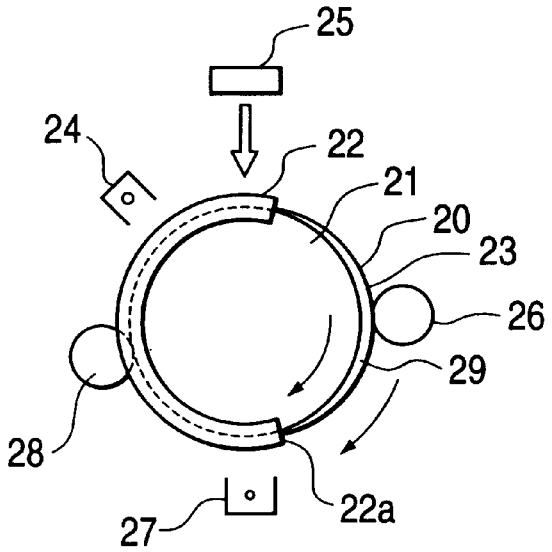
FIG. 52(*a*) and 52(*b*) are schematic representations of related art.
Figure 52B:
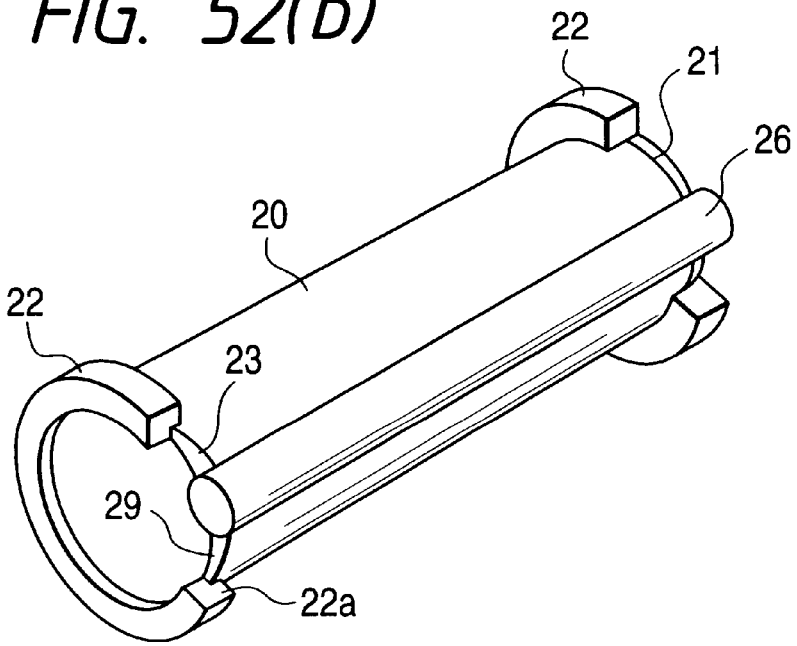

(f) Inside the image supporter 110, the rigid cylindrical member 140 is placed with the spacing S smaller than the allowable deformation amount of the image supporter 110, δ2, between the outer peripheral surface 145 of the cylindrical member 140 and the inner peripheral surface 113 of the image supporter 110. Thus, for example, when replacing the image supporter 110, etc., if the operator strongly presses the center 114 of the image supporter 110 in error, the image supporter 110 is supported by the cylindrical member 140 before it is broken, so that the image supporter 110 is not broken. Therefore, the image formation system is excellent in handleability as compared with the drum-like photosensitive member disclosed in Unexamined Japanese Patent Publication No. Sho 58-86550 (see FIG. 51).

(g) The cleaner blade 132 comes in contact with the image supporter 110 and presses it until the inner peripheral surface 113 of the image supporter 110 abuts the outer peripheral surface 145 of the cylindrical member 140 for removing the toner remaining on the outer peripheral surface. It can clean the image supporter 110 more reliably by a comparatively large abutment force.

Second Embodiment

Figure 13:
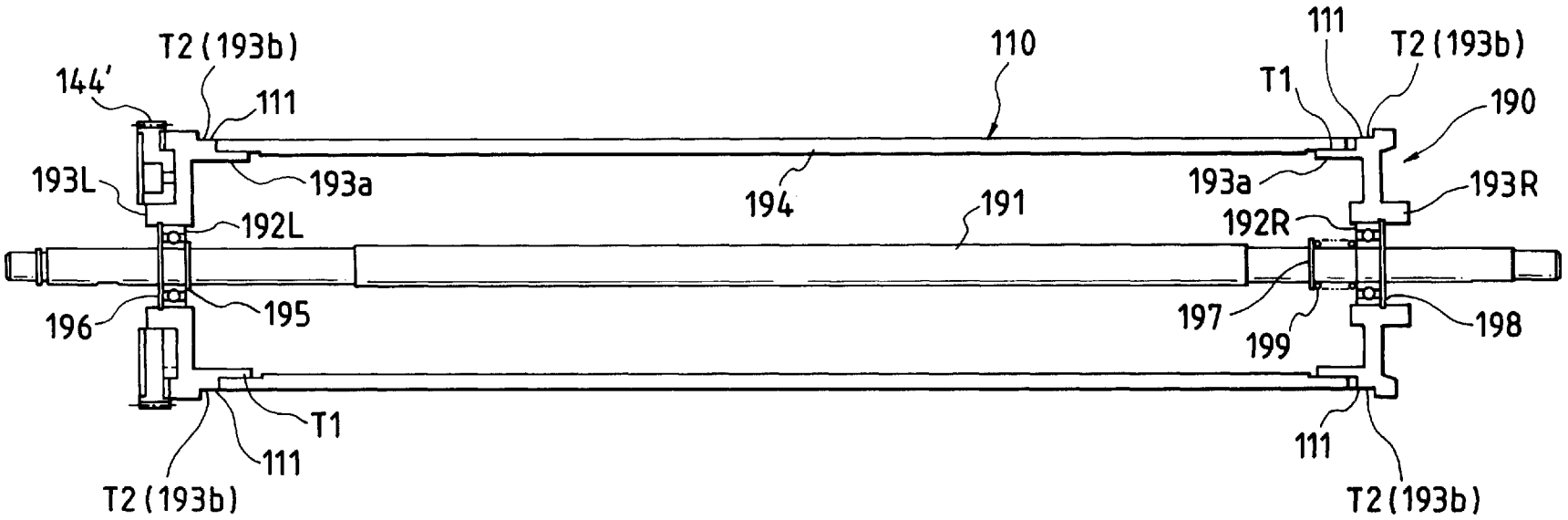
FIG. 13 is a frontal sectional view to show an example of a image supporter and support members thereof in a second embodiment of a image support apparatus according to the present invention.

FIG. 13 is a frontal sectional view to show an example of an image supporter and support members thereof in a second embodiment of an image support apparatus according to the present invention.

The second embodiment is the same as the first embodiment except for a support body and its support structure for supporting an image supporter 110.

A support body 190 in the second embodiment comprises a shaft 191, a side plate 193L as a support member attached rotatably to the shaft 191 at one end via a bearing 192L, a side plate 193R as a support member attached rotatably to the shaft 191 at the other end via a bearing 192R, a cylindrical member 194 supported by the side plates 193L and 193R, and a gear 144' fixed to the side plate 193R.

A cylindrical coupling part 193*a* is integral with the inside of each of the side plates 193L and 193R. The end of the cylindrical member 194 is pressed into the coupling part 193*a* of the side plate 193L, whereby the side plate 193L and the cylindrical member 194 are coupled integrally. The coupling part 193*a* of the side plate 193R is fitted slidably into the inner peripheral surface of the cylindrical member 194, whereby the side plate 193R and the cylindrical member 194 are attached so that they can make a relative move in the axial direction. The coupling parts thereof are formed with tapers T1 in the same direction.

The image supporter 110 is supported at both ends 111 bonded to the side plates 193L and 193R. Tapers T2 are formed at the image supporter 110 support members 193*b* of the side plates 193L and 193R.

A retaining ring 195 fixed to the shaft 191 and a retaining ring 196 engaging the side plate 193L are provided at both sides of one bearing 192L. Since the outer retaining ring 196 does not engage the shaft 191, the bearing 192L and the side plate 193L can be slid only to the left in FIG. 13 relative to the shaft 191.

Retaining rings 197 and 198 are also provided at both sides of the other bearing 192R. The inner retaining ring 197 is fixed to the shaft 191 with a spacing from the bearing 192R and a compressed spring 199 as urging means is disposed between the retaining ring 197 and the bearing 192R. The outer retaining ring 198 engages the side plate 193R, but not the shaft 191 and can be slid. Therefore, the bearing 192R and the side plate 193R can be slide left and right relative to the shaft 191.

The image support apparatus is assembled as follows:

(i) One side plate 193L is pressed into one end of the cylindrical member 194.

(ii) The cylindrical member 194 is inserted into the image supporter 110 until the support member 193*b* of the side plate 193L is lightly pressed into the end 111 of the image supporter 110.

(iii) The coupling part 193*a* of the other side plate 193R is inserted into the other end of the cylindrical member 194. At this time, the support member 193*b* of the side plate 193R is lightly pressed into the other end of the image supporter 110.

(iv) Both ends 111 of the image supporter 110 and the support members 193*b* of the side plates are fixedly secured with a bonding agent.

(v) The shaft 191 to which the retaining ring 195, the bearing 192L, the retaining ring 197, the compressed spring 199, and the bearing 192R are previously attached is inserted.

(vi) One retaining ring 196 is attached to the side plate 193L and the other retaining ring 198 is pushed while compressing the compressed spring 199 and is engaged with the other side plate 193R.

According to the structure, if the image supporter 110, the cylindrical member 194, and the side plates 193L and 193R differ in thermal expansion coefficient and an expansion and contraction amount difference occurs between them due to temperature change, the difference is absorbed by a relative move of the coupling part 193*a* of the side plate 193L and the inner peripheral surface of the cylindrical member 194. This prevents the image supporter 110 from becoming deformed due to temperature change.

Third Embodiment

Figure 15:
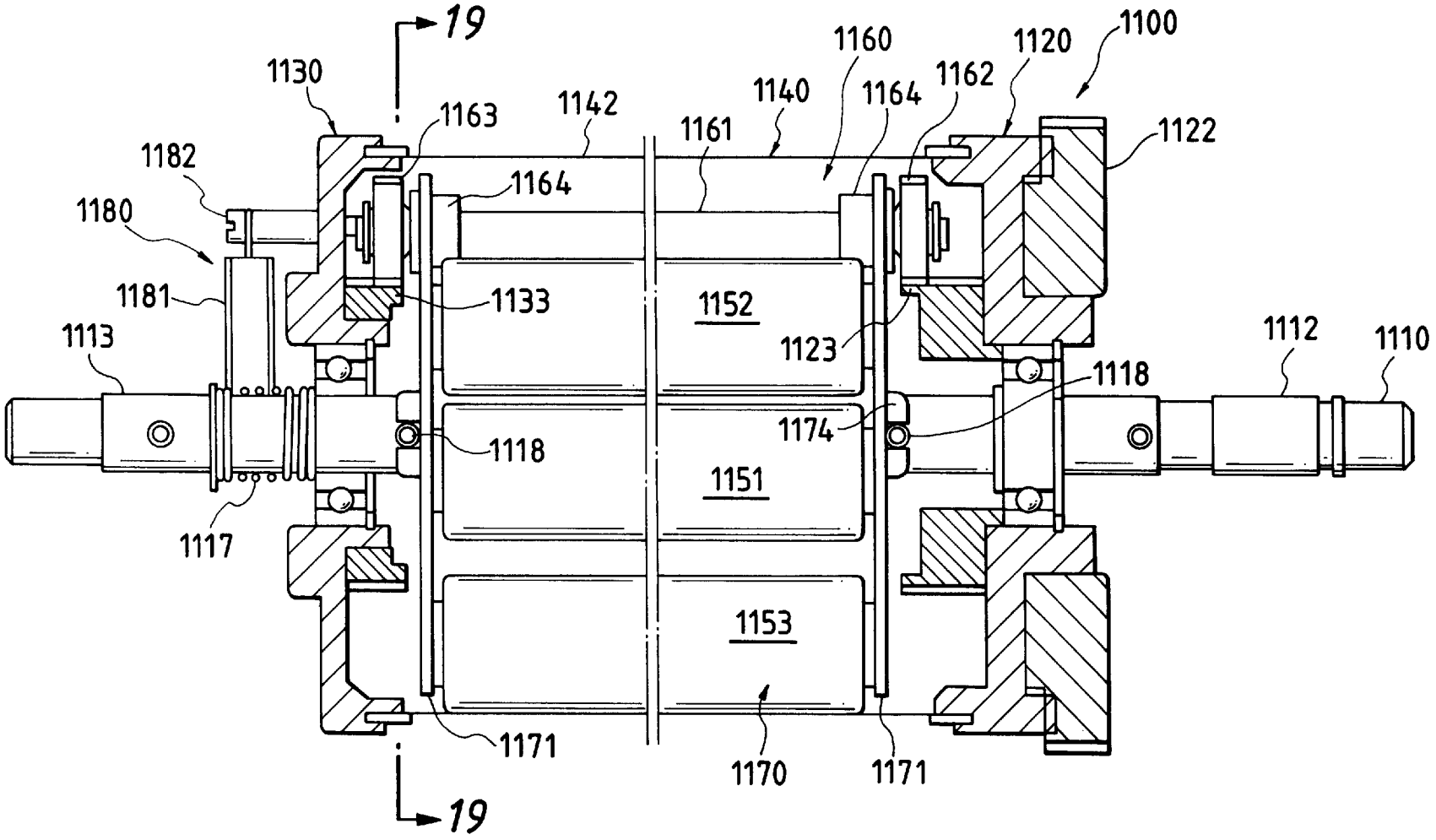
FIG. 15 is a frontal sectional view to show a third embodiment of an image support apparatus according to the present invention.
Figure 16:
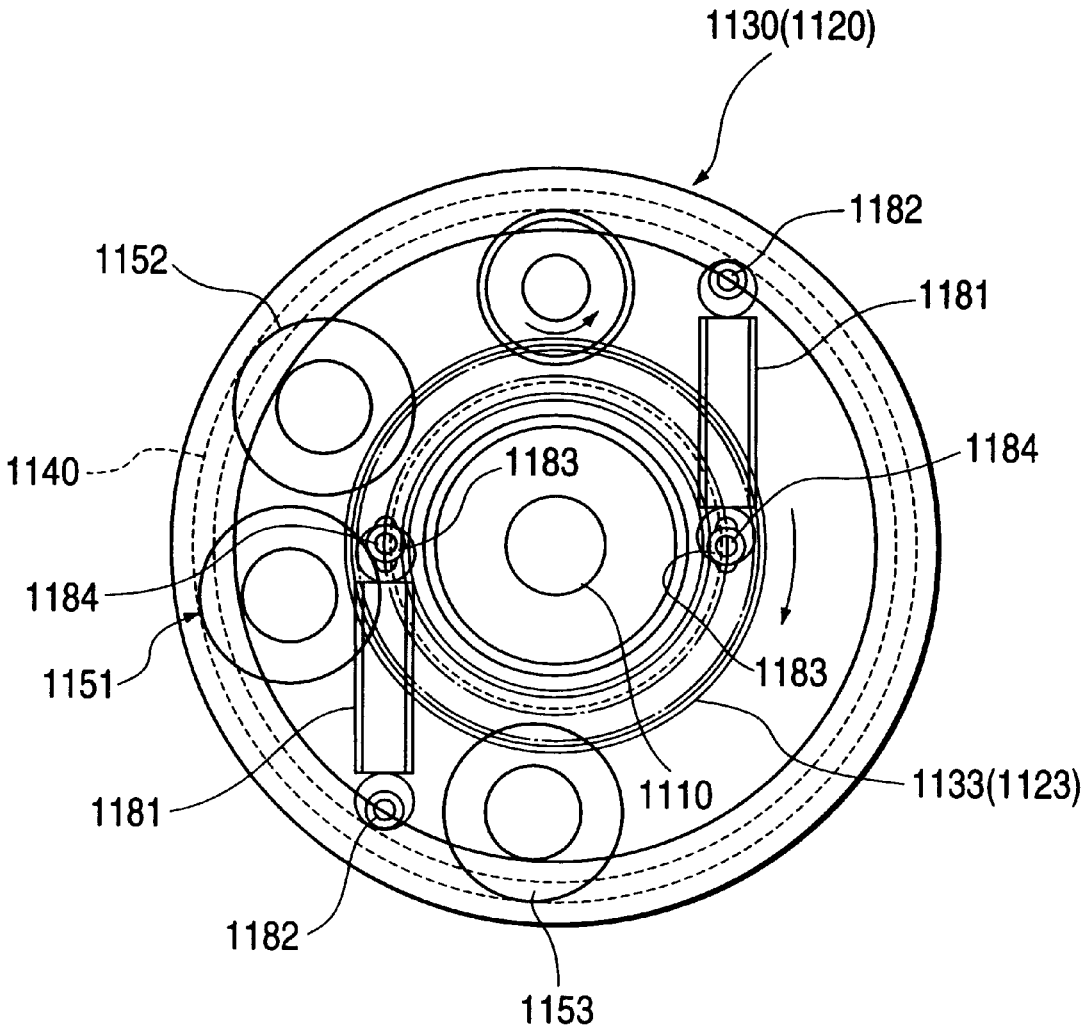
FIG. 16 is a left perspective side view partially omitted to show the third embodiment.
Figure 17:
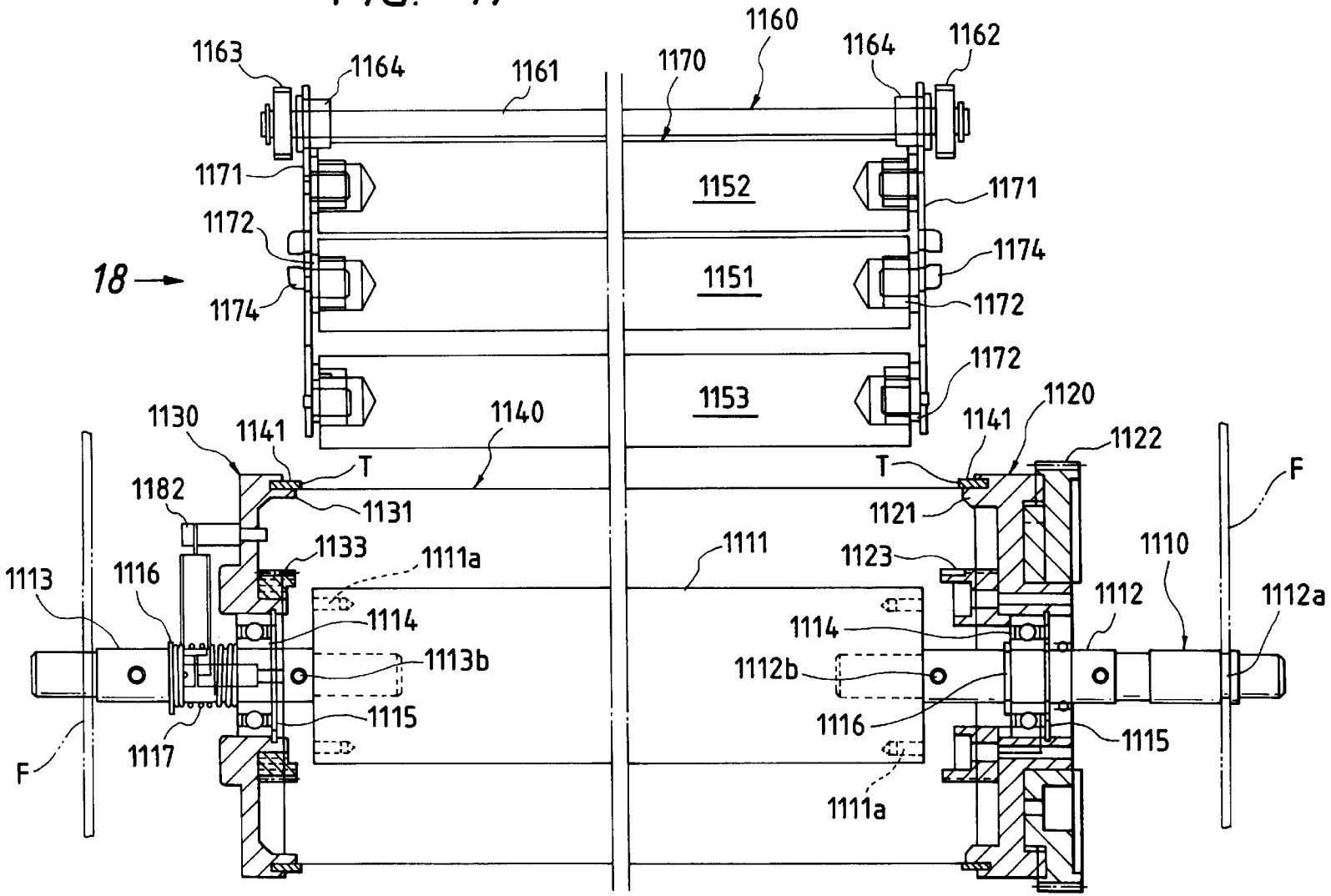
FIG. 17 is an exploded frontal sectional view to show the third embodiment.
Figure 18:
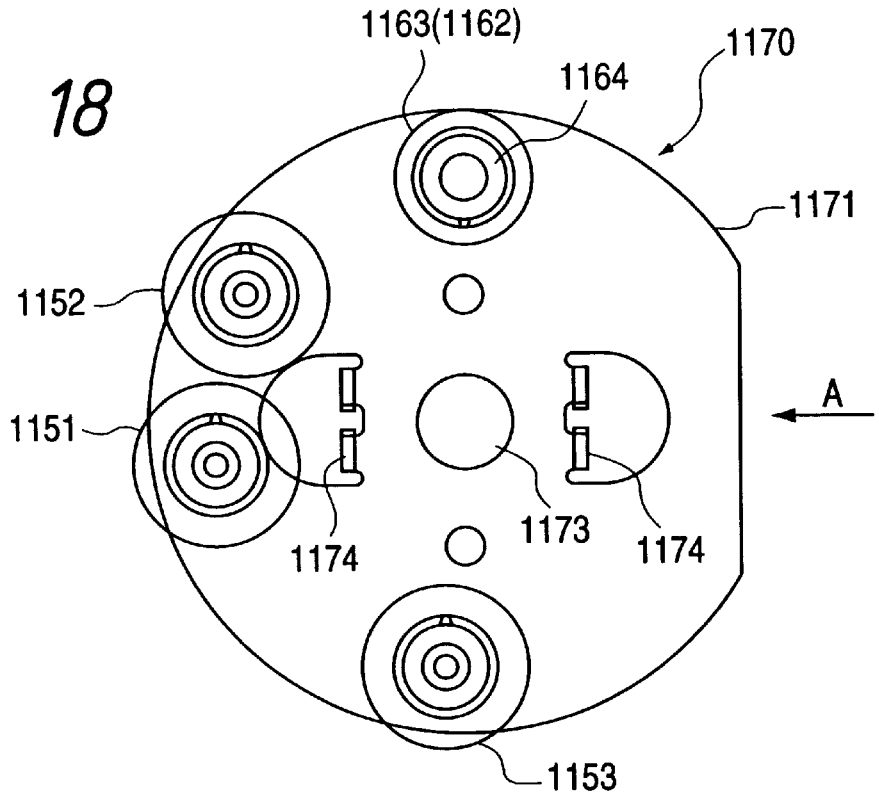
FIG. 18 is a perspective view taken on arrow 18 in FIG. 17.
Figure 19:
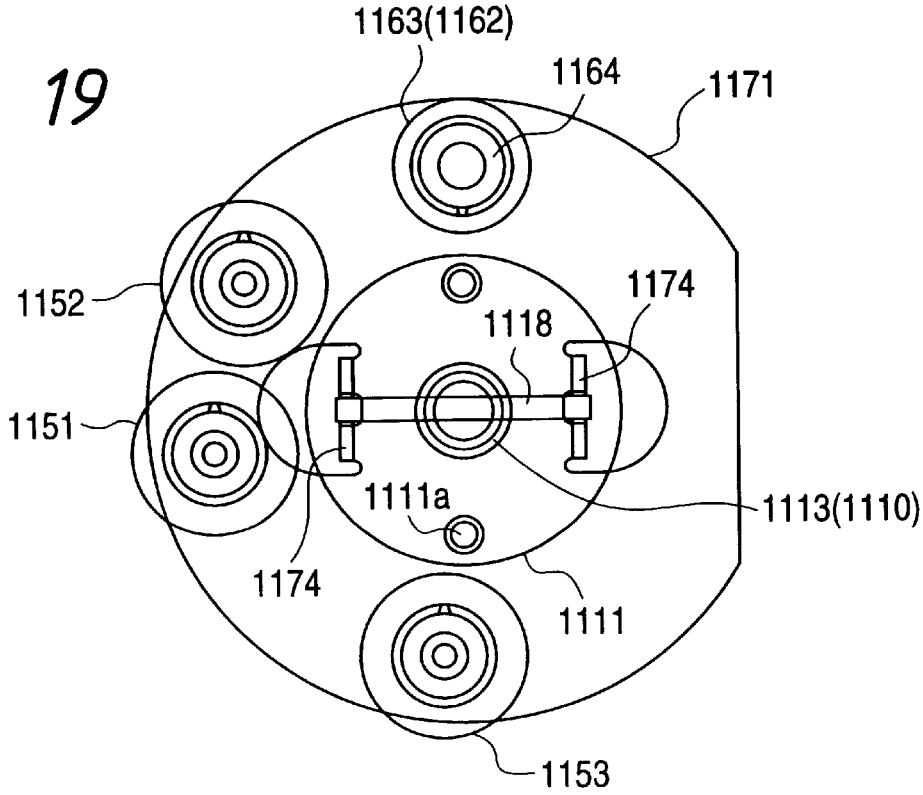
FIG. 19 is a partially omitted view taken on line 19—19 in FIG. 15.
Figure 20:
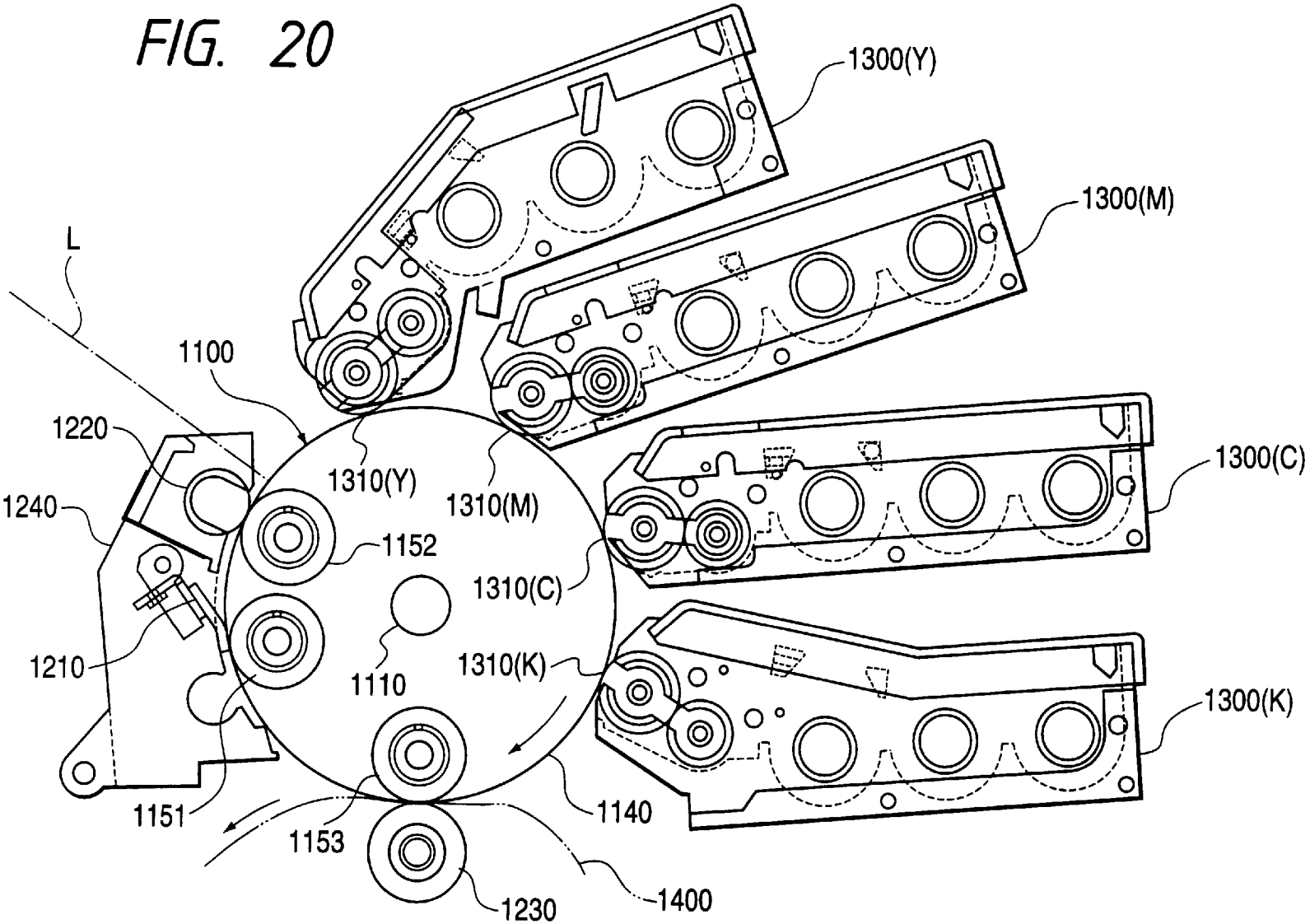
FIG. 20 is a fragmentary sectional view to show a state in which the image support apparatus is built in an image formation system.

FIG. 15 is a frontal sectional view to show a first embodiment of an image support apparatus according to the present invention. FIG. 16 is a left perspective side view partially omitted. FIG. 17 is an exploded frontal sectional view. FIG. 18 is a perspective view taken on arrow 18 in FIG. 17. FIG. 19 is a partially omitted view taken on line 19 in FIG. 15. FIG. 20 is a fragmentary sectional view to show a state in which the image support apparatus is built in an image formation system.

As shown in FIGS. 15 and 16, the image support apparatus 1100 comprises a shaft 1110 not rotated by itself, a pair of disk-like members 1120 and 1130 attached rotatably to the shaft 1110, an image supporter 1140 like a thin cylinder having flexibility supported and fixed at both ends by the disk-like members 1120 and 1130 and rotated together with the disk-like members 1120 and 1130, and a first backup roller 1151, a second backup roller 1152, and a third backup roller 1153 as first, second, and third backup mechanisms being attached to the shaft 1110 inside the image supporter 1140 for supporting the image supporter 1140 from the inside thereof at abutment positions where a cleaning member 1210 (see FIG. 20), a charge roller 1220 (see FIG. 20), and a transfer roller 1230 (see FIG. 20) as abutment members are abutted against the image supporter 1140 from the outside thereof. It further includes gang mechanisms 1160 for ganging together the disk-like members 1120 and 1130 inside the image supporter 1140.

In the embodiment, the first, second, and third backup rollers 1151, 1152, and 1153 are provided as the backup mechanisms, but at least one backup mechanism may be disposed at a necessary place. In this case, it is desirable to place the backup mechanism at the abutment position where the cleaning member 1210 is abutted against the image support.

As shown in FIG. 17, the shaft 1110 comprises a large diameter part 1111 placed inside the image supporter 1140 and small diameter parts 1112 and 1113 projected from both ends of the large diameter part 1111 and penetrating the disk-like members 1120 and 1130. One small diameter part 1112 is formed with a ring-like groove 1112*a*. When the image support apparatus 1100 is built in an image formation system, the groove 1112*a* engages a frame F of the image formation system, thereby positioning the image support apparatus 1100 to the frame F.

The disk-like members 1120 and 1130 are attached rotatably to the shaft 1110 each via a bearing 1114. The disk-like members 1120 and 1130 and the bearings 1114 are regulated in sliding in the axial direction of the shaft 1110 by retaining rings 1115 and 1116. A compressed coil spring 1117 for preventing their play is disposed between the left bearing 1114 and the left retaining ring 1116.

The disk-like members 1120 and 1130 are formed on inner faces with short cylindrical support members 1121 and 1131 for supporting the image supporter 1140 at both ends 1141 thereof. The image supporter 1140 is fixed at both ends 1141 to the support members 1121 and 1131 by appropriate means, such as bonding, (in the embodiment, not only in a bonding agent, but also by winding tape T).

A drive gear 1122 is fixed to one disk-like member 1120 on the outer face thereof.

The backup rollers 1151, 1152, and 1153 are attached to the shaft 1110 by means of a pair of side plates 1171 and 1171, as shown mainly in FIGS. 15 and 19.

The backup rollers 1151, 1152, and 1153 are assembled as a subunit 1170 as shown in FIGS. 17 and 18. That is, the rollers are attached rotatably to the side plates 1171 and 1171 via bearing members 1172. As shown in FIGS. 15, 17, and 19, the side plates 1171 and 1171 are fixed to side parts of the large diameter part 1111 of the shaft 1110 by screws (in FIG. 17, numeral 1111*a* is a screw hole), whereby the subunit 1170 is fixed to the shaft 1110. Specifically, the shaft 1110 consists of the large diameter part 1111 and the small diameter parts 1112 and 1113 as described above, which can be disassembled. Therefore, before the image support apparatus 1100 is assembled, first the large diameter part 1111 is entered between the side plates 1171 and 1171 of the subunit 1170 as indicated by arrow A in FIG. 18 and the subunit 1170 and the large diameter part 1111 are fixed. Next, the small diameter parts 1112 and 1113 are entered through holes 1173 of the side plates 1171 (see FIG. 18) and are fixed to the side parts of the large diameter part 1111. Then, the disk-like members 1120 and 1130, the image supporter 1140, and the like are assembled, whereby the image support apparatus 1100 can be assembled. The side plates 1171 and 1171 are formed on the outer parts with stand pieces 1174 and 1174 (see FIGS. 17 and 18) by bending. Pins 1118 are inserted into the stand pieces 1174 and through holes 1112*b* and 1113*b* made in the small diameter parts 1112 and 1113, thereby positioning the shaft 1110 and the subunit 1170 in the circumferential direction. With the components assembled, the outer peripheral surfaces of the rollers 1151, 1152, and 1153 come in light contact with or extremely approach the inner peripheral surface of the image supporter 1140 (see FIGS. 15, 16, and 20).

The components can also be assembled furthermore accurately by attaching the backup rollers 1151, 1152, and 1153 to the shaft 1110 as follows: The large diameter part 1111 and the small diameter parts 1112 and 1113 are molded in one piece as the shaft 1110 and the small diameter parts 1112 and 1113 of the shaft 1110 are inserted into the through holes 1173 of the side plates 1171 to attach the side plates 1171 and 1171 from both sides of the shaft 1110, then the backup rollers 1151, 1152, and 1153 are sandwiched between the side plates 1171 and 1171 for assembling. In doing so, the outer peripheral surfaces of the small diameter parts 1112 and 1113 integral with the large diameter part 1111 of the shaft 1110 and the through holes 1173 of the side plates 1171 and 1171 are used for radial positioning, so that the positional accuracy of the backup rollers 1151, 1152, and 1153 relative to the shaft 1110 is enhanced.

As shown in FIGS. 15 and 16, the gang mechanism 1160 comprises a gang shaft 1161 placed in parallel with the shaft 1110 inside the image supporter 1140 and a pair of gears 1162 and 1163 fixed to the gang shaft 1161 at both ends thereof and meshing with gears 1123 and 1133 disposed in the disk-like members 1120 and 1130. The gang mechanism 1160 is also built in the subunit 1170 as shown in FIG. 17. That is, the gang shaft 1161 is supported rotatably on the side plates 1171 and 1171 via the bearing members 1164 and the gears 1162 and 1163 are fixed to the gang shaft 1161 at both the ends. As a result, the subunit 1170 consists of the side plates 1171 and 1171, the backup rollers 1151–1153, and the gang mechanism 1160.

In the embodiment, the gang mechanism 1160 is provided with backlash prevention means 1180.

As shown in FIGS. 15 and 16, the backlash prevention means 1180 is made up of tension springs 1181 and 1181 as urging means for always urging the gear 1133 disposed in one disk-like member 1130 in the mesh direction with the gear 1163 of the gang mechanisms 1160. The tension spring 1181 is disposed between a pin 1182 fixed to the disk-like member 1130 and a pin 1184 passed through the through hole 1183 (see FIG. 16) made in the disk-like member 1130 and fixed to the gear 1133. The gear 1133 is attached relatively pivotably around the shaft 1110 relative to the disk-like member 1130 and the through hole 1183 is a long hole in the shape of a circular arc having a short length (although long enough to remove backlash) with the shaft 1110 as the center. The pin 1184 can pivot around the shaft 1110 in the range of the long hole. Therefore, when the image support apparatus 1100 is built in the image formation system and a drive gear (not shown) of the image formation system main body meshes with the drive gear 1122, the gear 1133 is always urged in the mesh direction with the gear 1163 of the gang mechanisms 1160 by the action of the tension spring 1181, thereby removing backlash. The other gear 1123 is fixed to the side plate 1120 (numeral 1124 in FIG. 17 is a screw hole).

As shown in FIG. 20, the image support apparatus 1100 is built in the image formation system and the drive gear (not shown) of the image formation system main body meshes with the drive gear 1122, whereby the image supporter 1140 is rotated in the arrow direction.

In FIG. 20, numeral 1220 is the above-mentioned charge roller, L is a laser beam for selectively exposing the surface of the image supporter 1140, numerals 1300Y, 1300M, 1300C, and 1300K are developing machines, numeral 1230 is the above-mentioned transfer roller, and numeral 1210 is the above-mentioned cleaning member.

The charge roller 1220 abuts the outer peripheral surface of the image supporter 1140 for uniformly charging the outer peripheral surface.

The laser beam L is emitted from exposure mechanisms (not shown) for selectively exposing the surface of the image supporter 1140 for forming an electrostatic latent image on the surface of the image supporter 1140.

The developing machines 1300Y, 1300M, 1300C, and 1300K contain yellow, magenta, cyan, and black toners respectively. The developing machines 1300 can be attached to and detached from the image supporter 1140; only one of the developing machines can abut the image supporter 1140 at any given time. Numerals 1310Y, 1310M, 1310C, and 1310K are developing rollers abutting the image supporter 1140; the developing rollers are made of metal rollers with roughened surfaces or hard resin rollers.

An intermediate transfer belt 1400 is circulated between the transfer roller 1230 and the image supporter 1140 and a secondary transfer roller (not shown) is placed facing the intermediate transfer belt 1400. While the intermediate transfer belt 1400 is circulated, a toner image on the image supporter 1140 is transferred onto the intermediate transfer belt 1400 between the transfer roller 1230 (primary transfer roller) and the image supporter 1140 and the toner image transferred onto the intermediate transfer belt 1400 is transferred to a recording medium such as paper supplied between the intermediate transfer belt 1400 and the secondary transfer roller.

The cleaning member 1210 includes a cleaning blade 1210. The cleaning blade 1210 and the charge roller 1220 are built in a subcase 1240. The subcase 1240 can be combined with the image support apparatus 1100 as a single unit.

The image formation system can form a full color image with four color toners of yellow (Y), magenta (M), cyan (C), and black (B) and operates as described before.

The image support apparatus 1100 can produce the following functions and effects:

(a) The image supporter 1140 shaped like a thin cylinder is supported and fixed at both ends 1141 by the disk-like members 1120 and 1130 attached rotatably to the shaft 1110. Thus, when the disk-like members 1120 and 1130 are rotated, the image supporter 1140 is rotated reliably.

Since the image supporter 1140 is supported and fixed at both ends 1141 by the disk-like members 1120 and 1130, excellent durability is also provided.

(b) The image supporter 1140 is shaped like a thin cylinder having flexibility and is supported at both ends 1141 by the disk-like members 1120 and 1130, thus the center portion 1142 (see FIG. 15) of the image supporter 1140 not supported by the disk-like member 1120, 1130 can be deformed inwardly.

Therefore, the portion of the center portion 1142 of the image supporter 1140 where the backup mechanism 1151, 1152, 1153 is not disposed, or if the backup mechanism is disposed, where the backup mechanism is spaced from an abutment member, such as the charge roller 1220 or the transfer roller 1230, can be used as an artificial soft material. Even if the member abutted against it is a hard roller such as the developing roller 1310, a reliable and stable contact state can be provided and an image can be formed or supported reliably on the image supporter 1140.

On the other hand, the cleaning member 1210, the charge roller 1220, and the transfer roller 1230 as abutment members are abutted against the outer peripheral surface of the image supporter 1140. At the abutment positions, the image supporter 1140 is supported from the inside by the backup mechanisms 1151, 1152, and 1153, so that the abutment members can be abutted reliably.

That is, the cleaning member 1210 and the charge roller 1220 can be abutted against the image supporter 1140 reliably for removing the toner remaining on the outer peripheral surface of the image supporter 1140 reliably and charging reliably. At the transfer position, the image supporter 1140 can also be abutted reliably against the intermediate transfer belt 1400 in the transfer roller 1230 portion.

Moreover, assuming that the cleaning member 1210, etc., is abutted against the image supporter 1140 in a state in which the backup mechanisms 1151–1153 do not exist, it is feared that the image supporter 1140 shaped like a thin cylinder may become creep-deformed. However, the image support apparatus 1100 of the embodiment also eliminates such a fear.

(c) The image supporter 1140 is supported and fixed at both ends 1141 by the disk-like members 1120 and 1130 attached rotatably to the shaft 1110 and the backup mechanisms 1151, etc., are attached to the shaft 1110 inside the image supporter 1140, whereby they are put into a unit for easy handling.

Thus, the image support apparatus 1100 of the embodiment can provide a reliable and stable contact state with the abutment members, is excellent in durability and handling, and can be driven reliably.

Further, since (d) The backup mechanisms 1151, 1152, and 1153 are rotatable rollers, the load on the image supporter 1140 can be lessened and therefore the drive torque of the image supporter 1140 can be decreased.

(e) Since the disk-like members 1120 and 1130 are rotated at the same time, a twist force does not act on the image supporter 1140 shaped like a thin cylinder or becomes extremely small if it acts on the image supporter 1140. As a result, the image supporter 1140 can be well rotated without laboring although it is shaped like a thin cylinder.

(f) Since the gang mechanism 1160 for ganging together the disk-like members 1120 and 1130 is disposed inside the image supporter 1140, the disk-like members 1120 and 1130 can be driven in a simple composition as compared with the case where they are driven separately.

Moreover, the gang mechanism 1160 is disposed inside the image supporter 1140, thus upsizing of the unit can be prevented.

(g) The gang mechanism 1160 comprises the gang shaft 1161 placed in parallel with the shaft 1110 inside the image supporter 1140 and a pair of gears 1162 and 1163 fixed to the gang shaft 1161 at both ends thereof and meshing with the gears 1123 and 1133 disposed in the disk-like members 1120 and 1130, so that the disk-like members 1120 and 1130 can be ganged together reliably.

(h) The gang mechanism 1160, which is provided with the backlash prevention means 1180, can gang together the disk-like members 1120 and 1130 accurately.

Fourth Embodiment

Figure 21:
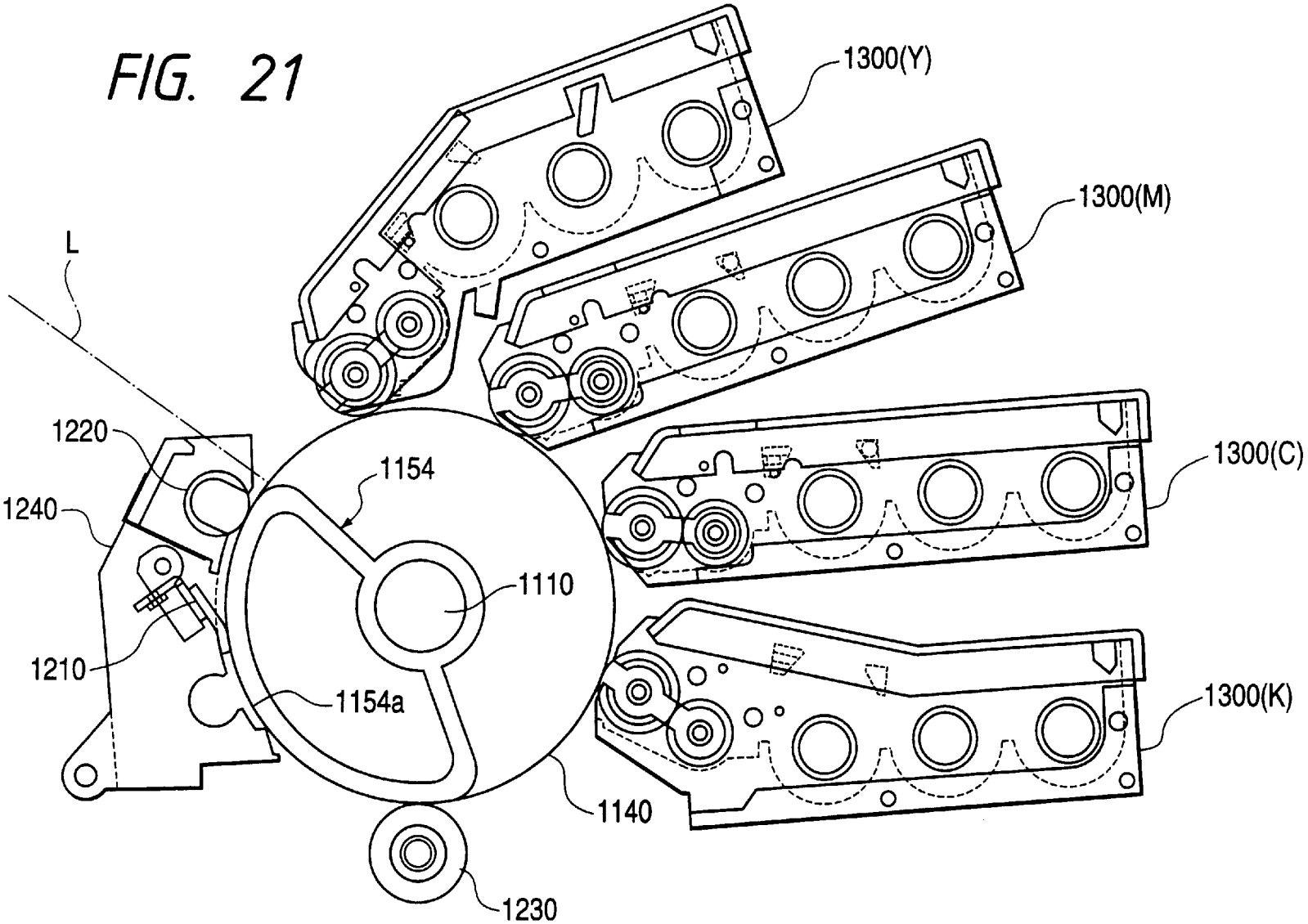
FIG. 21 is a partial side view to show a state in which a fourth embodiment of an image support apparatus according to the present invention is built in an image formation system.

FIG. 21 is a partial side view to show a state in which a fourth embodiment of an image support apparatus according to the present invention is built in an image formation system. Parts similar to those previously described with reference to FIG. 20 are denoted by the same reference numerals in FIG. 21 and will not be discussed again.

The fourth embodiment differs from the third embodiment only in the backup mechanism structure.

A backup mechanism 1154 in the second embodiment is made of a hollow and substantially semicylindrical member which is fan-shaped on a side view thereof. The backup mechanism 1154 is fixed to a shaft 1110 and has an outer peripheral surface 1154*a* like a circular arc on a side view thereof coming in sliding contact with the inner peripheral surface of an image supporter 1140 from a transfer position (abutment position of a transfer roller 1230) to a cleaning position (abutment position of a cleaning member 1210) to a charge position (abutment position of a charge roller 1220) for supporting the image supporter 1140 from the inside. The backup mechanism 1154 can be made of a draw material, injection-molded article, for example.

According to the configuration, the functions and effects in (a), (b), (c), (e), (f), (g), and (h) described in the third embodiment can also be provided.

Further, the backup mechanism 1154, which is made of a member coming in sliding contact with the inner peripheral surface of the image support, can also produce the effect of being capable of supporting the image supporter 1140 in the rotation direction thereof in a wider range. That is, one backup mechanism is sufficient to use.

Fifth Embodiment

Figure 22:
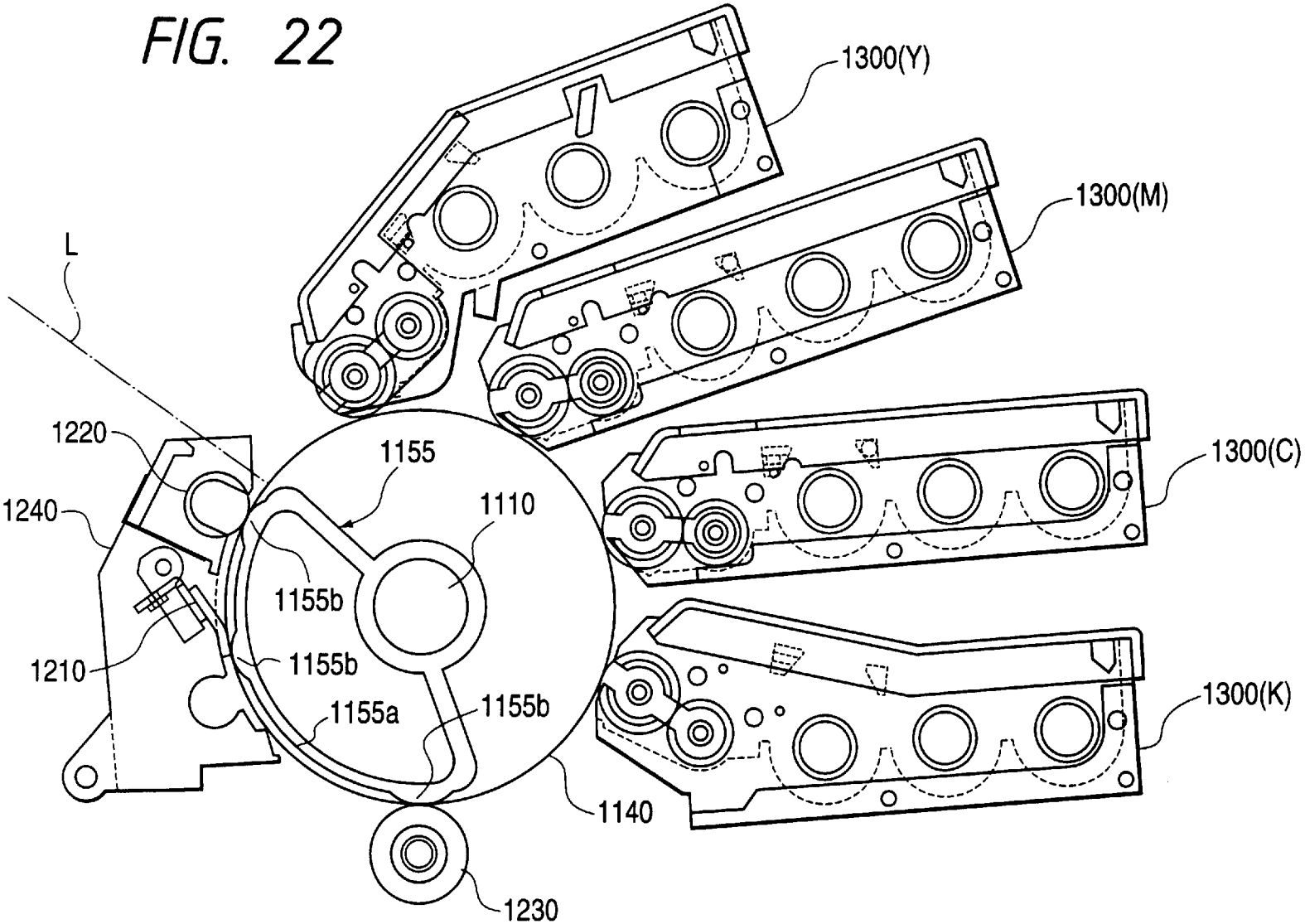
FIG. 22 is a partial side view to show a state in which a fifth embodiment of an image support apparatus according to the present invention is built in an image formation system.

FIG. 22 is a partial side view to show a state in which a fifth embodiment of an image support apparatus according to the present invention is built in an image formation system. Parts similar to those previously described with reference to FIG. 21 are denoted by the same reference numerals in FIG. 22 and will not be discussed again.

The fifth embodiment differs from the fourth embodiment only in the backup mechanism shape.

A backup mechanism 1155 in the fifth embodiment is made of a hollow and substantially semicylindrical member which is substantially fan-shaped on a side view thereof. The backup mechanism 1155 is fixed to a shaft 1110 and has an outer peripheral surface 1155*a* like a substantially circular arc on a side view thereof formed with projections 1155*b* being a substantially semicircular arc in cross section and coming in sliding contact with the inner peripheral surface of an image supporter 1140 at a transfer position (abutment position of a transfer roller 1230), a cleaning position (abutment position of a cleaning member 1210), and a charge position (abutment position of a charge roller 1220) for supporting the image supporter 1140 from the inside. The projections 1155*b* extend in the axial direction of the image supporter 1140 (direction orthogonal to paper face) so that they can back up the image supporter 1140 at the abutment positions.

According to the configuration, the effects of decreasing frictional resistance of the backup mechanism 1155 with the image supporter 1140 as the projections 1155*b* are formed and therefore decreasing the drive torque of the image supporter 1140 can be produced in addition to the functions and effects similar to those of the fourth embodiment.

Sixth Embodiment

Figure 23:
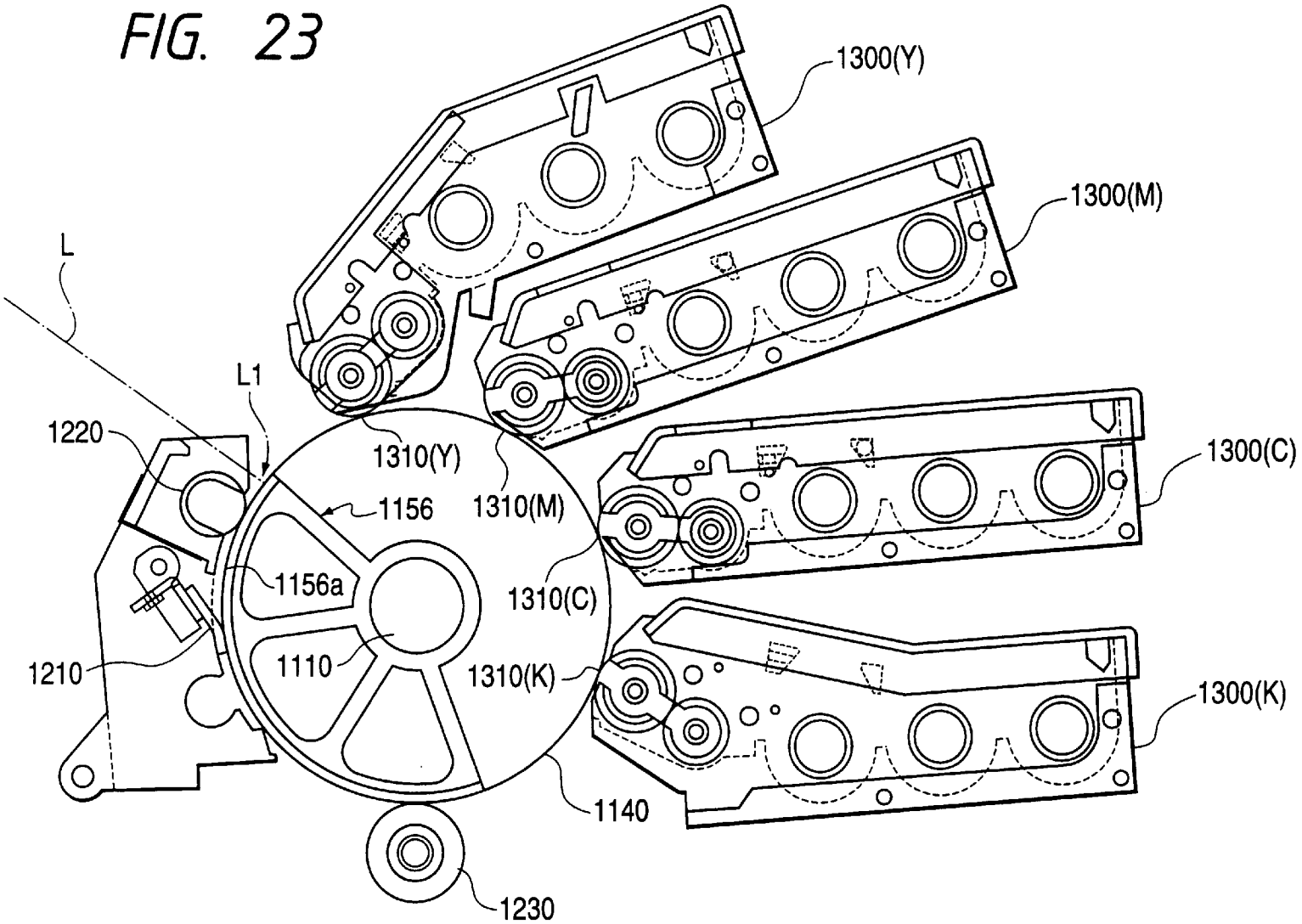
FIG. 23 is a partial side view to show a state in which a sixth embodiment of an image support apparatus according to the present invention is built in an image formation system.

FIG. 23 is a partial side view to show a state in which a sixth embodiment of an image support apparatus according to the present invention is built in an image formation system. Parts similar to those previously described with reference to FIG. 22 are denoted by the same reference numerals in FIG. 23 and will not be discussed again.

A backup mechanism 1156 in the fourth embodiment is made of a hollow and substantially semicylindrical member which is fan-shaped on a side view thereof. The backup mechanism 1156 is fixed to a shaft 1110 and has an outer peripheral surface 1156*a* like a circular arc on a side view thereof coming in sliding contact with the inner peripheral surface of an image supporter 1140 from a transfer position (abutment position of a transfer roller 1230) to a cleaning position (abutment position of a cleaning member 1210) to a charge position (abutment position of a charge roller 1220) to an exposure position L1 for supporting the image supporter 1140 from the inside.

That is, the sixth embodiment is characterized by the fact that the backup mechanism 1156 supports the image supporter 1140 from the inside at the exposure position L1.

The backup mechanism 1156 supports the image supporter 1140 at least at the exposure position L1 toward the outside slightly from the rotation path of the image supporter 1140 formed if the backup mechanism 1156 does not exist. That is, it supports the image supporter 1140 so as to swell it slightly.

According to this configuration, in addition to the functions and effects similar to those of the fourth embodiment, the behavior of the image supporter 1140 at the exposure position L1 becomes stable and therefore an accurate exposure state can be provided.

More particularly, in FIG. 23, the image supporter 1140 is a photosensitive body which is exposed on a surface for forming an electrostatic latent image and a developing roller 1310 is attached to and detached from the image supporter 1140 (photosensitive body). Assuming that there is no member for supporting the image supporter 1140 from the inside at the exposure position L1, the image supporter 1140, which is shaped like a thin cylinder having flexibility, is affected by the attachment or detachment operation of the developing roller 1310 and becomes deformed delicately and it is feared that the exposure position L1 to the image supporter 1140, namely, the photosensitive body may vary. If the exposure position to the photosensitive body 1140 varies, an image is not formed at the position where it is originally intended to be formed, causing image quality to be degraded. Particularly, to superimpose images of a number of colors (Y, C, M, and K) for forming a color image as shown in the figure, a shift occurs among the images of Y, C, M, and K colors and a fine color image cannot be provided.

In contrast, the image support apparatus of the sixth embodiment is provided with the backup mechanism 1156 for supporting the image supporter 1140 from the inside at the exposure position L1, so that the behavior of the image supporter 1140 at the exposure position L1 becomes stable and therefore exposure position variations are decreased. As a result, a high-quality image, particularly a high-quality color image can be provided.

Moreover, the backup mechanism 1156 supports the image support at least at the exposure position L1 toward the outside slightly from the rotation path of the image support formed if the backup mechanism 1156 did not exist. Thus, the behavior of the image supporter 1140 at the exposure position L1 becomes still more stable and a still more accurate exposure state can be provided. Particularly, in FIG. 23, since the abutment positions of the color developing rollers 1310Y, 1310C, 1310M, and 1310K against the image supporter 1140 differ, if the backup mechanism 1156 does not exist, the deformation state of the image supporter 1140 also varies delicately depending on which developing roller abuts the image supporter 1140. According to this embodiment, the backup mechanism 1156 supports the image support at least at the exposure position L1 toward the outside slightly from the rotation path of the image supporter 1140 formed if the backup mechanism 1156 does not exist, so that the behavior of the image supporter 1140 at the exposure position L1 becomes stable and an accurate exposure state can be provided.

Seventh Embodiment

Figure 24:
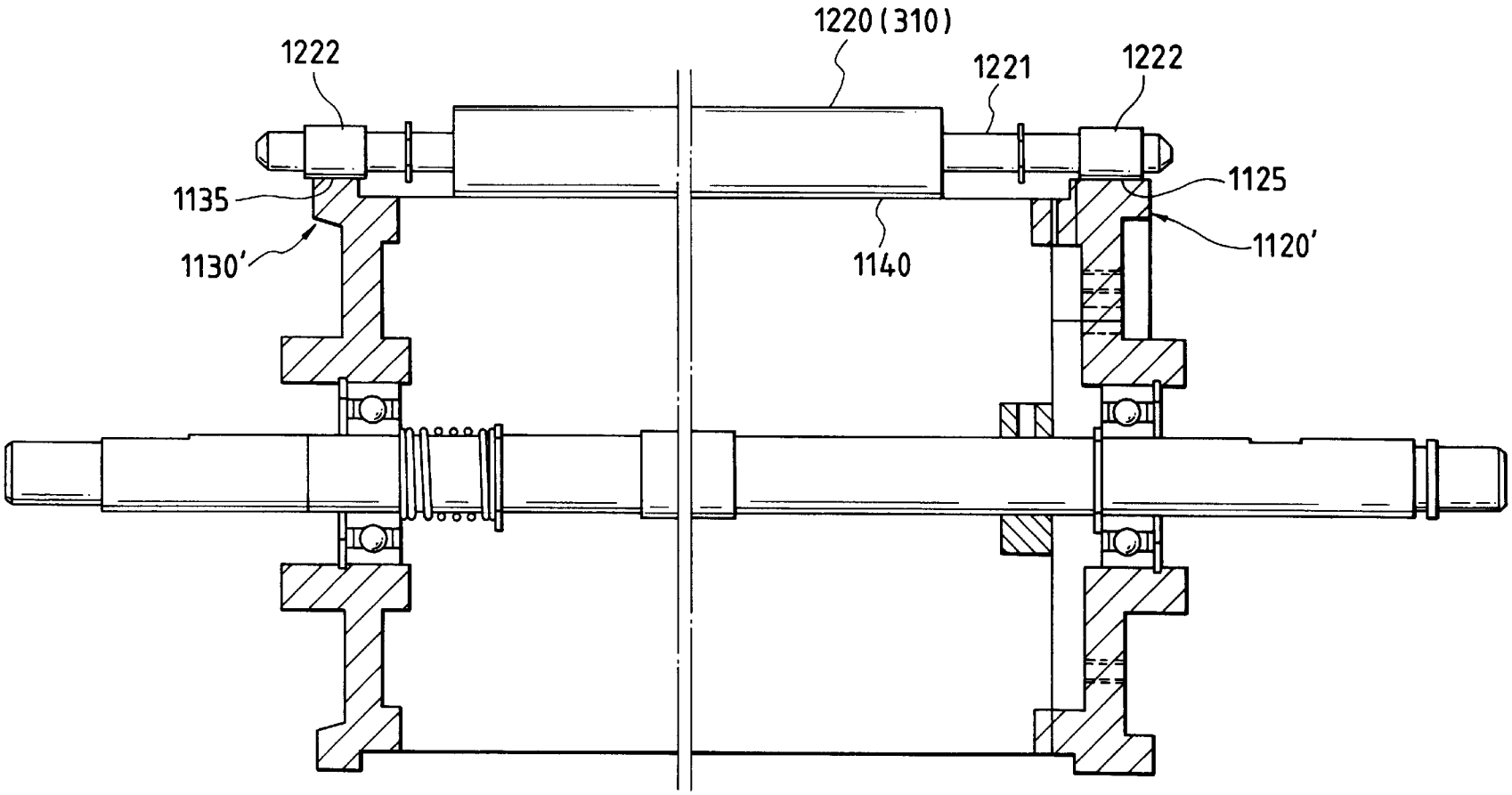
FIG. 24 is a partially omitted sectional view to show a seventh embodiment of an image support apparatus according to the present invention.

FIG. 24 is a partial sectional view of a seventh embodiment of an image support apparatus according to the present invention.

The seventh embodiment of the present invention is characterized by the fact that rolls 1222 are disposed at both ends of a shaft 1221 of a roller abutted against an image supporter 1140, such as a charge roller 1220 or a transfer roller 1230, and are abutted against outer peripheral surfaces 1125 and 1135 of disk-like members 1120' and 1130', thereby positioning the image supporter 1140 and the roller abutted against it.

Therefore, this structure can be adopted for any of the third to sixth embodiments.

Eighth Embodiment

Figure 25:
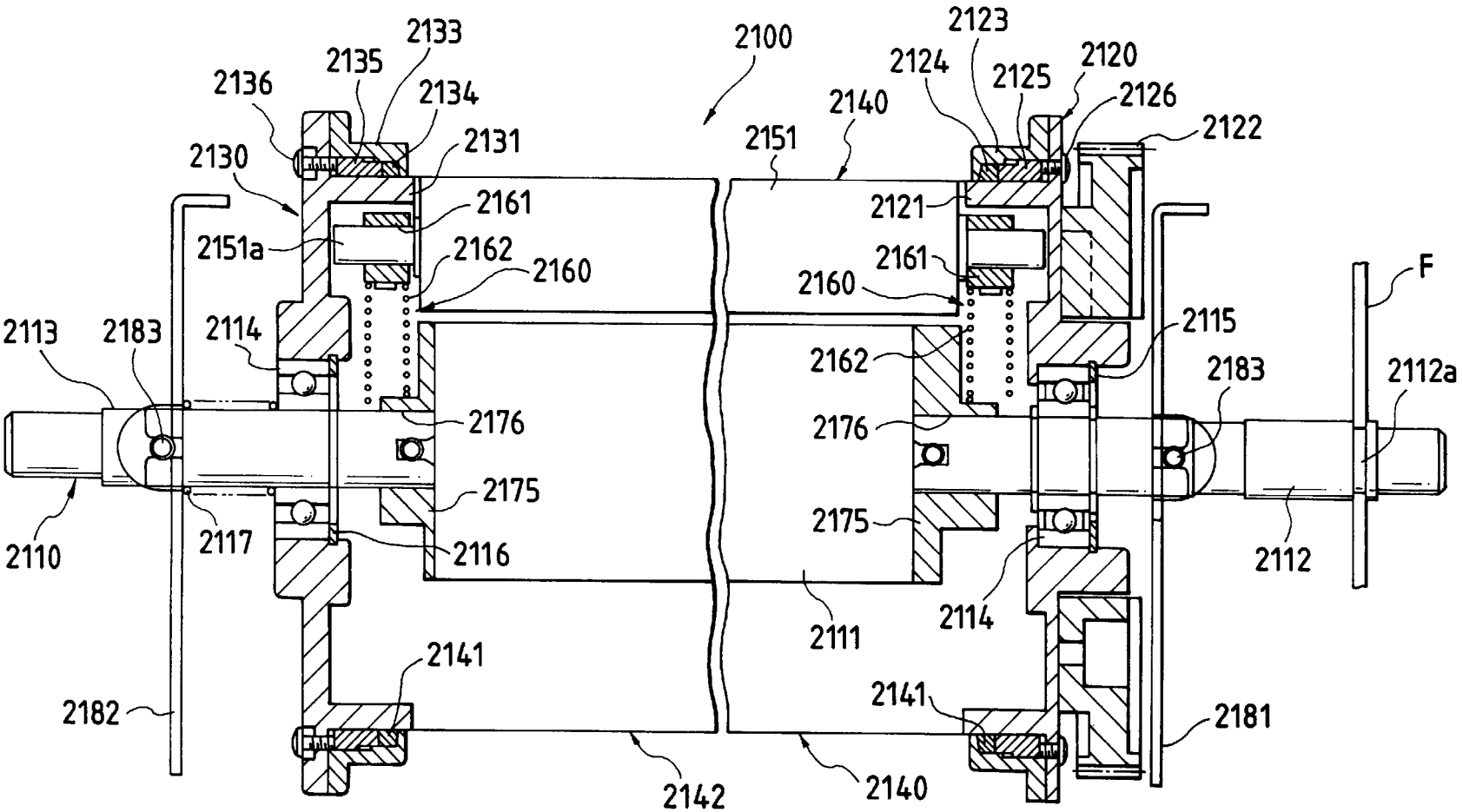
FIG. 25 is a frontal sectional view to mainly show an eighth embodiment of an image support apparatus according to the present invention (equivalent to sectional view taken on line 25—25 in FIG. 27)
Figure 26:
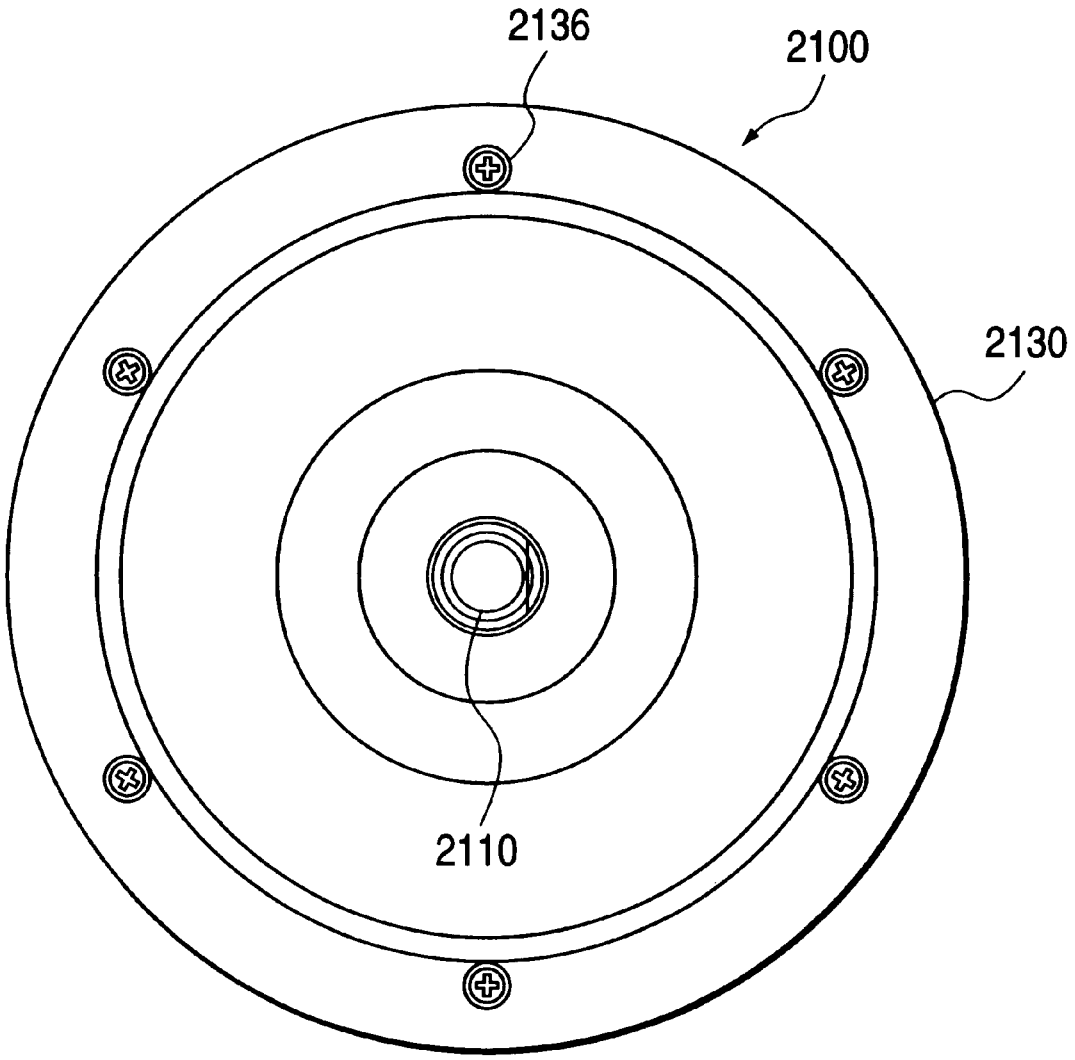
FIG. 26 is a left side view of the image support apparatus of the eighth embodiment.
Figure 27:
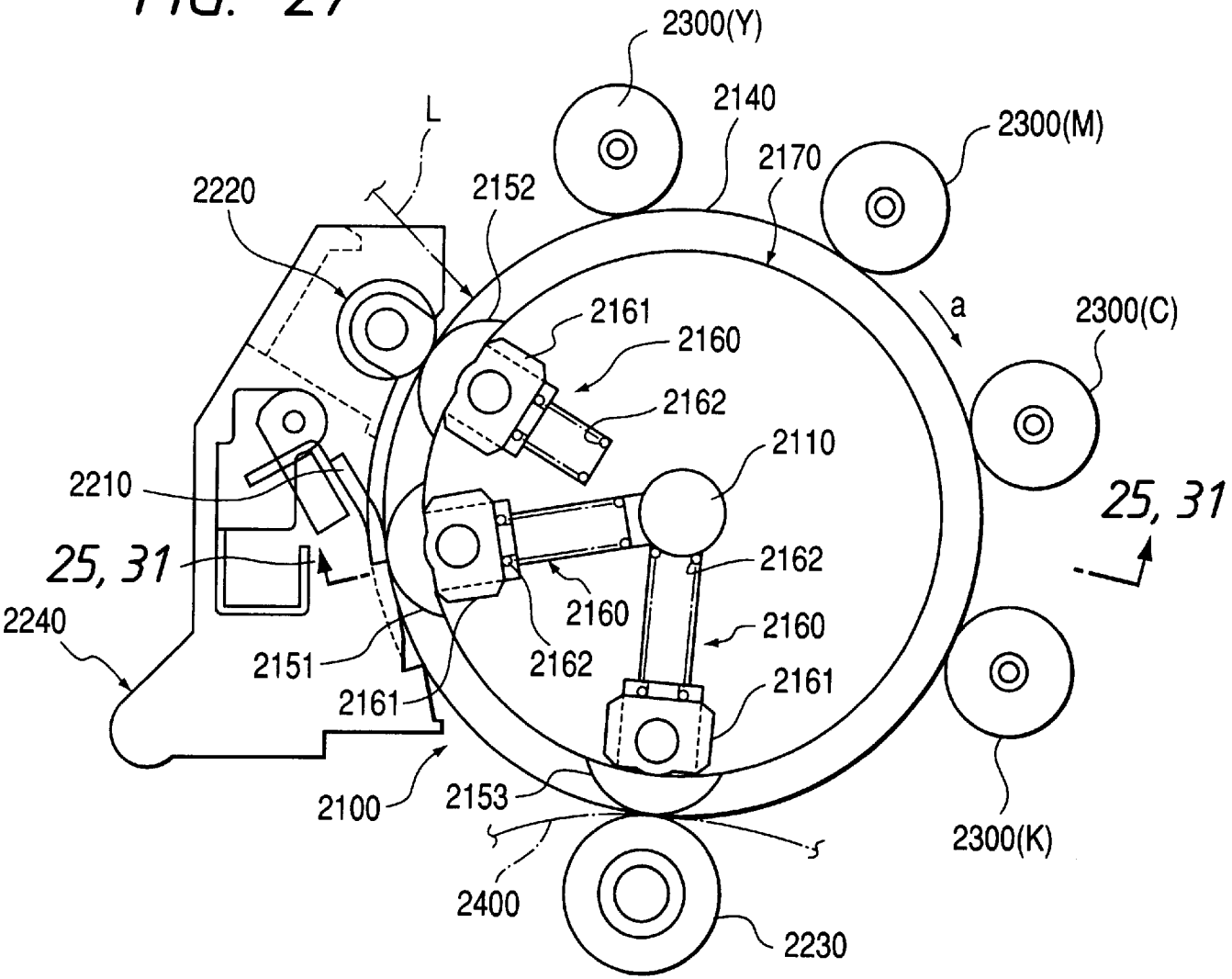
FIG. 27 is a fragmentary sectional view to show a state in which the image support apparatus is built in an image formation system.

FIG. 25 is a frontal sectional view to mainly show an eighth embodiment of an image support apparatus according to the present invention (equivalent to sectional view taken on line 25—25 in FIG. 27). FIG. 26 is a left side view. FIG. 27 is a fragmentary sectional view to show a state in which the image support apparatus is built in an image formation system.

As shown in FIGS. 25–27, the image support apparatus 2100 comprises a shaft 2110 not rotated by itself, a pair of disk-like members 2120 and 2130 attached rotatably to the shaft 2110, an image supporter 2140 shaped like a thin cylinder having flexibility supported and fixed at both ends by the disk-like members 2120 and 2130 and rotated together with the disk-like members 2120 and 2130, a first backup roller 2151, a second backup roller 2152, and a third backup roller 2153 as first, second, and third backup mechanisms being attached to the shaft 2110 inside the image supporter 2140 for supporting the image supporter 2140 from the inside thereof at abutment positions where a cleaning member 2210 (see FIG. 27), a charge roller 2220 (see FIG. 27), and a transfer roller 2230 (see FIG. 27) as abutment members are abutted against the image supporter 2140 from the outside thereof, and urging means 2160 for urging the backup rollers in the support direction (outward in the radial direction).

The backup rollers 2151, 2152, and 2153 are provided for supporting the image supporter 2140 from the inside thereof at abutment positions where the cleaning member 2210, the charge roller 2220, and the transfer roller 2230 abut the image supporter 2140, as described above, and for preventing creep deformation of the image supporter 2140, etc., as described later. Thus, they are formed of material that can prevent inward deformation of the image supporter 2140, such as metal, synthetic resin, or hard rubber.

In this embodiment, the first, second, and third backup rollers 2151, 2152, and 2153 are provided as the backup mechanisms, but only one backup mechanism may be disposed at a necessary place. In this case, it is desirable to place the backup mechanism at the abutment position where the cleaning member 2210 is abutted against the image support.

As shown in FIG. 25, the shaft 2110 comprises a large diameter part 2111 placed inside the image supporter 2140 and small diameter parts 2112 and 2113 projected from both ends of the large diameter part 2111 and penetrating the disk-like members 2120 and 2130. Side plates 2181 and 2182 for mounting the image support apparatus 2100 on a frame F (only a part shown) of an image formation system are attached to the small diameter parts 2112 and 2113. Pins 2183 are used for positioning the side plates 2181 and 2182 and the shaft 2110 in the circumferential direction. One small diameter part 2112 is formed with a ring-like groove 2112*a*. When the image support apparatus 2100 is built in the image formation system, the groove 2112*a* engages the frame F of the image formation system, thereby positioning the image support apparatus 2100 to the frame F.

The disk-like members 2120 and 2130 are attached rotatably to the shaft 2110 each via a bearing 2114. The disk-like members 2120 and 2130 and the bearings 2114 are regulated in sliding in the axial direction of the shaft 2110 by retaining rings 2115 and 2116. A compressed coil spring 2117 for preventing their play is disposed between the left bearing 2114 and the left retaining ring 2116.

Figure 28:
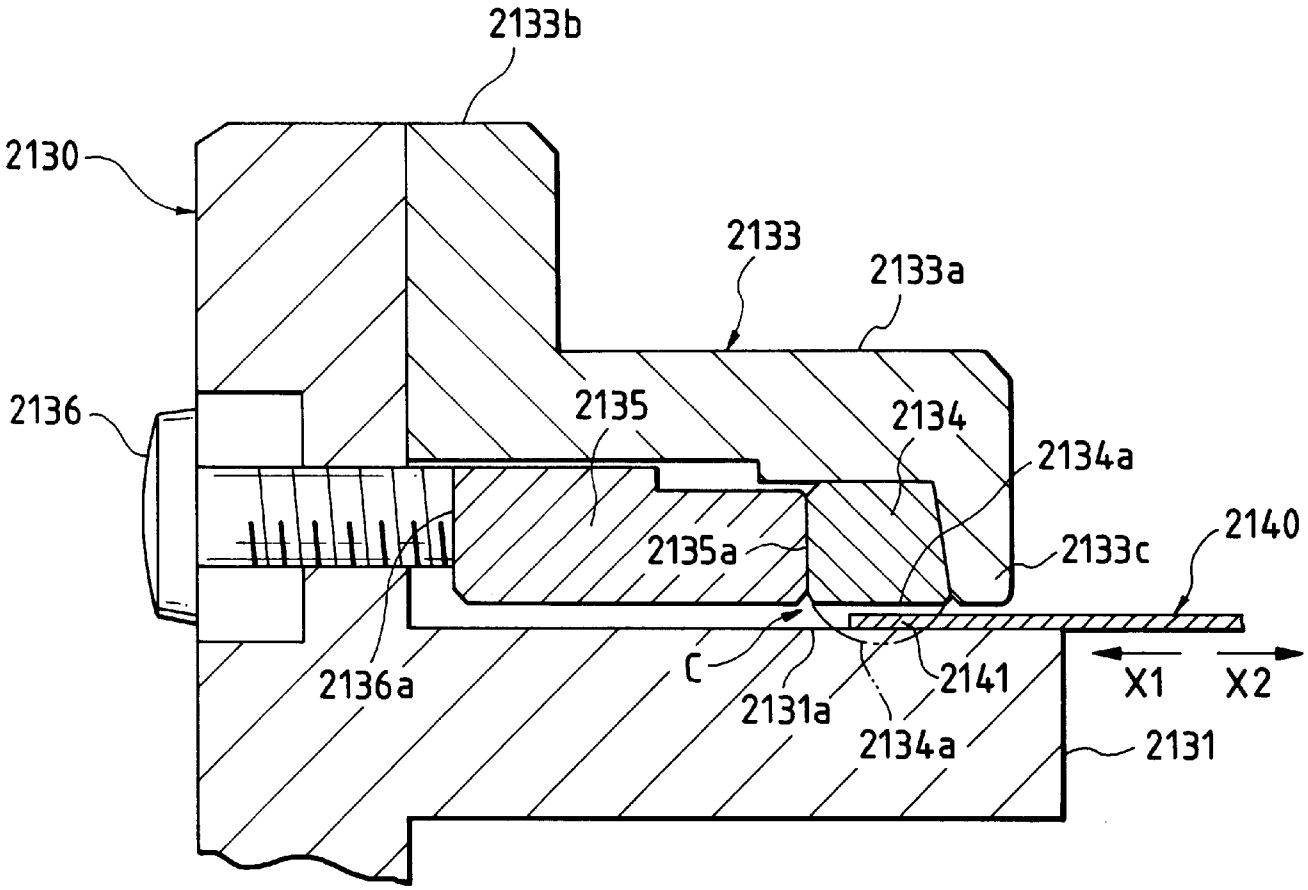
FIG. 28 is a drawing to show an image support end fixation structure and is a partially enlarged view of FIG. 25.

The disk-like members 2120 and 2130 are formed on inner faces with short cylindrical support members 2121 and 2131 for supporting the image supporter 2140 at both ends 2141 thereof. The image supporter 2140 can also be fixed at both ends 2141 to the support members 2121 and 2131 by appropriate means, such as bonding. However, the embodiment adopts the following fixation structure:

FIG. 28 is a drawing to show the fixation structure and is a partially enlarged view of FIG. 25. Since the fixation structure is symmetrical, the structure on the left disk-like member 2130 side will be discussed and the reference numerals of the right members corresponding to the left members are enclosed in parentheses.

As shown in FIGS. 25 and 28, the fixation structure comprises a ring-like member 2133 (2123) placed on the outer peripheral side of the support member 2131 (2121) inside the disk-like member 2130 (2120), an elastic ring 2134 (2124) made of an elastic body such as rubber placed between the ring-like member 2133 (2123) and the support member 2131 (2121), a ring-like slider 2135 (2125) placed between the ring-like member 2133 (2123) and the support member 2131 (2121), and screws 2136 (2126) for sliding the ring-like slider 2135 (2125).

As shown in FIG. 28, the ring-like member 2133 has a tubular part 2133*a*, a flange 2133*b* integral with the tubular part 2133*a*, and a stopper part 2133*c* formed integrally like a ring inward at the tip of the tubular part 2133*a*. The flange 2133*b* is fixed to the disk-like member 2130 by appropriate fixing means, such as a screw (not shown).

The elastic ring 2134 is placed inside the stopper part 2133*c* and a clearance C is formed between an inner peripheral surface 2134*a* of the elastic ring 2134 and an outer peripheral surface 2131*a* of the support member 2131 as indicated by the solid line in FIG. 28 in a state before the ring-like slider 2135 is slid in the arrow X2 direction as described above. Therefore, in this state, the end 2141 of the image supporter 2140 can be inserted into the clearance C.

The ring-like slider 2135 is placed between the elastic ring 2134 and the disk-like member 2130.

The screw 2136 threadably engages the disk-like member 2130 and can abut the ring-like slider 2135 at a tip 2136*a* of the screw 2136. A plurality of the screws 2136 are equally spaced from each other in the circumferential direction (in the embodiment, six screws as shown in FIG. 26).

Therefore, if the screws 2136 are turned in the structure, the tips 2136*a* of the screws abut the ring-like slider 2135 and slide it in the arrow X2 direction.

When the ring-like slider 2135 is slid in the arrow X2 direction, a ring-like tip face 2135*a* of the ring-like slider 2135 presses the elastic ring 2134 between the tip face 2135*a* and the stopper part 2133*c* of the ring-like member 2133.

The inner peripheral surface 2134*a* of the elastic ring 2134 this pressed attempts to swell inwardly as indicated by the phantom line in FIG. 28 (the state is drawn conceptually). In fact, the swelling is blocked by the support member 2131 and the end 2141 of the image supporter 2140. As a result, the end 2141 of the image support is sandwiched between the support member 2131 and the inner peripheral surface 2134*a* of the elastic ring.

That is, according to the fixation structure, the screws 2136 are turned for sliding the ring-like slider 2135, whereby the end 2141 of the image support is sandwiched between the swelling inner peripheral surface 2134*a* of the elastic ring 2134 and the support member 2131 and can be fixed to the support member 2131.

As shown in FIG. 25, a drive gear 2122 is fixed to the other disk-like member 2120 on the outer face thereof.

Figures 29A, 29B:
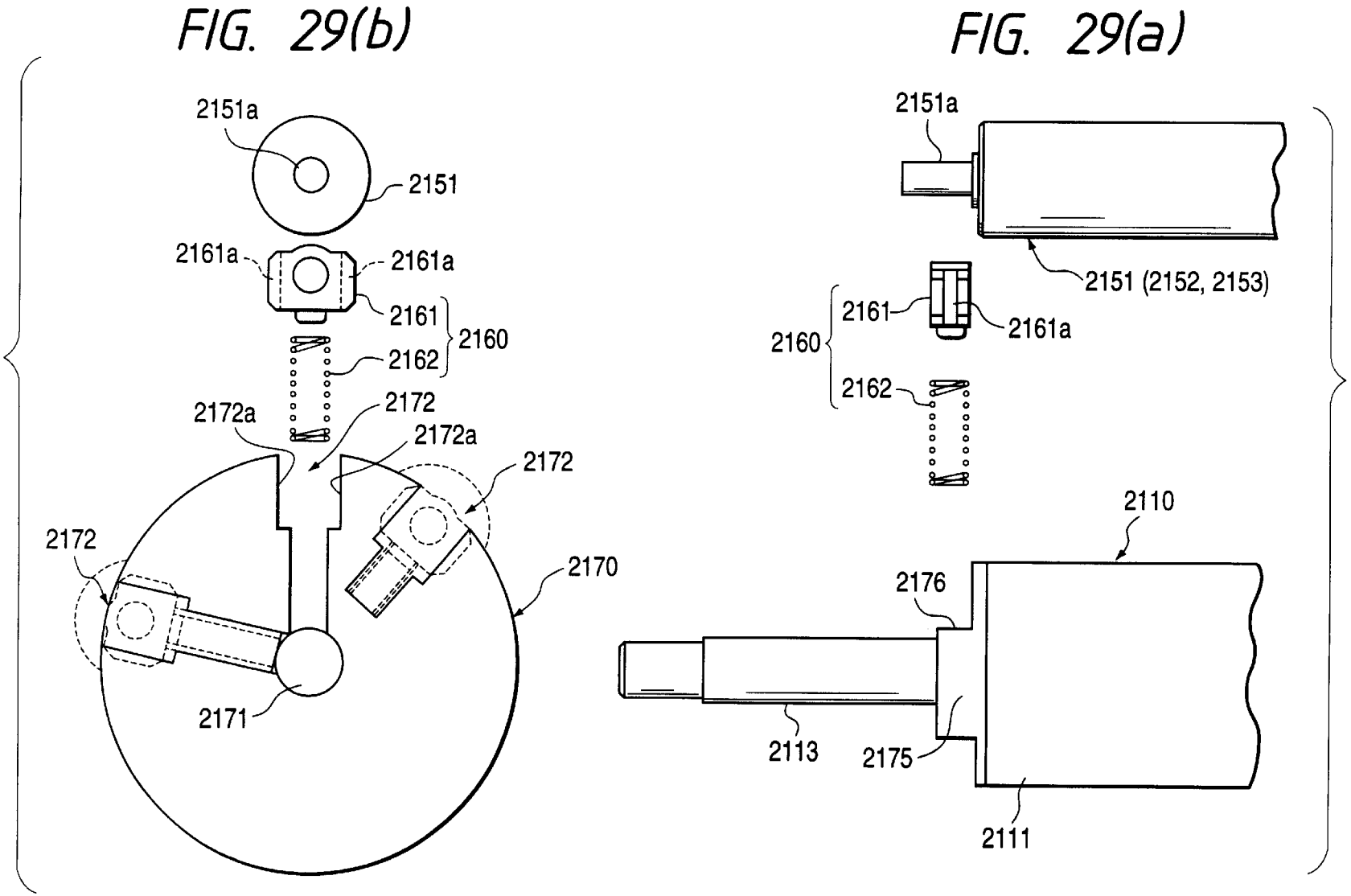
FIGS. 29(*a*) and 29(*b*) relate to a backup roller attachment structure.

The backup rollers 2151, 2152, and 2153 are attached to the shaft 2110 via a pair of attachment plates 2170 and 2170 and the urging means 2160, as shown in FIGS. 25, 27, and 29. The backup rollers 2151, 2152, and 2153 are basically the same in attachment structure and the attachment structure will be discussed with the backup roller 2151 as a representative.

Flanges 2175 and 2175 are fixed to the large diameter parts 2111 of the shaft 2110 at both sides thereof and the attachment plates 2170 are fixed to the flanges 2175.

As shown in FIG. 29, an insertion hole 2171 for the small diameter part 2112 or 2113 of the shaft 2110 is made in the center of the attachment plate 2170, the small diameter part of the shaft is inserted into the insertion hole 2171, and the attachment plate 2170 is fixed to the flange 2175 by a screw, etc., (not shown). Attachment hollows 2172 of the urging means 2160 are made in the attachment plate 2170.

The urging means 2160 corresponding to the backup roller 2151 comprises bearing members 2161 and 2161 for rotatably supporting shaft ends 2151*a* of the backup roller 2151 and compressed springs 2162 and 2162 for urging the bearing members 2161 and 2161 outward in the radial direction of the shaft 2110.

Figure 30A:
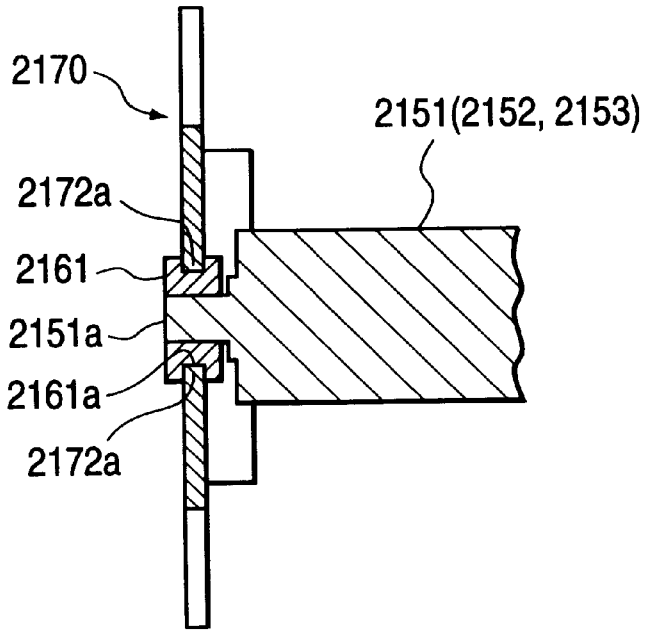
FIGS. 30(*a*) and 30(*b*) relate to a backup roller attachment structure.
Figure 30B:
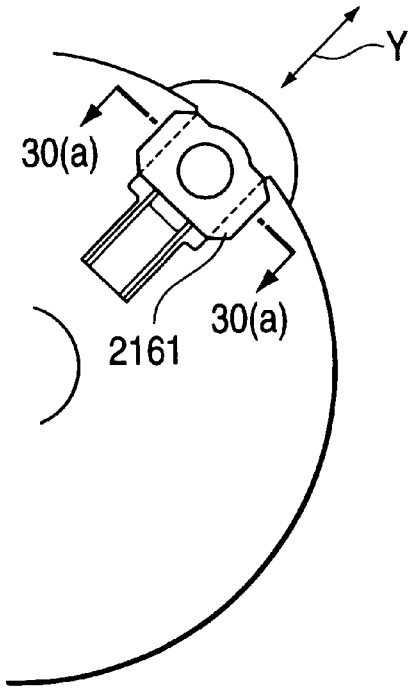

Guide grooves 2161*a* and 2161*a* are made in both side parts of the bearing member 2161 and side margin parts 2172*a* and 2172*a* forming the attachment hollow 2172 of the attachment plate 2170 engage the guide grooves 2161*a* and 2161*a* as shown in FIG. 30 (*a*), whereby the bearing member 2161 is attached to the attachment plate 2170 slidably in the radial direction of the shaft 2110 (arrow Y direction in FIG. 30(*b*)).

The compressed spring 2162 is disposed between the bearing member 2161 and a tubular part 2176 of the flange 2175.

The backup rollers 2151, 2152, and 2153 are placed in the image supporter 2140 so as to contract the compressed springs 2162 for supporting the image supporter 2140 from the inside thereof by the urging force of the compressed springs 2162, as shown in FIGS. 25 and 27.

As shown in FIG. 27, the image support apparatus 2100 is built in the image formation system and the drive gear (not shown) of the image formation system main body meshes with the drive gear 2122, whereby the image supporter (photosensitive body) 2140 is rotated in the arrow a direction.

In FIG. 27, numeral 2220 is the above-mentioned charge roller, L is a laser beam for selectively exposing the surface of the photosensitive body 2140, numerals 2300Y, 2300M, 2300C, and 2300K are developing rollers, numeral 2230 is the above-mentioned transfer roller, and numeral 2210 is the above-mentioned cleaning member.

The charge roller 2220 abuts the outer peripheral surface of the photosensitive body 2140 for uniformly charging the outer peripheral surface.

The laser beam L is emitted from exposure mechanisms (not shown) for selectively exposing the surface of the photosensitive body 2140 for forming an electrostatic latent image on the surface of the photosensitive body (image support) 2140.

The developing rollers 2300Y, 2300M, 2300C, and 2300K can be attached to and detached from the photosensitive body 2140; only one of the developing rollers can abut the photosensitive body 2140 at any given time. The developing rollers 2300Y, 2300M, 2300C, and 2300K supply yellow, magenta, cyan, and black toners, respectively, onto the photosensitive body 2140. The developing rollers are made of metal rollers with roughened surfaces or hard resin rollers.

An intermediate transfer belt 2400 is circulated between the transfer roller 2230 and the photosensitive body 2140 and a secondary transfer roller (not shown) is placed facing the intermediate transfer belt 2400. While the intermediate transfer belt 2400 is circulated, a toner image on the photosensitive body 2140 is transferred onto the intermediate transfer belt 2400 between the transfer roller 2230 (primary transfer roller) and the photosensitive body 2140 and the toner image transferred onto the intermediate transfer belt 2400 is transferred to a recording medium such as paper supplied between the intermediate transfer belt 2400 and the secondary transfer roller.

The cleaning member 2210 includes a cleaning blade. The cleaning blade 2210 and the charge roller 2220 are built in a subcase 2240. The subcase 2240 can be combined with the image support apparatus 2100 using the side plates 2181 and 2182 (see FIG. 25) as a single unit.

The image formation system can form a full color image with four color toners of yellow (Y), magenta (M), cyan (C), and black (B) and operates as described before.

The image support apparatus 2100 can produce the following functions and effects:

(a) The image supporter 2140 shaped like a thin cylinder is supported and fixed at both ends 2141 by the disk-like members 2120 and 2130 attached rotatably to the shaft 2110. Thus, when the disk-like members 2120 and 2130 are rotated, the image supporter 2140 is rotated reliably.

Since the image supporter 2140 is supported and fixed at both ends 2141 by the disk-like members 2120 and 2130, excellent durability is also provided.

(b) The image supporter 2140 is shaped like a thin cylinder having flexibility and is supported at both ends 2141 by the disk-like members 2120 and 2130, thus the center portion 2142 (see FIG. 25) of the image supporter 2140 not supported by the disk-like member 2120, 2130 can be deformed inwardly.

Therefore, the portion of the center portion 2142 of the image supporter 2140 where the backup mechanism 2151, 2152, 2153 is not disposed can be used as an artificial soft material. Even if the member abutted against it is a hard roller such as the developing roller 2300, a reliable and stable contact state can be provided and an image can be formed or supported reliably on the image supporter 2140.

On the other hand, the cleaning member 2210, the charge roller 2220, and the transfer roller 2230 as abutment members are abutted against the outer peripheral surface of the image supporter 2140. At the abutment positions, the image supporter 2140 is supported from the inside by the backup mechanisms 2151, 2152, and 2153, so that the abutment members can be abutted reliably.

That is, the cleaning member 2210 and the charge roller 2220 can be abutted against the image supporter 2140 reliably for removing the toner remaining on the outer peripheral surface of the image supporter 2140 reliably and charging reliably. At the transfer position, the image supporter 2140 can also be abutted reliably against the intermediate transfer belt 2400 in the transfer roller 2230 portion.

Moreover, assuming that the cleaning member 2210, etc., is abutted against the image supporter 2140 in a state in which the backup mechanisms 2151–2153 do not exist, it is feared that the image supporter 2140 like a thin cylinder may become creep-deformed. However, the image support apparatus 2100 of the embodiment also eliminates such a fear.

Further, the backup mechanisms 2151, etc., support the image supporter 2140 from the inside thereof with the backup mechanisms urged by the urging means 2160, so that positional accuracy between the image supporter 2140 and the backup mechanisms 2151, etc., is enhanced.

(c) The image supporter 2140 is supported and fixed at both ends 2141 by the disk-like members 2120 and 2130 attached rotatably to the shaft 2110 and the backup mechanisms 2151, etc., are attached to the shaft 2110 inside the image supporter 2140, whereby they are put into a unit for easy handling.

Thus, the image support apparatus 2100 of the embodiment can provide a reliable and stable contact state with the abutment members, is excellent in durability and handling, and can be driven reliably.

Further, since (d) The backup mechanisms 2151, 2152, and 2153 are rotatable rollers, the load on the image supporter 2140 can be lessened and therefore the drive torque of the image supporter 2140 can be decreased.

Ninth Embodiment

Figure 31:
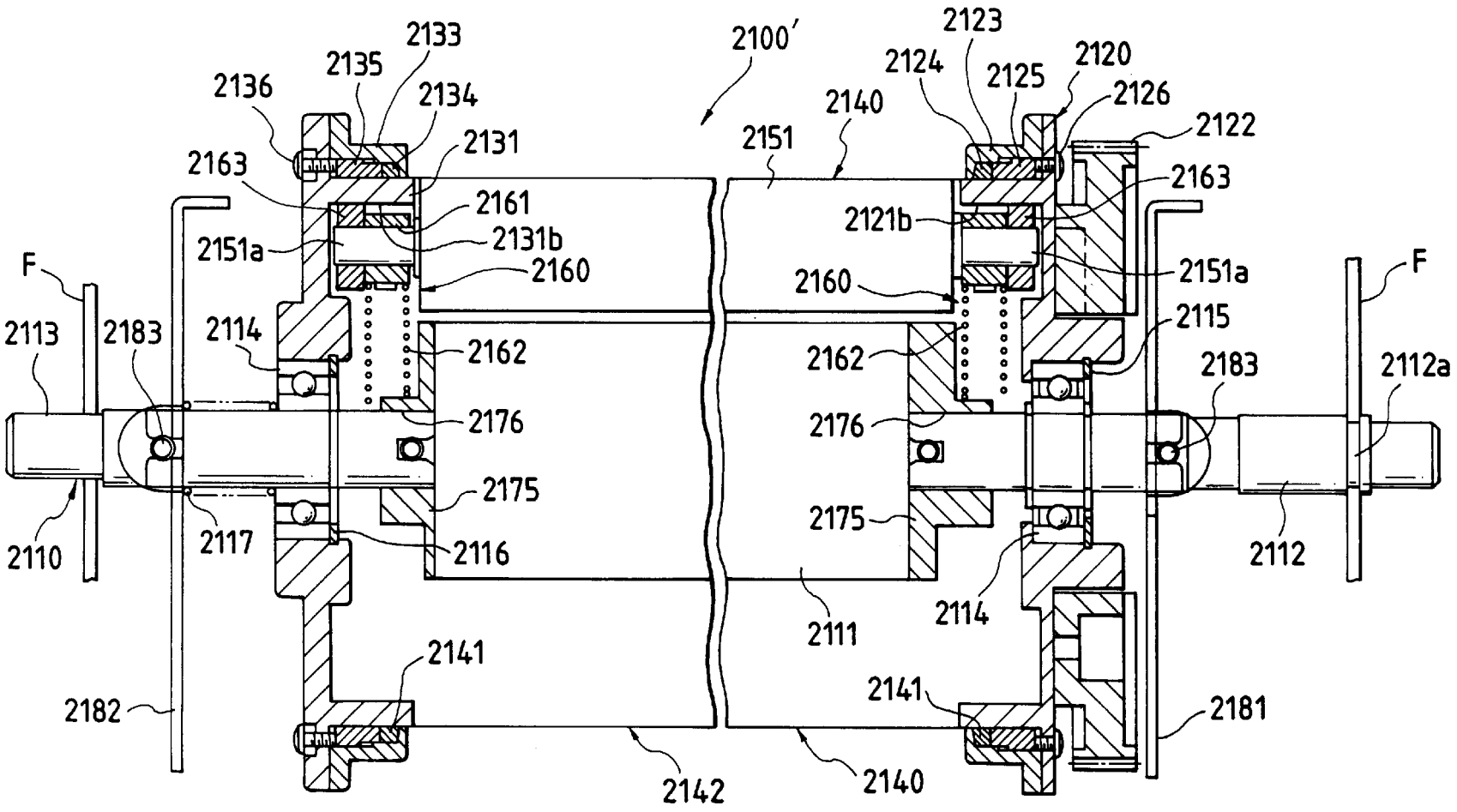
FIG. 31 is a frontal sectional view to mainly show a ninth embodiment of an image support apparatus according to the present invention (equivalent to sectional view taken on line 31—31 in FIG. 27)

FIG. 31 is a frontal sectional view to mainly show a ninth embodiment of an image support apparatus according to the present invention (equivalent to sectional view taken on line 31—31 in FIG. 27). Parts similar to those previously described with reference to FIG. 25 are denoted by the same reference numerals in FIG. 31 and will not be discussed again.

The ninth embodiment differs from the eighth embodiment in that positioning rollers 2163 and 2163 are disposed at shaft ends 2151*a* and 2151*a* of backup roller 2151, 2152, 2153 (only 2151 shown) and are abutted against inner peripheral surfaces 2121*b* and 2131*b* of support members 2121 and 2131 of disk-like members 2120 and 2130, thereby positioning the backup roller 2151, 2152, 2153.

According to the configuration, the following function and effect (e) can be provided in addition to the functions and effects in (a)–(d) described above:

(e) The rollers 2163 and 2163 abut the inner peripheral surfaces 2121*b* and 2131*b* of the support members 2121 and 2131 of the disk-like members 2120 and 2130, thereby positioning the backup roller 2151, 2152, 2153. That is, the urging force of compressed springs 2162 is received by the support members 2121 and 2131, so that an unnecessary force can be prevented from acting on an image support 2140. Therefore, wear of the inner face of the image support 2140 can be decreased. The need for producing excessive fixation strength of the image support 2140 to the support members 2121 and 2131 is eliminated and cost reduction is also enabled.

Tenth Embodiment

Figure 32:
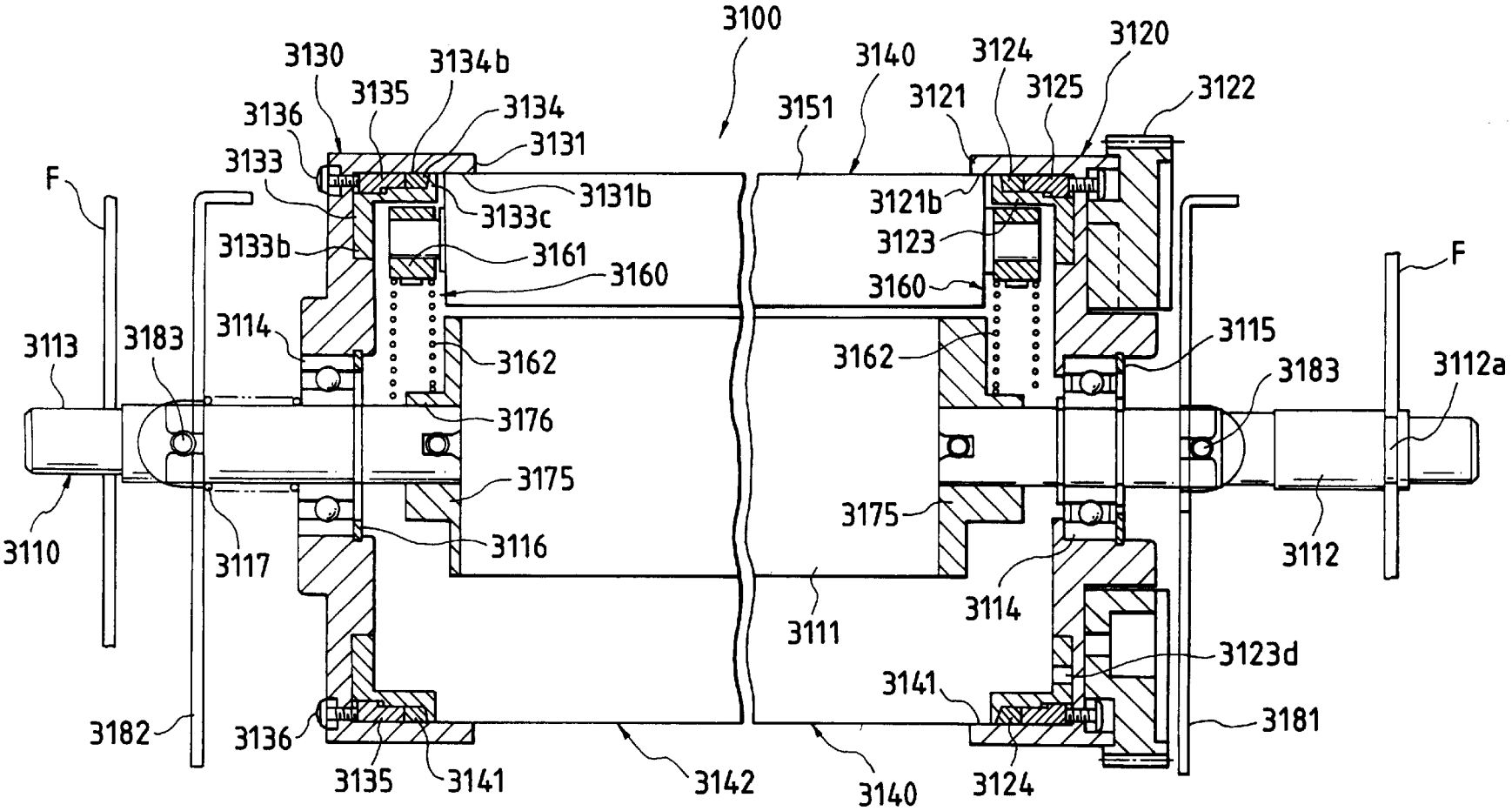
FIG. 32 is a frontal sectional view to mainly show a tenth embodiment of an image support apparatus according to the present invention.

FIG. 32 is a frontal sectional view to mainly show a tenth embodiment of an image support apparatus according to the present invention.

Figure 33:
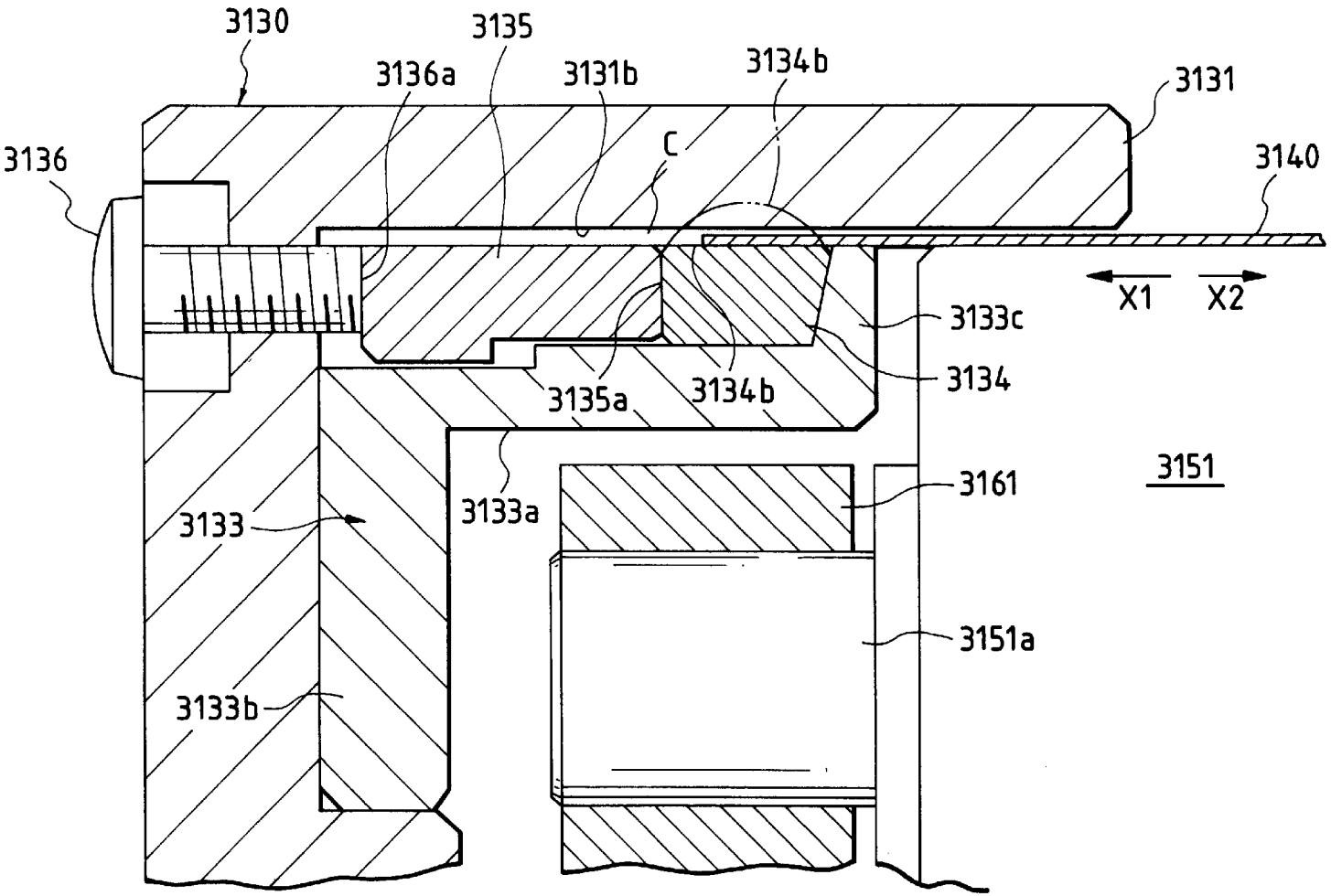
FIG. 33 is a drawing to show an image supporter end fixation structure of the tenth embodiment and is a partially enlarged view of FIG. 32.

The image supporter 3140 is fixed at both ends 3141 by adopting the following structure in the embodiment:

FIG. 33 is a drawing to show the fixation structure and is a partially enlarged view of FIG. 32. Since the fixation structure is symmetrical, the structure on the left disk-like member 3130 side will be discussed and the reference numerals of the right members corresponding to the left members are enclosed in parentheses.

As shown in FIGS. 32 and 33, the fixation structure comprises a ring-like member 3133 (3123) as a regulation part placed on the outer peripheral side of the support member 3131 (3121) inside the disk-like member 3130 (3120), an elastic ring 3134 (3124) made of an elastic body such as rubber placed inside in the circumferential direction via the end 3141 of the image supporter 3140 on the support member 3131 (3121) between the ring-like member 3133 (3123) and the support member 3131 (3121), a ring-like slider 3135 (3125) as a press member placed between the ring-like member 3133 (3123) and the support member 3131 (3121), and screws 3136 (3126) for sliding the ring-like slider 3135 (3125).

As shown in FIG. 33, the ring-like member 3133 has a tubular part 3133*a*, a flange 3133*b* integral with the tubular part 3133*a*, and a stopper part 3133*c* formed integrally like a ring inward at the tip of the tubular part 3133*a*. The flange 3133*b* is fixed to the disk-like member 3130 by appropriate fixing means, such as a screw, (not shown). In FIG. 32, numeral 3123*d* is a screw hole for a screw fixing the ring-like member 3123 (3133) to the disk-like member 3120 (3130).

The elastic ring 3134 is placed inside the stopper part 3133*c* and a clearance C is formed between an outer peripheral surface 3134*b* of the elastic ring 3134 and an inner peripheral surface 3131*b* of the support member 3131 as indicated by the solid line in FIG. 33 in a state before the ring-like slider 3135 is slid in the arrow X2 direction as described above. Therefore, in this state, the end 3141 of the image supporter 3140 can be inserted into the clearance C.

The ring-like slider 3135 is placed between the elastic ring 3134 and the disk-like member 3130.

The screw 3136 threadably engages the disk-like member 3130 and can abut the ring-like slider 3135 at a tip 3136*a* of the screw 3136. A plurality of the screws 3136 are equally spaced from each other in the circumferential direction (in the embodiment, six screws like as shown in FIG. 26).

Therefore, if the screws 3136 are turned in the structure, the tips 3136*a* of the screws abut the ring-like slider 3135 and slide it in the arrow X2 direction.

When the ring-like slider 3135 is slid in the arrow X2 direction, a ring-like tip face 3135*a* of the ring-like slider 3135 presses the elastic ring 3134 between the tip face 3135*a* and the stopper part 3133*c* of the ring-like member 3133.

Since the elastic ring 3134 is regulated in deformation other than deformation toward the support member 3131 by the tubular part 3133*a* and the stopper part 3133*c* of the ring-like member 3133, the outer peripheral surface 3134*b* of the elastic ring 3134 that is pressed attempts to swell to the support member 3131 (outward in the circumferential direction) almost equally in the circumferential direction as indicated by the phantom line in FIG. 33 (the state is drawn conceptually). In fact, however, the swelling is blocked by the support member 3131 and the end 3141 of the image supporter 3140. As a result, the end 3141 of the image support is pressed and widened by the outer peripheral surface 3134*b* of the elastic ring 3134 and is sandwiched between the support member 3131 and the outer peripheral surface 3134*b* of the elastic ring and is also positioned in the radial direction by the inner peripheral surface 3131*b* of the support member 3131.

That is, according to the fixation structure, the screws 3136 are turned for sliding the ring-like slider 3135, whereby the end 3141 of the image supporter 3140 is sandwiched between the outer peripheral surface 3134*b* of the elastic ring 3134 swelling almost equally in the circumferential direction and the support member 3131 and can be positioned and fixed to the support member 3131.

According to the configuration, the following functions and effects (f), (g), (h), (i) and (j) can be provided in addition to the functions and effects in (a)–(d) described above:

(f) The disk-like members 3120 and 3130 are formed with the support members 3121 and 3131 concentric with the image supporter 3140 for supporting the image supporter 3140 at ends 3141 thereof and the elastic rings 3124 and 3134 each made of an elastic body are placed via the ends 3141 of the image supporter 3140 on the support members 3121 and 3131. The regulation parts 3123 and 3133 for regulating deformation other than deformation of the elastic rings 3124 and 3134 toward the support members 3121 and 3131 are disposed on the opposite side to the support members 3121 and 3131 with respect to the elastic rings 3124 and 3134 and the ring-like press members 3125 and 3135 for pressing the elastic rings 3124 and 3134 axially are provided. Thus, when the elastic rings 3124 and 3134 are pressed by the press members 3125 and 3135, they become deformed so as to swell to the support members 3121 and 3131 almost equally in the circumferential direction, causing the ends 3141 of the image supporter 3140 to be sandwiched and fixed between the elastic rings 3124 and 3134 and the support members 3121 and 3131.

Therefore, the ends 3141 of the image supporter 3140 that are fixed become parallel to the support members 3121 and 3131, which are concentric with the image supporter 3140 and can be prepared with high (exact) roundness. As a result, the roundness of the image supporter 3140 supported and fixed at both ends 3141 by the support members 3121 and 3131 of the disk-like members 3120 and 3130 can also be improved.

(g) Moreover, the support members 3121 and 3131 are adapted to support the ends 3141 of the image supporter 3140 from the outside in the circumferential direction and the elastic rings 3124 and 3134 are placed inside in the circumferential direction via the ends 3141 of the image support on the support members 3121 and 3131. Thus, when the elastic rings 3124 and 3134 are pressed by the press members 3125 and 3135, they become deformed so as to swell outward in the circumferential direction, causing the ends 3141 of the image supporter 3140 to be widened outward in the circumferential direction and sandwiched between the elastic rings 3124 and 3134 and the support members 3121 and 3131.

Therefore, asperities viewed from the axial direction do not occur at the ends 3141 of the image supporter 3140, resulting in more improvement in the roundness of the image supporter 3140.

(h) The image support apparatus 3100 can be manufactured by placing the members as described above and pressing the elastic rings 3124 and 3134 by the press members 3125 and 3135 for fixing the ends 3141 of the image support 3140. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image support member described in Unexamined Japanese Patent Publication No. Sho 58-86550 (see FIG. 51) are also eliminated, so that the image support apparatus 3100 can be manufactured easily.

Thus, the image support apparatus 3100 of this embodiment can produce the effects of improving the roundness, providing a reliable and stable contact state with the abutment members such as the hard roller, and easy manufacturing.

(i) Moreover, pressing of the elastic rings 3124 and 3134 by the press members 3125 and 3135 is released, whereby the ends 3141 of the image supporter 3140 can be unfixed and the image supporter 3140, a consumable article, and the disk-like members 3120 and 3130, etc., that can be used for a long term can be disassembled, so that the effect of recycling the parts other than the image support can also be produced.

(j) Furthermore, the disk-like members 3120 and 3130 are provided with the support members 3121 and 3131 for positioning the backup mechanisms 3151, etc., and the image supporter 3140 in the radial direction at the same time, namely, the image supporter 3140 and the backup mechanisms 3151, etc., are positioned by the common positioning parts, so that positional accuracy between the image supporter 3140 and the backup mechanisms 3151, etc., is more enhanced.

Further, the urging force of the urging means 3160 is received at the positioning parts 3121*b* and 3131*b*, so that an unnecessary force can be prevented from acting on the image supporter 3140. Therefore, wear of the inner face of the image supporter 3140, particularly wear of the inner face of the center portion 3142 can be decreased. The need for producing excessive fixation strength of the image supporter 3140 to the support members 3121 and 3131 is eliminated and cost reduction is also enabled.

Eleventh Embodiment

Figure 35:
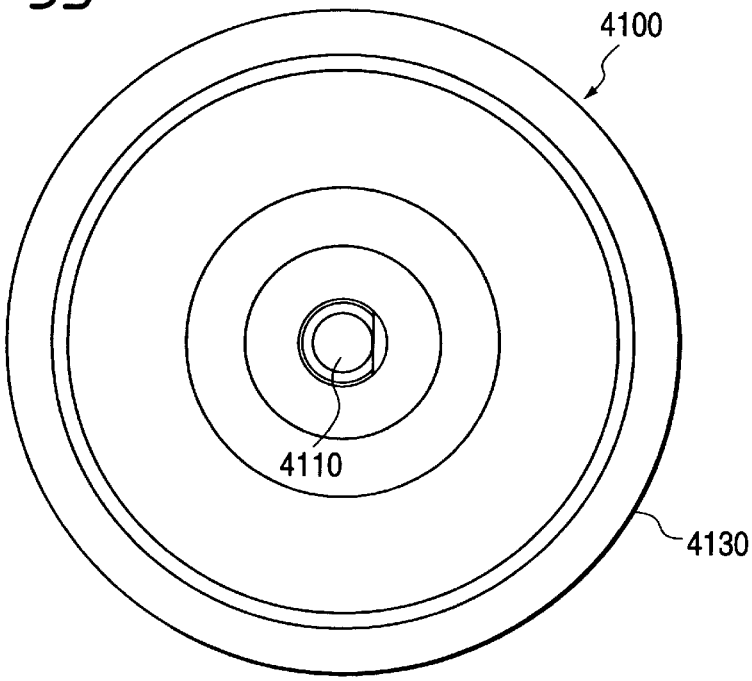
FIG. 35 is a left side view of the image support apparatus of the eleventh embodiment.
Figure 36:
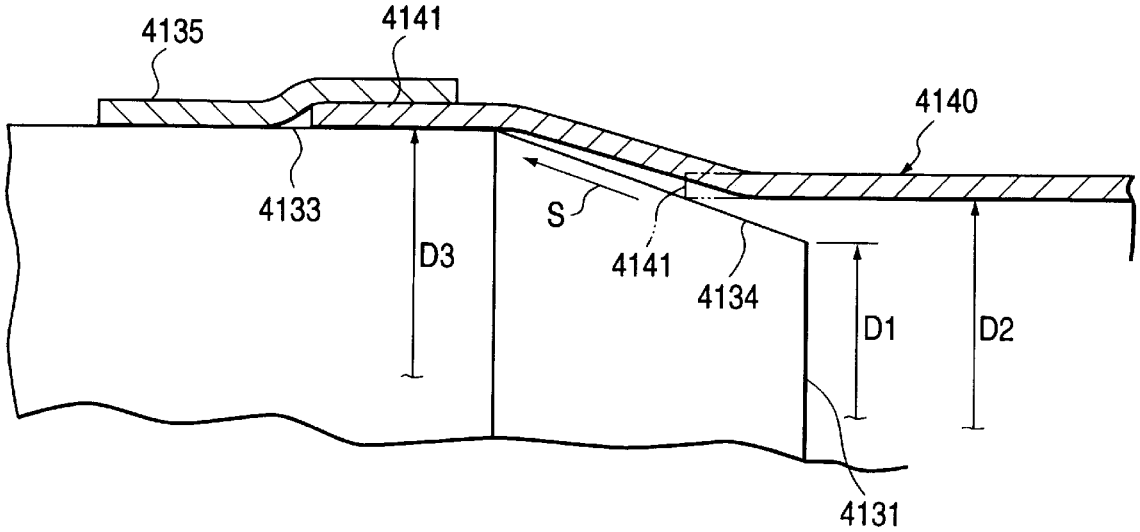
FIG. 36 is a drawing to show an image supporter end fixation structure of the eleventh embodiment and is a partially enlarged view of FIG. 34.
Figure 37:
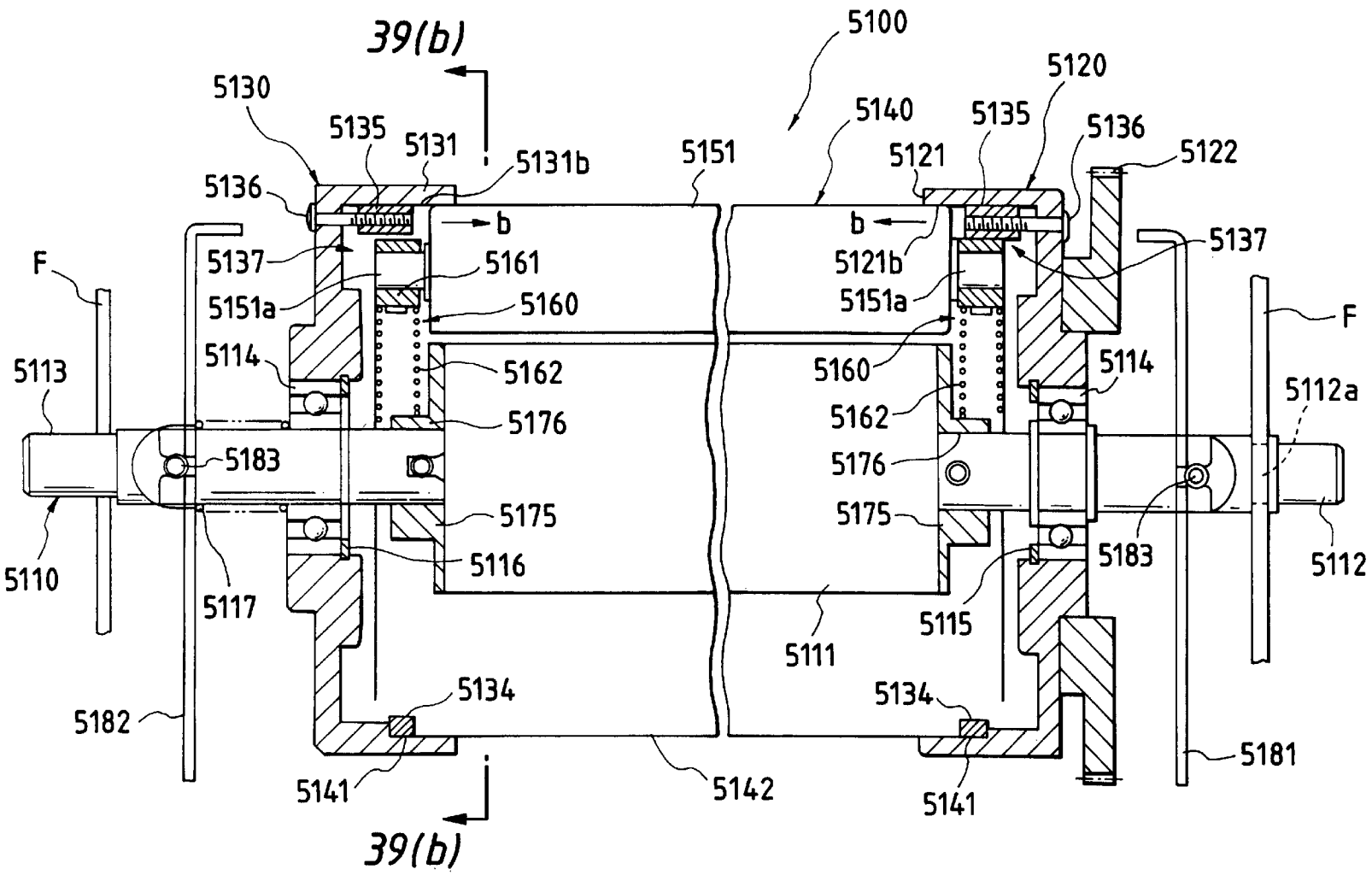
FIG. 37 is a frontal sectional view to mainly show an twelfth embodiment of an image support apparatus according to the present invention.

FIG. 37 is a frontal sectional view to mainly show an eleventh embodiment of an image support apparatus according to the present invention. FIG. 35 is a left side view. FIG. 36 is a drawing to show the support structure of an image support and is a partially enlarged view of FIG. 34.

The image supporter 4140 is fixed at both ends 4141 by adopting the following structure in this embodiment:

Since the fixation structure is symmetrical, the structure on the left disk-like member 4130 side will be discussed and the reference numerals of the right members corresponding to the left members are enclosed in parentheses.

Figure 34:
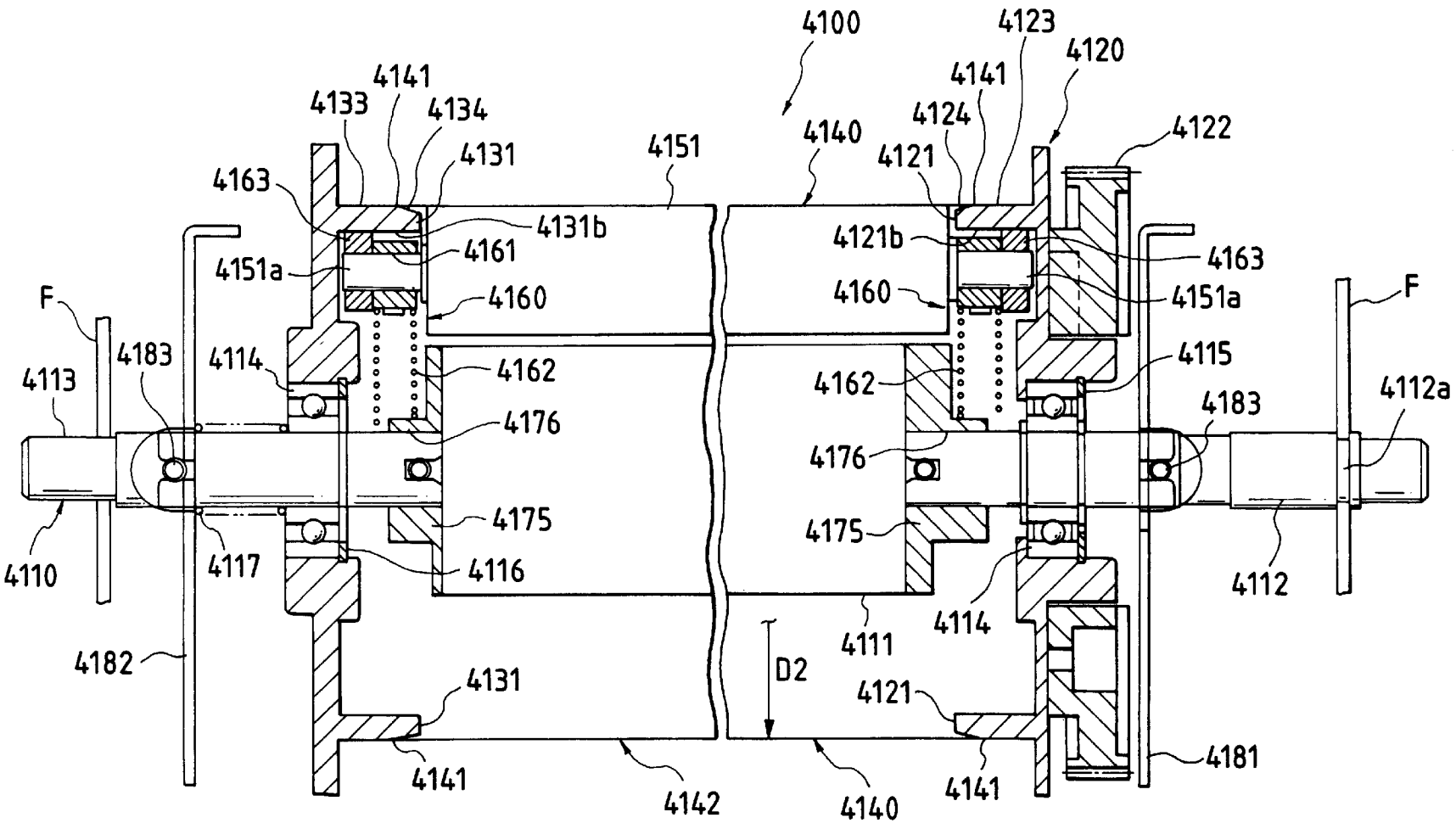
FIG. 34 is a frontal sectional view to mainly show an eleventh embodiment of an image support apparatus according to the present invention.

As shown in FIGS. 34 and 36, the support member 4131 (4121) has a cylindrical face 4133 (4123) having an outer diameter D3 (see FIG. 36) larger than an inner diameter D2 (see FIG. 36) of the image support before being supported on the support member 4131 (4121) and a truncated cone face 4134 (4124) adjoining the cylindrical face 4133 (4123). The truncated cone face 4134 (4124) has a tip diameter D1 (see FIG. 36) made smaller than the inner diameter D2 of the image support before supported on the support member 4131 (4121).

Therefore, as shown in FIG. 36, if the support member 4131 (4121) is inserted into the end 4141 of the image supporter 4140 from the tip side of the truncated cone face 4134 (4124), the end 4141 of the image supporter 4140 first comes in contact with the truncated cone face 4134 (4124) of the support member 4131 (4121) as indicated by the phantom line in FIG. 36. Then, if inserting of the support member 4131 (4121) is continued, the end 4141 of the image supporter 4140 is pressed and widened equally throughout in the circumferential direction along the truncated cone face 4134 (4124) indicated by arrow S, arrives at the cylindrical face 4133 (4123) of the support member 4131 (4121), and is supported on the cylindrical face 4133 (4123) with the end 4141 coming in intimate contact with the cylindrical face 4133 (4123) of the support member 4131 (4121) because of the elasticity of the image supporter 4140 itself as indicated by the solid line in FIG. 36.

That is, according to the fixation structure, if there is tolerance between the support member 4131 (4121) and the image supporter 4140, the cylindrical face 4133 (4123) of the support member 4131 (4121) has the outer diameter D3 larger than the inner diameter D2 of the image supporter 4140 before supported on the support member 4131 (4121) (before the support member is inserted) and the tip diameter D1 of the truncated cone face 4134 (4124) of the support member 4131 (4121) is made smaller than the inner diameter D2 of the image supporter 4140 before supported on the support member 4131 (4121), thus the support member 4131 (4121) is inserted into the end 4141 of the image supporter 4140 from the tip side of the truncated cone face 4134 (4124), whereby the end 4141 of the image supporter 4140 can be supported on the cylindrical face 4133 (4123) smoothly and reliably with the end 4141 coming in intimate contact with the cylindrical face 4133 (4123) of the support member 4131 (4121).

The end 4141 of the image support is positioned radially on the cylindrical face 4133 (4123) of the support member 4131 (4121).

The end 4141 of the image supporter 4140 is fixed on the cylindrical face 4133 by the shrinkage force produced by the elasticity of the image support itself. To ensure that the end 4141 is fixed, bonding tape 4135 may be wound, as shown in FIG. 36. The outer diameter D3 of the cylindrical face 4133 (4123) relative to the inner diameter D2 of the image supporter 4140 is set within an elastic deformation area in the radial direction of the image supporter 4140 (or within breakage limits).

According to the configuration, the following functions and effects (k), (l) and (m) can be provided in addition to the functions and effects in (a)–(e) described above:

(k) The disk-like members 4120 and 4130 are formed with the support members 4121 and 4131 for supporting the image supporter 4140 at the ends 4141 thereof from the inside in the circumferential direction. The support member 4121, 4131 has the cylindrical face 4123, 4133 having the outer diameter D3 larger than the inner diameter D2 of the image support before it is supported on the support member 4121, 4131 and the truncated cone face 4124, 4134 adjoining the cylindrical face 4123, 4133. The truncated cone face 4124, 4134 has the tip diameter D1 made smaller than the inner diameter D2 of the image support before supported on the support member 4121, 4131. Thus, if the support member 4121, 4131 is inserted into the end 4141 of the image supporter 4140 from the tip side of the truncated cone face 4124, 4134, the end 4141 of the image support first comes in contact with the truncated cone face 4124, 4134 of the support member 4121, 4131. Then, if inserting of the support member 4121, 4131 is continued, the end 4141 of the image support is pressed and widened equally throughout in the circumferential direction along the truncated cone face 4124, 4134, arrives at the cylindrical face 4123, 4133 of the support member 4121, 4131, and is supported on the cylindrical face 4123, 4133 with the end 4141 coming in intimate contact with the cylindrical face 4123, 4133 of the support member 4121, 4131 because of the elasticity of the image supporter 4140 itself.

That is, if there is tolerance between the support member 4121, 4131 and the image supporter 4140, the cylindrical face 4123, 4133 of the support member 4121, 4131 has the outer diameter D3 larger than the inner diameter D2 of the image supporter 4140 before being supported on the support member 4121, 4131 and the tip diameter D1 of the truncated cone face 4124, 4134 of the support member 4121, 4131 is made smaller than the inner diameter D2 of the image supporter 4140 before being supported on the support member 4121, 4131, thus the support member 4121, 4131 is inserted into the end 4141 of the image supporter 4140 from the tip side of the truncated cone face 4124, 4134, whereby the end 4141 of the image supporter 4140 can be supported on the cylindrical face 4123, 4133 smoothly and reliably with the end 4141 coming in intimate contact with the cylindrical face 4123, 4133 of the support member 4121, 4131.

The cylindrical faces 4123 and 4133 can be worked with high accuracy as compared with the truncated cone face 4124 and 4134 and high roundness can be provided. As a result, the roundness of the image supporter 4140 supported on the cylindrical faces 4123 and 4133 in the intimate contact state can also be improved.

(l) The image support apparatus 4100 can be manufactured by inserting the support members 4121 and 4131 into the ends 4141 of the image supporter 4140. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image support member described in Unexamined Japanese Patent Publication No. Sho 58-86550 (see FIG. 51) are also eliminated, so that the image support apparatus 4100 can be manufactured easily.

Thus, the image support apparatus 4100 of the embodiment can produce the effects of improving the roundness, providing a reliable and stable contact state with the abutment members such as the hard roller, and easy manufacturing.

Further, since (m) The support members 4121 and 4131 are adapted to support the ends 4141 of the image supporter 4140 from the inside in the circumferential direction, the effective use of the space inside the support members 4121 and 4131 in the circumferential direction can also be made.

In this embodiment, the positioning rollers 4163 and 4163 for the backup rollers 4151, etc., are placed in the space and are abutted against the inner peripheral surfaces 4121*b* and 4131*b* of the support members 4121 and 4131, thereby positioning the backup rollers 4151, etc., radially.

Twelfth Embodiment

Figure 38:
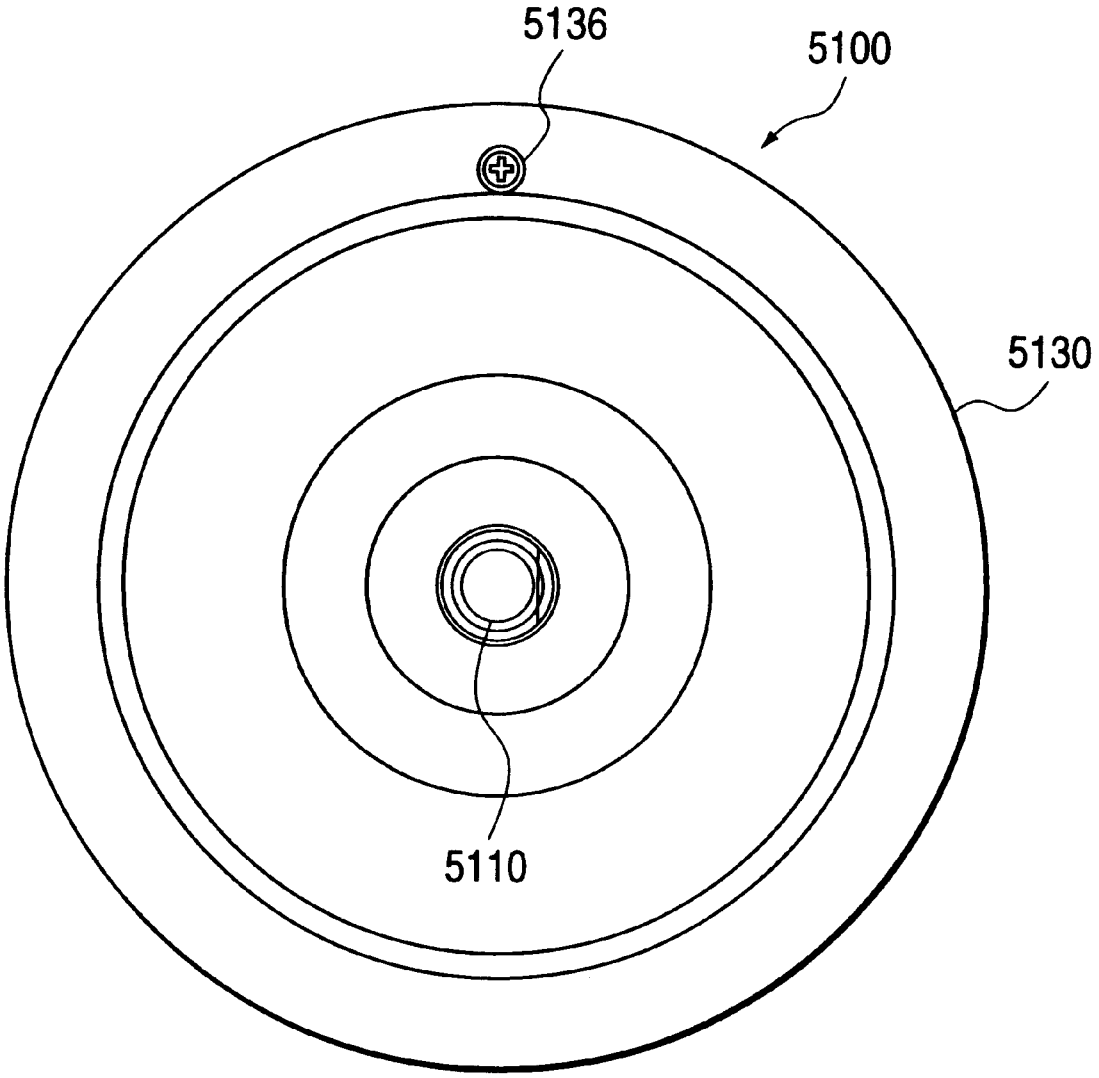
FIG. 38 is a left side view of the image support apparatus of the twelfth embodiment.
Figure 39A:
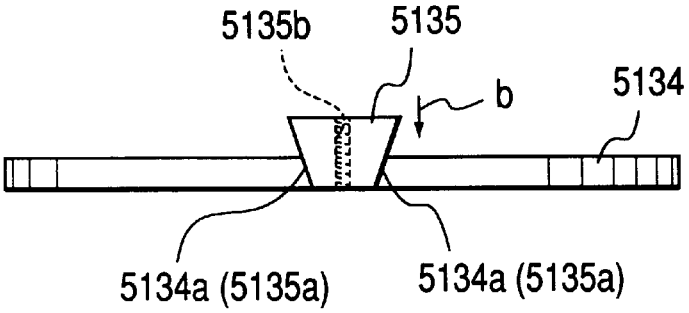
FIGS. 39(*a*) and 39(*b*) show an image supporter end fixation structure of the twelfth embodiment.
Figure 39B:
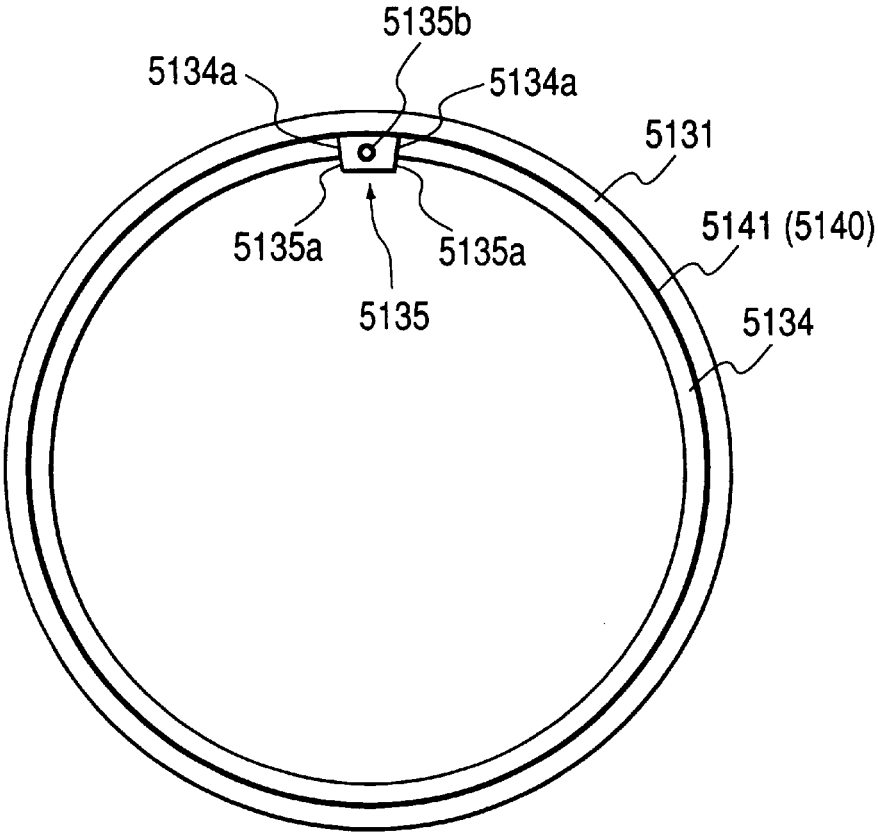

FIG. 37 is a frontal sectional view to mainly show a twelfth embodiment of an image support apparatus according to the present invention. FIG. 38 is a left side view. FIGS. 39(*a*) and 39(*b*) show an outline of image support end fixation means; FIG. 39(*b*) is a partial view taken on line 39(*b*)—39(*b*) in FIG. 37 and FIG. 39(*a*) is a plan view of FIG. 39(*b*).

The image supporter 5140 is fixed at both ends 5141 by adopting the following structure in the embodiment:

Since the fixation structure is symmetrical, the structure on the left disk-like member 5130 side will be discussed and the reference numerals of the right members corresponding to the left members are enclosed in parentheses.

As shown in FIGS. 37 and 39, the fixation structure comprises the above-mentioned support member 5131 (5121), an elastic ring 5134 (see FIG. 39) placed inward in the circumferential direction via the end 5141 of the image supporter 5140 on the support member 5131 (5121), and press and widening mechanisms 5137 (see FIG. 37) for pressing and widening the elastic ring 5134.

As shown in FIG. 39, the elastic ring 5134 is opened at both ends 5134*a* and 5134*a*, namely, is shaped like a C and both of the ends are tapered as shown in FIG. 39 (*a*). The elastic ring 5134 is made of a metal, for example.

The press and widening mechanisms 5137 comprise a wedge-like slider 5135 being inserted between both ends 5134*a* and 5134*a* of the elastic ring 5134 for pressing and widening the gap between the open ends, as indicated by arrow b in FIGS. 37 and 39 (*a*), and a screw 5136 (see FIG. 37) for sliding the slider 4135.

As shown in FIG. 39, the slider 5135 is formed with taper faces 4135*a* and 4135*a* abutting slidably both ends 4134*a* and 4134*a* of the elastic ring 5134 and a female screw 4135*b* threadably engaging the screw 4136.

The screw 5136 is attached to the disk-like member 5130 (4120) rotatably (not threadably engaged with the disk-like member).

Therefore, in the structure, if the screw 5136 is turned for moving the slider 5135 in an opposite direction to the arrow b, the elastic ring 5134 is contracted due to its elasticity. In this state, the end 5141 of the image supporter 5140 can be placed between the elastic ring 5134 and the supporter 5131 (5121).

If the screw 5136 is turned in the opposite direction for moving the slider 5135 in the arrow b direction, the taper faces 5135*a* and 5135*a* of the slider 5135 abut both ends 5134*a* and 5134*a* of the elastic ring 5134, thereby widening the elastic ring 5134 outward. Thus, the end 5141 of the image supporter 5140 is sandwiched and fixed between the support member 5131 (5121) and the elastic ring 5134.

That is, according to the structure, if the gap between the open ends 5134*a* and 5134*a* of the elastic ring 5134 is pressed and widened by the press and widening mechanisms 5137, the elastic ring 5134 widens to the support member 5131 (5121) almost equally in the circumferential direction, causing the end 5141 of the image supporter 5140 to be sandwiched and fixed between the support member 5131 (5121) and the elastic ring 5134.

The end 5141 of the image support is radially positioned on an inner peripheral surface 5131*b* (5121*b*) of the support member 5131 (5121).

According to the configuration, the following functions and effects (n), (o), (p), (q) and (r) can be provided in addition to the functions and effects in (a)–(d) described above:

(n) The disk-like members 5120 and 5130 are formed with the support members 5121 and 5131 concentric with the image support for supporting the image supporter 5140 at the ends 5141 thereof and the elastic rings 5134 each shaped like C opened at both ends 5134*a* and 5134*a* are placed via the ends 5141 of the image supporter 5140 on the support members 5121 and 5131. The press and widening mechanisms 5137 for pressing and widening the gap between the open ends 5134*a* and 5134*a* of the elastic ring 5134 is provided. Thus, if the gap between the open ends 5134*a* and 5134*a* of the elastic ring 5134 is pressed and widened by the press and widening mechanisms 5137, the elastic ring 5134 widens to the support member almost equally in the circumferential direction, causing the end 5141 of the image supporter 5140 to be sandwiched and fixed between the support member 5121, 5131 and the elastic ring 5134.

Therefore, the ends 5141 of the image supporter 5140 fixed become parallel to the support members 5121 and 4131, which are concentric with the image support and can be prepared with high (exact) roundness. As a result, the roundness of the image supporter 5140 supported and fixed at both ends 5141 by the support members 5121 and 5131 of the disk-like members can also be improved.

(o) Moreover, the support members 5121 and 5131 are adapted to support the ends 5141 of the image supporter 5140 from the outside in the circumferential direction and the elastic rings 5134 are placed inside in the circumferential direction via the ends 5141 of the image support on the support members 5121 and 5131. Thus, the elastic ring 5134 is widened, whereby the end 5141 of the image support is pressed and widened outward in the circumferential direction and is sandwiched between the elastic ring 5134 and the support member 5121, 5131.

Therefore, asperities viewed from the axial direction do not occur at the ends 5141 of the image supporter 5140, resulting in more improvement in the roundness of the image supporter 5140.

(p) The image support apparatus 5100 can be manufactured by placing the members as described above and widening the elastic rings 5134 by the press and widening mechanisms 5137 for fixing the ends 5141 of the image supporter 5140. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image support member described in Unexamined Japanese Patent Publication No. Sho 58-86550 (see FIG. 51) are also eliminated, so that the image support apparatus 5100 can be manufactured easily.

Thus, the image support apparatus 5100 can produce the effects of improving the roundness, providing a reliable and stable contact state with the abutment members such as the hard roller, and easy manufacturing.

Further, (q) Widening of the elastic rings 5134 by the press and widening mechanisms 5137 is released, whereby the ends 5141 of the image supporter 5140 can be unfixed and the image supporter 5140, a consumable article, and the disk-like members 5120 and 5130, etc., that can be used for a long term can be disassembled, so that the effect of recycling the parts other than the image supporter 5140 can also be produced.

(r) Since the elastic rings 5134 can be made of material other than rubber, such as metal, there is no fear of contaminating the surface of the image supporter 5140 because of an exuding plasticizing agent, etc.

Thirteenth Embodiment

Figure 40:
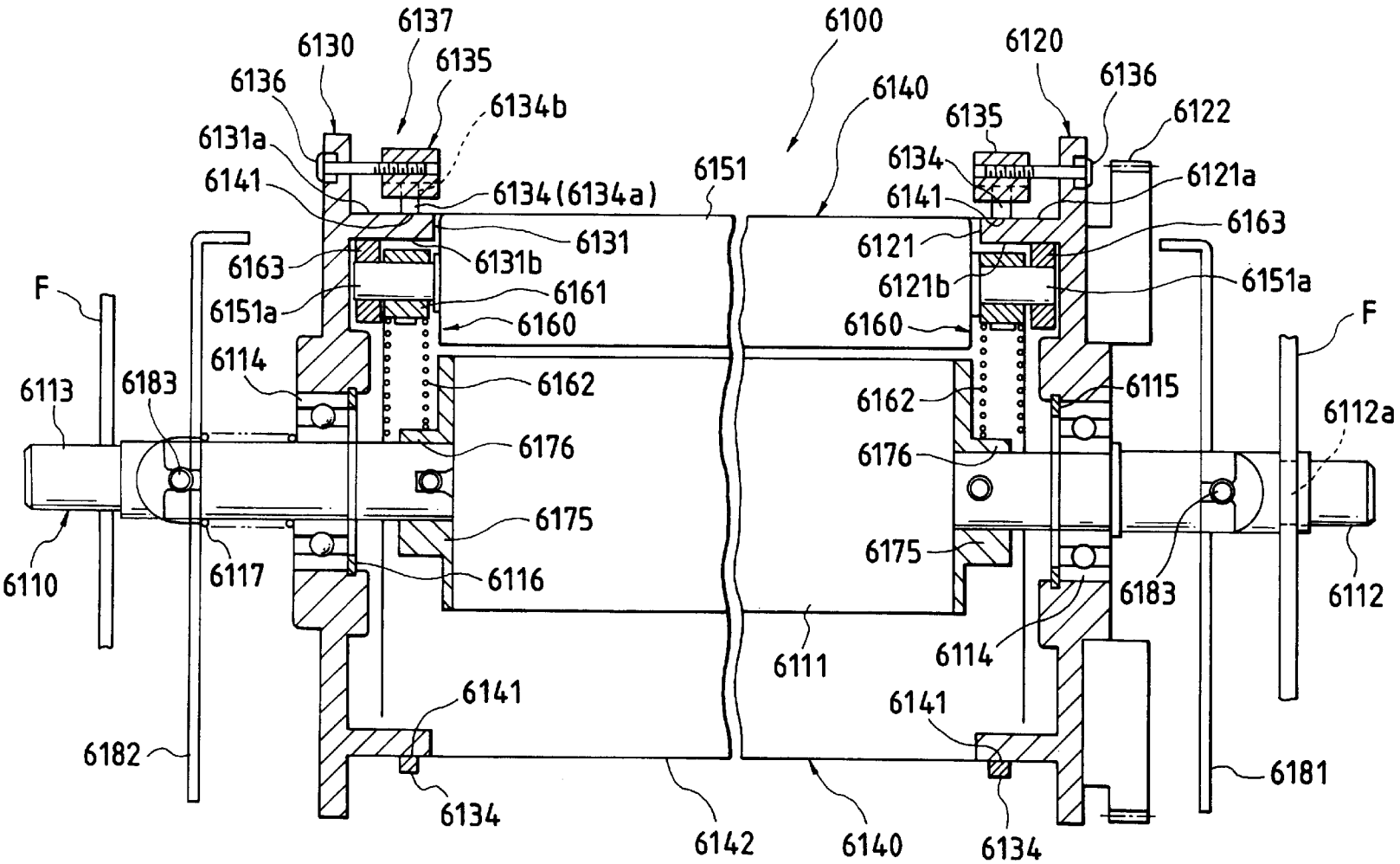
FIG. 40 is a frontal sectional view to mainly show an thirteenth embodiment of an image support apparatus according to the present invention.
Figure 41:
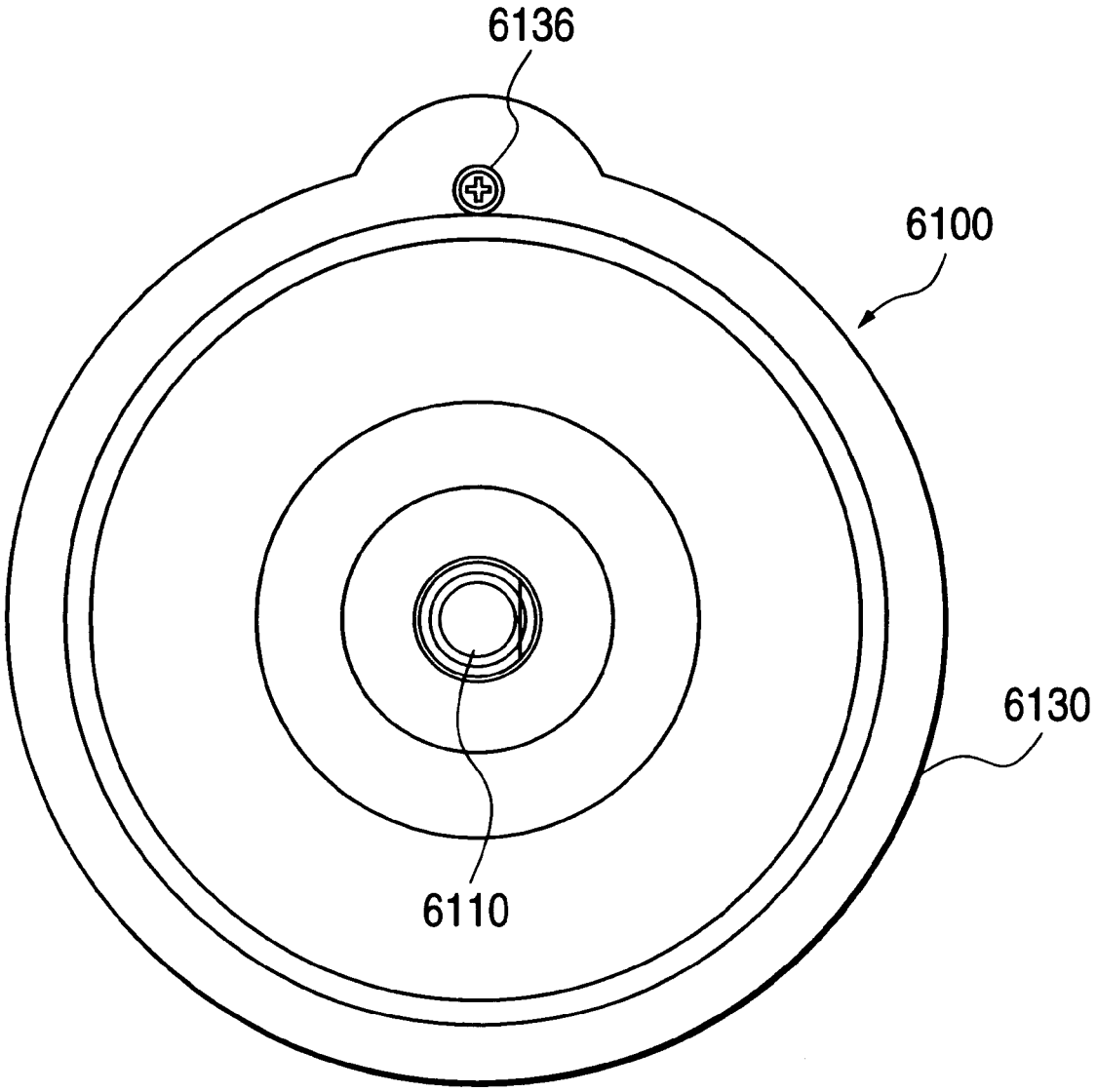
FIG. 41 is a left side view of the image support apparatus of the thirteenth embodiment.
Figure 42A:
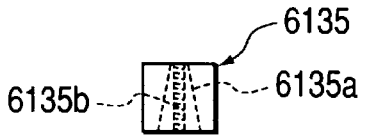
FIGS. 42(*a*)–42(*d*) show an image supporter end fixation structure of the thirteenth embodiment.
Figure 42B:
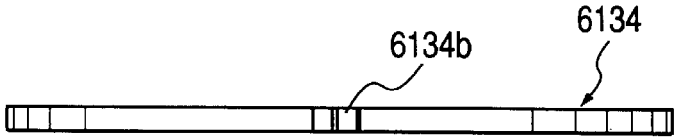
Figure 42C:
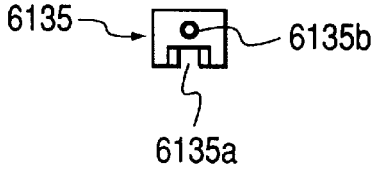
Figure 42D:
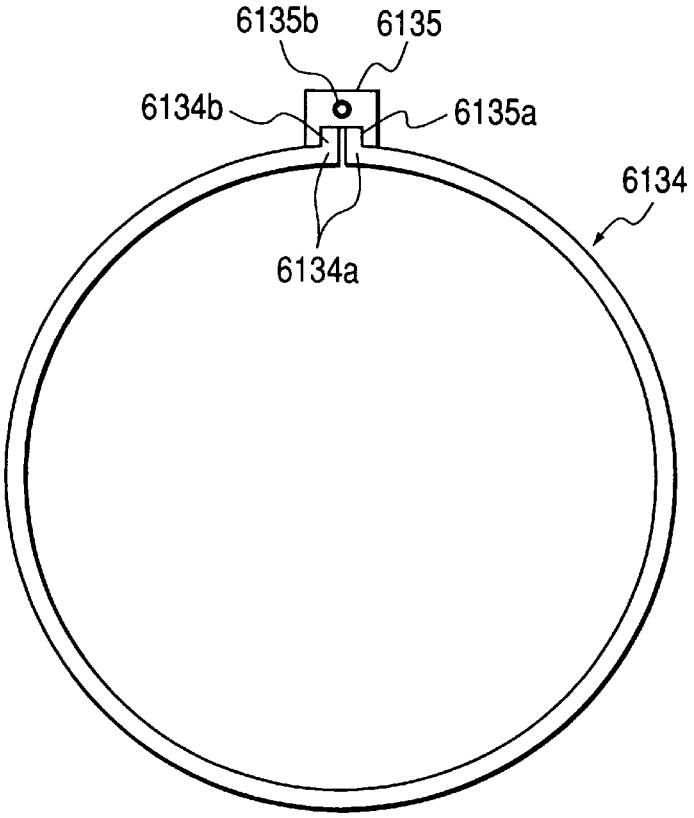

FIG. 40 is a frontal sectional view to mainly show a thirteenth embodiment of an image support apparatus according to the present invention. FIG. 41 is a left side view. FIGS. 42(*a*)–42(*d*) are sectional views showing a state in which the image support apparatus is built in an image formation system.

In the embodiment, the disk-like members 6120 and 6130 are formed on inner faces with cylindrical support members 6121 and 6131 concentric with the image supporter 6140 for supporting the image supporter 6140 at both ends 6141 thereof from the inside in the circumferential direction.

The image supporter 6140 is fixed at both ends 6141 by adopting the following structure:

Since the fixation structure is symmetrical, the structure on the left disk-like member 6130 side will be discussed and the reference numerals of the right members corresponding to the left members are enclosed in parentheses.

As shown in FIGS. 40 and 42, the fixation structure comprises the above-mentioned support member 6131 (6121), an elastic ring 6134 (see FIG. 42) placed outward in the circumferential direction via the end 6141 of the image supporter 6140 on the support member 6131 (6121), and tightening mechanisms 6137 (see FIG. 40) for tightening the elastic ring 6134.

As shown in FIGS. 42 (*b*) and (*d*), the elastic ring 6134 is opened at both ends 6134*a* and 6134*a*, namely, is shaped like C and projections 6134*b* and 6134*b* are formed at both the ends. The elastic ring 6134 is made of a metal, for example.

The tightening mechanisms 6137 comprises a slider 6135 slidably engaging the projection 6134*b*, 6134*b* of the elastic ring 6134 and a screw 6136 (see FIG. 40) for sliding the slider 6135.

As shown in FIG. 42, the slider 6135 is formed with taper groove 6135*a* slidably engaging the projection 6134*b*, 6134*b* of the elastic ring 6134 and a female screw 6135*b* threadably engaging the screw 6136.

The screw 6136 is attached to the disk-like member 6130 (6120) rotatably (not threadably engage the disk-like member).

Therefore, in the structure, if the screw 6136 is turned for moving the slider 6135 in the direction away from the disk-like member 6130 (6120), the elastic ring 6134 is widened due to its elasticity. In this state, the end 6141 of the image supporter 6140 can be placed between the elastic ring 6134 and the support 6131 (6121).

If the screw 6136 is turned in the opposite direction for moving the slider 6135 to the disk-like member 6130 (6120) side, the taper grooves 6135*a* of the slider 6135 engage the projections 6134*b* and 6134*b* of the elastic ring 6134, thereby contracting the elastic ring 6134 in the direction narrowing the gap between the open ends 6134*a* of the elastic ring 6134, whereby the end 6141 of the image supporter 6140 can be tightened onto the support member 6131 (6121).

That is, according to the structure, if the elastic ring 6134 is tightened in the direction narrowing the gap between the open ends 6134*a* and 6134*a* of the elastic ring 6134 by the tightening mechanisms 6137, it contracts toward the support member 6131 (6121) almost equally in the circumferential direction, causing the end 6141 of the image supporter 6140 to be sandwiched and fixed between the support member 6131 (6121) and the elastic ring 6134.

The end 6141 of the image support is radially positioned on an outer peripheral surface 6131*a* (6121*a*) of the support member 6131 (6121).

According to the configuration, the following functions and effects (s), (t), and (u) can be provided in addition to the functions and effects in (a)–(e), (m) and (r) described above:

(s) The disk-like members 6120 and 6130 are formed with the support members 6121 and 6131 concentric with the image support for supporting the image supporter 6140 at the ends 6141 thereof and the elastic rings 6134 each shaped like C opened at both ends 6134*a* and 6134*a* are placed via the ends 6141 of the image supporter 6140 on the support members 6121 and 6131. The tightening mechanisms 6137 for tightening the elastic ring 6134 in the direction narrowing the gap between the open ends 6134*a* and 6134*a* of the elastic ring 6134 is provided. Thus, if the elastic ring 6134 is tightened in the direction narrowing the gap between the open ends 6134*a* and 6134*a* of the elastic ring 6134 by the tightening mechanisms 6137, the elastic ring 6134 contracts to the support member almost equally in the circumferential direction, causing the end 6141 of the image supporter 6140 to be sandwiched and fixed between the support member 6121, 6131 and the elastic ring 6134.

Therefore, the ends 6141 of the image supporter 6140 fixed become parallel to the support members 6121 and 6131, which are concentric with the image support and can be prepared with high roundness. As a result, the roundness of the image supporter 6140 supported and fixed at both ends 6141 by the support members 6121 and 6131 of the disk-like members can also be improved.

(t) The image support apparatus 6100 can be manufactured by placing the members as described above and tightening the elastic rings 6134 by the tightening mechanisms 6137 for fixing the ends 6141 of the image supporter 6140. The need for filling the space between the rotation shaft and the outer layer with the elastic material layer as with the photosensitive drum 1 described in Japanese Patent Publication No. Hei 4-69383 (see FIGS. 48–50) and the need for making the fit tolerance excessively small as with the drum-like image support member described in Unexamined Japanese Patent Publication No. Sho 58-86550 (see FIG. 51) are also eliminated, so that the image support apparatus 6100 can be manufactured easily.

Thus, the image support apparatus 6100 can produce the effects of improving the roundness, providing a reliable and stable contact state with the abutment members such as the hard roller, and easy manufacturing.

Further, (u) Tightening of the elastic rings 6134 by the tightening mechanisms 6137 is released, whereby the ends 6141 of the image supporter 6140 can be unfixed and the image supporter 6140, a consumable article, and the disk-like members 6120 and 6130, etc., that can be used for a long term can be disassembled, so that the effect of recycling the parts other than the image supporter 6140 can also be produced.

Fourteenth Embodiment

Figure 43:
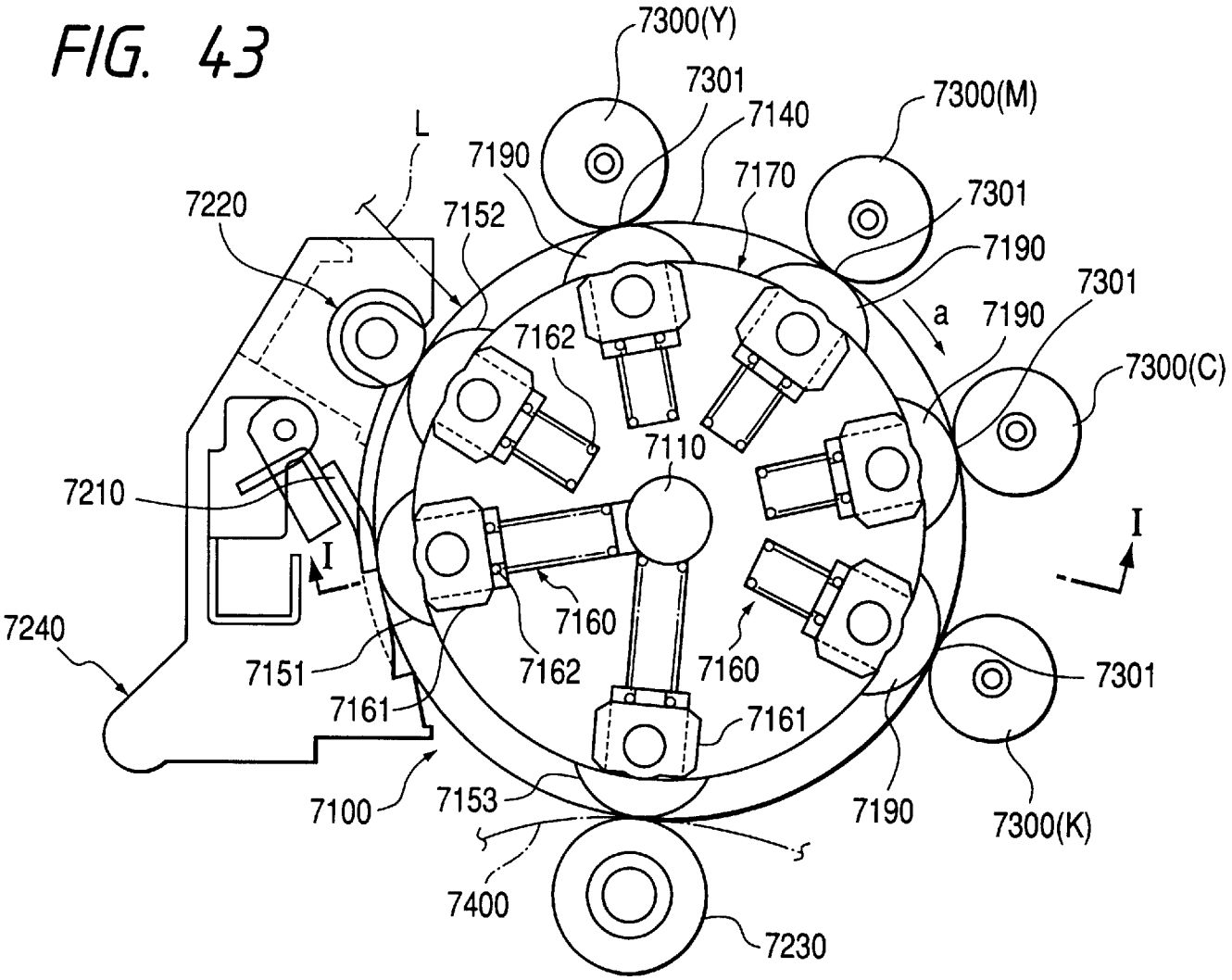
FIG. 43 is a fragmentary sectional view to show a state in which the image support apparatus of a fourteenth embodiment is built in an image formation system.

FIG. 43 is a fragmentary sectional view to show a state in which a fourteenth embodiment of an image support apparatus according to the present invention is built in an image formation system.

As shown in FIG. 43, the fourteenth embodiment differs from the ninth embodiment in that backup rollers 7190 as backup mechanisms are attached to the shaft 7110 inside the image supporter 7140 for supporting the image supporter 7140 from the inside thereof near abutment positions 7301 where developing rollers 7300 are abutted against the image supporter 7140 from the outside thereof.

The backup rollers 7190 as backup mechanisms are provided for supporting the image supporter 7140 from the inside thereof near the abutment positions 7301 where the developing rollers 7300 are abutted against the image supporter 7140 for suppressing vibration of the image supporter 7140, as described above. As described later, if the developing rollers 7300 are hard rollers, it is necessary for the backup rollers 7190 not to block inward deformation of the image supporter 7140 near the abutment positions 7301, thus the backup rollers 7190 are formed of easily deformed elastic substance, such as expanded elastic substance (for example, sponge).

Every backup roller has a metal shaft

Figures 44A, 44B:
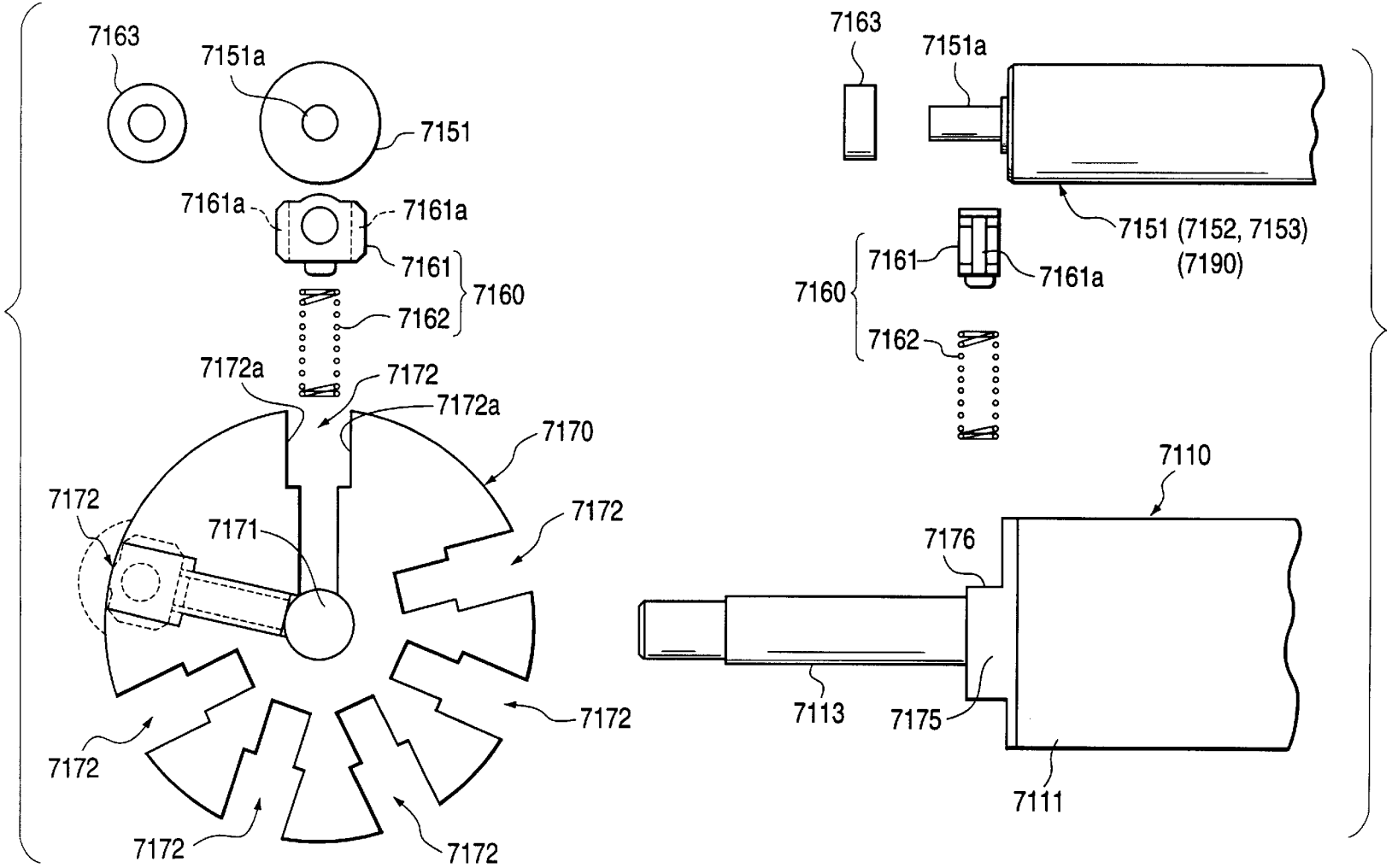
FIGS. 44(*a*) and 44(*b*) relate to a backup roller attachment structure of the fourteenth embodiment.

The backup rollers 7151, 7152, 7153, and 7190 are attached to the shaft 7110 via a pair of attachment plates 7170 and 7170 and the urging means 7160, as shown in FIGS. 43 and 44(*a*) and 44(*b*)). The attachment structure is similar to the above embodiments.

The backup rollers 7151, 7152, 7153, and 7190 are placed in the image supporter 7140 so as to contract the compressed springs 7162 for supporting the image supporter 7140 from the inside thereof with the urging force of the compressed springs 7162 received on the inner peripheral surfaces 2121*b* and 2131*b* of the support members 2121 and 2131 as the positioning parts (see FIG. 25).

According to the configuration, the following functions and effects (v), (w), and (x) can be provided in addition to the functions and effects in (a)–(e) described above:

(v) Since the backup mechanisms 7190 made of elastic substance support the image supporter 7140 from the inside thereof near the abutment positions 7301 where the developing rollers 7300 are abutted against the image supporter 7140 from the outside thereof, vibration of the image supporter 7140 is suppressed and a stable contact state with the developing rollers 7300 can be provided, resulting in suppression of jitter and inconsistencies in density.

The backup mechanisms 7190, which are made of an elastic substance, do not block inward deformation of the center portion of the image supporter 7140.

Thus, the image support apparatus 7100 of the embodiment can provide a reliable and stable abutment state against the hard developing rollers 7300 and can be driven reliably.

Further, (w) The urging means 7160 for urging the backup rollers 7190 in the support direction thereof and the positioning parts 2121*b* and 2131*b* (see FIG. 25) being disposed in the disk-like members 2120 and 2130 (see FIG. 25) for positioning the backup mechanisms 7190 in the support direction are provided, so that positional accuracy between the image supporter 7140 and the backup mechanisms 7190 is enhanced.

That is, the disk-like members 2120 and 2130 are provided with the positioning parts 2121*b* and 2131*b* for positioning the backup mechanisms 7190 in the support direction and the urging force of the urging means 7160 is received at the positioning parts 2121*b* and 2131*b*, so that an unnecessary force can be prevented from acting on the image supporter 7140.

Therefore, the image support apparatus 7100 can decrease the drive torque of the image supporter 7140 while suppressing vibration of the image supporter 7140 and the need for producing excessive fixation strength of the image supporter 7140 to the support members 2121 and 2131 is eliminated. Cost reduction is also enabled.

(x) Since the backup mechanisms 7190 are made of rotatable rollers, a smooth rotation state of the image supporter 7140 can be provided and the load on the image supporter 7140 can be lessened.

Therefore, the image support unit 7100 decreases the drive torque of the image supporter 7140 while suppressing vibration of the image supporter 7140.

Fifteenth Embodiment

Figure 45:
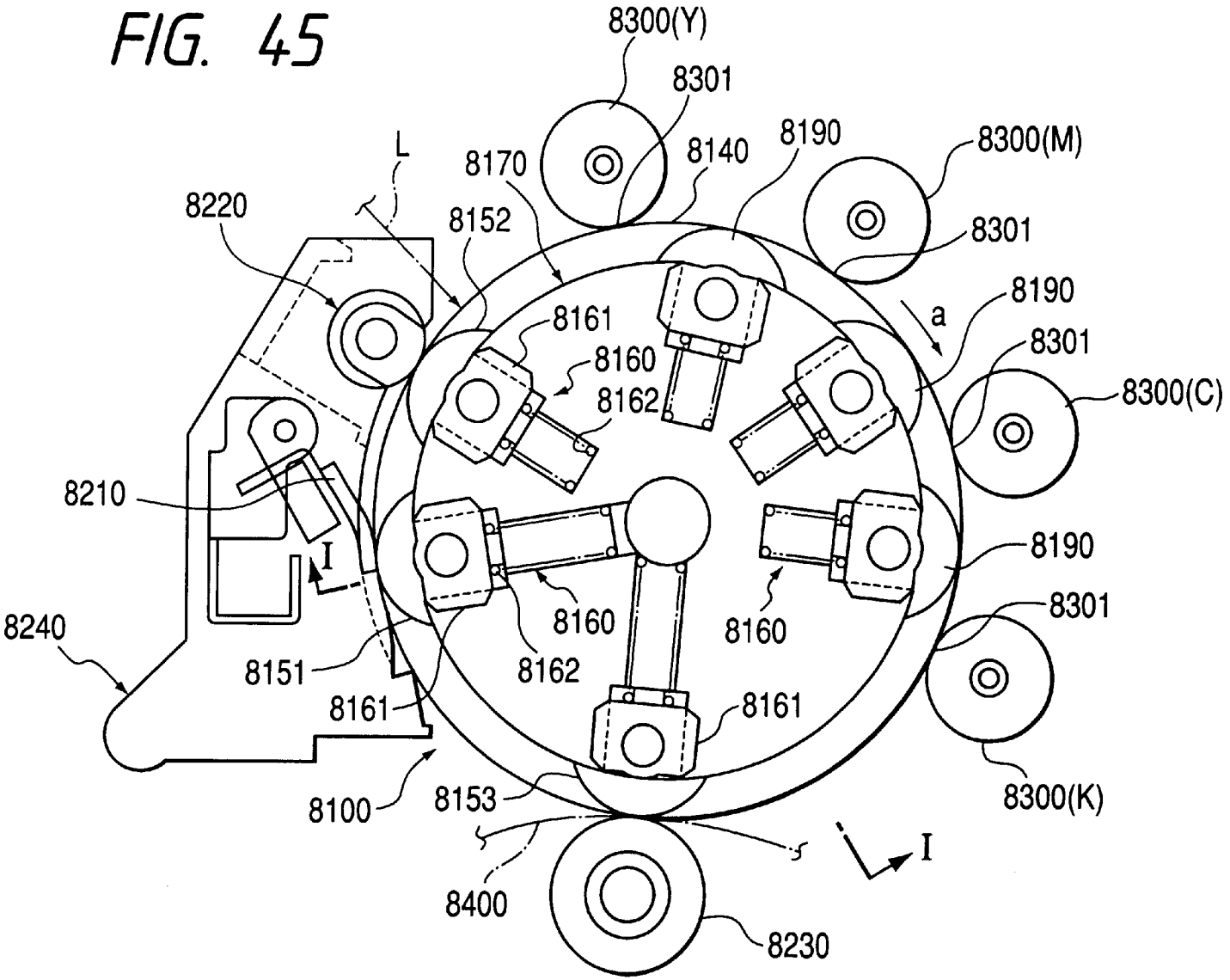
FIG. 45 is a fragmentary sectional view to show a state in which the image support apparatus of a fifteenth embodiment is built in an image formation system.

FIG. 45 is a fragmentary sectional view to show a state in which a fifteenth embodiment of an image support apparatus according to the present invention is built in an image formation system.

As shown in FIG. 45, the fifteenth embodiment differs from the fourteenth embodiment in that backup rollers 8190 are placed each between abutment positions of development rollers 8300.

Figures 46A, 46B:
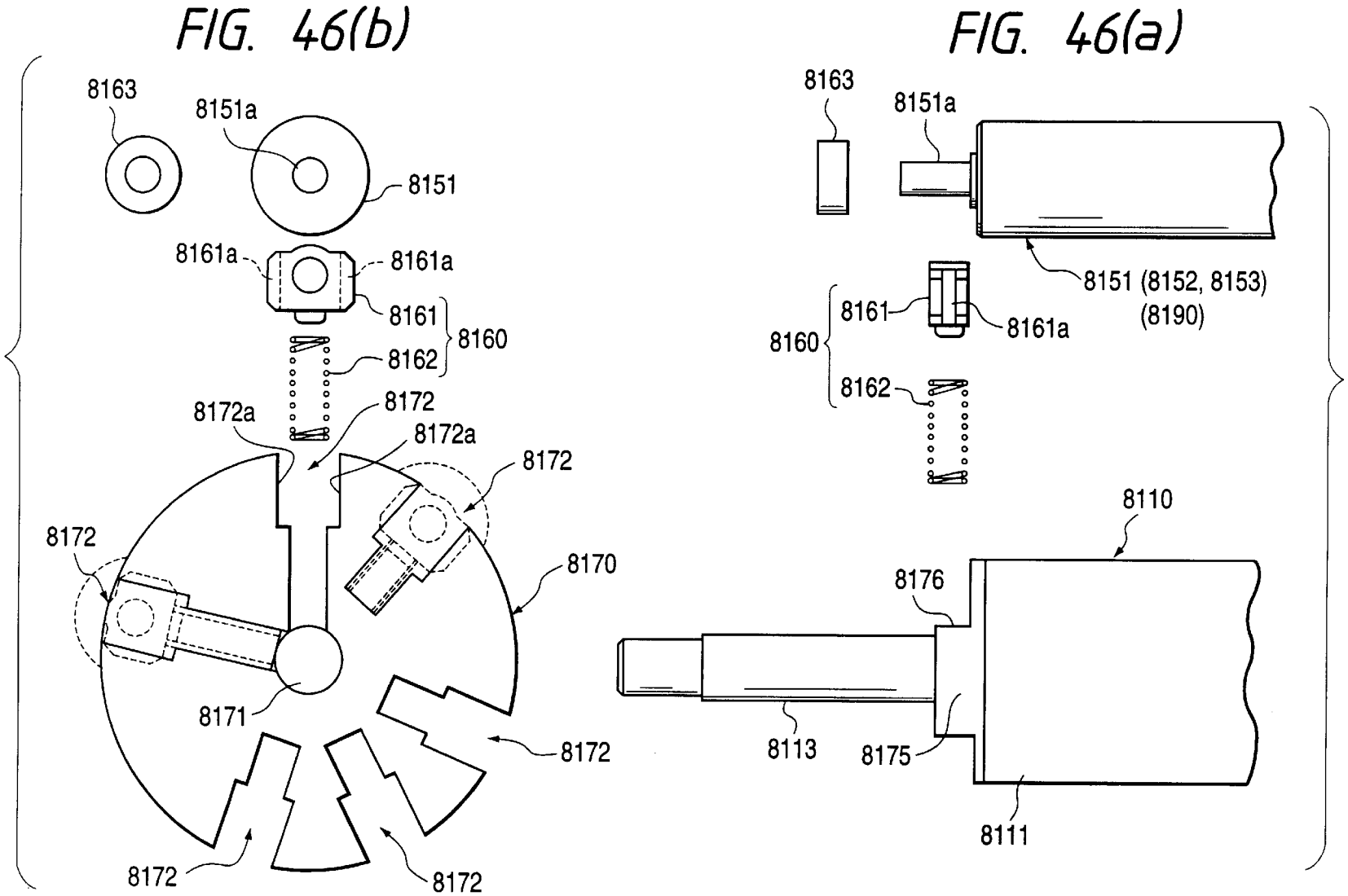
FIGS. 46(*a*) and 46(*b*) relate to a backup roller attachment structure of the fifteenth embodiment.

The backup rollers 8151, 8152, 8153, and 8190 are attached to the shaft 8110 via a pair of attachment plates 8170 and 8170 and the urging means 8160, as shown in FIGS. 45 and 46(*a*) and 46(*b*). The attachment structure is similar to the above embodiments.

The backup rollers 8151, 8152, 8153, and 8190 are placed in the image supporter 8140 so as to contract the compressed springs 8162 for supporting the image supporter 8140 from the inside thereof with the urging force of the compressed springs 8162 received on the inner peripheral surfaces 2121*b* and 2131*b* of the support members 2121 and 2131 as the positioning parts (see FIG. 25).

According to this configuration, the following functions and effects (v) and (z) can be provided in addition to the functions and effects in (a)–(e), (w) and (x) described above:

(y) Since the backup mechanisms 8190 made of elastic substance support the image supporter 8140 from the inside thereof near the abutment positions 8301 where the developing rollers 8300 are abutted against the image supporter 8140 from the outside thereof, vibration of the image supporter 8140 is suppressed and a stable contact state with the developing rollers 8300 can be provided, resulting in suppression of jitter and inconsistencies in density.

For the backup mechanisms 8190 made of elastic substance to support the image supporter 8140 from the inside thereof, it is also possible that the backup mechanisms 8190 are placed at the abutment positions 8301 of the developing rollers 8300. In doing so, if the backup mechanisms 8190 are not placed correctly in parallel with the axis of the image supporter 8140 or are uneven in softness (hardness), it is feared that the contact force between the developing rollers 8300 and the image supporter 8140 may become uneven, causing image unevenness.

In contrast, according to the image support apparatus 8100 of this embodiment, the backup mechanisms 8190 made of elastic substance are each placed between the abutment positions 8301 of the image supporter 8140 and the developing rollers 8300, rather than at the abutment positions 8301. Thus, if the backup mechanisms 8190 are not placed correctly in parallel with the axis of the image supporter 8140 or are uneven in softness (hardness), there is little influence on the abutment positions 8301 of the image supporter 8140 and the developing rollers 8300, and therefore the contact force between the developing rollers 8300 and the image supporter 8140 easily becomes even at the abutment positions 8301 of the image supporter 8140 and the developing rollers 8300.

Therefore, according to the image support apparatus 8100, image unevenness is less likely to occur.

Thus, the image support apparatus 8100 of the embodiment can provide a reliable and stable abutment state against the hard developing rollers 8300 and can be driven reliably.

Further, since (c) The backup mechanisms 8190 are each placed between the abutment positions 8301 of the developing rollers 8300, the number of the backup mechanisms 8190 can be decremented by one as compared with placement of the backup mechanisms 8190 at the abutment positions 8301 in a one-to-one correspondence with each other.

Specific examples of the above described embodiments are discussed below.

First and Second Embodiment

For the image formation system, (1) The image supporter 110 is 85.5 mm in diameter (outer diameter).

The image formation system can form an image on A3-size paper. Therefore, to consecutively form an image on sheets of paper supplied consecutively, the intermediate transfer belt 360 needs to have an outer peripheral length 171 mm or more in terms of diameter considering the interval between sheets of paper (distance between the rear end of the preceding sheet of paper and the front end of the subsequent sheet).

On the one hand, to lessen a relative position error of Y, M, C, and K toner images formed on the intermediate transfer belt 360 in the belt move direction and moderate tolerance of the parts, preferably the diameter ratio between the intermediate transfer belt 360 and the image supporter 110 is an integer ratio and the positions of images formed on the image supporter 110 relative to the photosensitive body 110 are the same in each color.

On the other hand, to enable four developing means 210 (Y, M, C, and K) to be placed surrounding the image supporter 110, preferably the image supporter 110 is 60 mm or more in diameter, but to miniaturize the system, preferably the diameter is made as small as possible.

Then, in these embodiments, the image supporter 110 is 85.5 mm in diameter (outer diameter).

However, the interval between consecutively supplied sheets of paper is lessened or enlarged, whereby the image supporter 110 can be placed in the range of 80–90 mm in diameter.

(2) The peripheral speed of the image supporter 110 is 180 mm/s, the distance between the exposure position (see FIG. 6) and the first developing means (in this case, the developing roller 211Y) is 36° in terms of the center angle of the image supporter 110, and the distance between the exposure position and the fourth developing means (in this case, the developing roller 211K) is 162.2°, as shown in FIG. 6.

Figure 14:
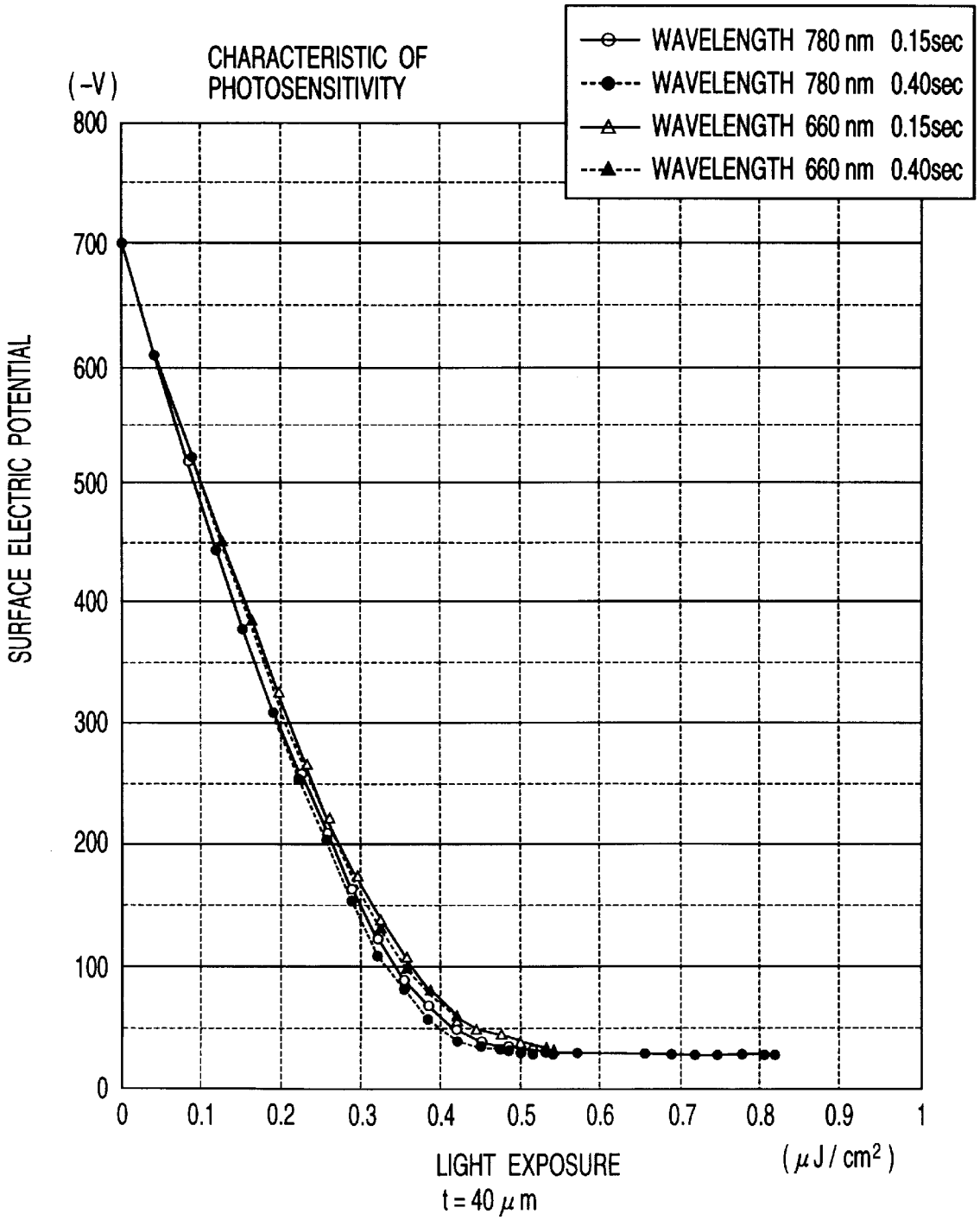
FIG. 14 is a graph to show a PIDC characteristic.

The PIDC characteristic of the image supporter 110 is as shown in FIG. 14. Preferably, the potential difference between the dark part potential (potential at a non-exposure position) at the first developing position of the image supporter 110 (in this case, the abutment position against the developing roller 211Y) and that at the fourth developing position (in this case, the abutment position against the developing roller 211K) is 50 V or less.

Preferably, the potential difference between the light part potential (potential at exposure position) at the first developing position of the image supporter 110 and that at the fourth developing position is also 50 V or less.

Then, in these embodiments, the peripheral speed of the image supporter 110 is 180 mm/s, the distance between the exposure position and the first developing means is 36° in terms of the center angle of the image supporter 110, and the distance between the exposure position and the fourth developing means is 162.2°. In this case, the time required for one point on the outer peripheral surface of the image supporter 110 to arrive at the first developing position from the exposure position is 0.15 seconds and the time required for the point to the fourth developing position is 0.7 seconds. The difference therebetween is 0.55 seconds.

However, the time difference can also be shortened (namely, the potential difference 50 V or less can also be accomplished) by setting the peripheral speed of the image supporter 110 to 180 mm/second or more or setting the distance between the exposure position and the fourth developing means to 162.2° or less.

(3) The charge roller 120 is 369 mm in length and the cleaner blade 132 is 367.4 mm in length.

If the cleaner blade 132 is longer than the charge roller 120, the ends of the cleaner blade 132 clean uncharged areas at both ends of the image supporter 110. Since the image supporter potential is unstable in such uncharged areas, a good cleaning characteristic cannot be provided.

Then, in these embodiments, the cleaner blade 132 is made shorter than the charge roller 120.

(4) The image support apparatus 100 is 3.4 kg in weight and 3.5–4 kg containing the exterior.

For image supporter 110, (1) The photosensitive layer has a film thickness ranging from 0.015–0.03 mm.

Since the photosensitive layer wears as it abuts the abutment members such as the cleaning member 130, if the film thickness of the photosensitive layer is too thin, the life of the photosensitive layer shortens. Therefore, preferably the photosensitive layer has a film thickness 0.015 mm or more.

Then, in these embodiments, the photosensitive layer has a film thickness ranging from 0.015–0.03 mm.

(2) The image supporter 110 has a coefficient of friction of 1.0 or less relative to the cleaner blade 132.

The reason why the coefficient of friction is 1.0 or less is that the drive torque of the image supporter 110 grows if the coefficient of friction exceeds 1.0.

(3) The image supporter 110 is 398±0.3 mm in length.

To prevent the image supporter 110, which is bent as the charge roller 120, etc., abuts the image supporter 110, from becoming permanently deformed, the distance L1 between the supported part of the image supporter 110 and the end of the charge roller 120 or the distance L2 between the supported part of the image supporter 110 and the end of the developing roller 211 needs to be set, as described above. Preferably, the distance is about 30 mm.

Then, in the embodiment, the image supporter 110 is 398±0.3 mm in length.

(4) The image supporter 110 base material of a nickel electric casting pipe, etc., is 0.03–0.1 mm thick.

If the base material is too thin, its rigidity (strength holding the shape by itself) weakens and a cylindricity failure or an abutment failure against the abutment members such as the developing roller occurs. Therefore, preferably the base material is 0.04 mm or more thick.

On the other hand, if the base material is too thick, it becomes difficult to provide good flexibility and the stress produced by abutment against the abutment members also grows. Since the casting time is prolonged, the manufacturing costs also increase. Therefore, preferably the base material is 0.05 mm or less thick.

Then, in these embodiments, the base material is 0.03–0.1 mm thick.

(5) The cylindricity of the image supporter 110 when it is built in the image support apparatus 100 is 0.05 or less.

The reason why the cylindricity is 0.05 or less is that the penetration depth of the developing roller 211 into the image supporter 110 (δ2-S1 in FIG. 3) is set to about 0.15 for producing a stable abutment state.

The cylindricity of the image supporter 110 can be set to 0.05 or less by setting the cylindricity of the base material to 0.02 or less and the cylindricity as the photosensitive layer is formed to 0.03 or less.

(6) The spacing S (see FIG. 3) between the inner peripheral surface 113 of the image supporter 110 (see FIG. 3) and the outer peripheral surface 145 of the cylindrical member 140 (or the cylindrical member 194 in FIG. 13) is 0.15–0.3 mm.

If the spacing S is too small, it is feared that sufficient deformation of the image supporter 110 because of flexibility will not be provided and that a stable abutment state against the developing roller, etc., will not be produced. Therefore, preferably the spacing S is 0.15 mm or more.

On the other hand, if the spacing S is too large, it is feared that the image supporter 110 may become overdeformed, causing an exposure position shift and that the stress produced by abutment against the abutment members may exceed an allowable stress. Therefore, preferably the spacing S is 0.3 mm or less.

Then, in these embodiments, the spacing S is 0.15–0.3 mm.

(7) The tolerance of the inner diameter of the image supporter 110 is ±0.03 mm or less.

This is because it is desired that the tolerance is small to enhance the accuracy of the spacing S.

(8) An electrode is installed as follows:

In the image supporter shown in FIG. 13, the inner peripheral surface of the image supporter 110 to the side plate 193 to the bearing 192 to the shaft 191 to the electrode is brought into conduction.

In the image supporter shown in FIG. 2 (3), the inner peripheral surface of the image supporter 110 to the conductive bonding agent 151 to the cylindrical member 140 to the side plate 142 to the shaft 142*a* end face to the electrode is brought into conduction.

For charge roller 120, (1) The charge roller 120 is formed with a surface layer.

The purpose of forming the charge roller 120 with a surface layer is to prevent the substance affecting the image supporter 110 from bleeding out.

The purpose is to control the resistance value of the charge roller 120.

The surface layer is of a 3-layer structure.

(2) The charge roller 120 is 14 mm in diameter.

To prevent a shaft 369 mm long from becoming deformed, a diameter of about 8 mm is required and rubber or resin of a charge roller usually used is about 3 mm thick.

Then, in these embodiments, the charge roller 120 is 14 mm in diameter.

(3) The charge roller 120 is made of a material of conductive rubber (NBR) comprising metal salt (lithium perchlorate) dispersed in urethane or nylon resin.

The purpose of adopting this material is to lessen the voltage, and the current dependency of the resistance value.

(4) The charge roller 120 has a resistance value ranging from $1\times10^5$ to $5\times10^6\Omega$.

If the resistance value is less than $1\times10^5\Omega$, a pin hole cannot be handled; if the resistance value is more than $5\times10^6\Omega$, the charge capability lowers.

(5) The charge roller 120 is driven by the image supporter 110.

The purpose of driving the charge roller 120 by the image supporter 110 is to suppress occurrence of charge unevenness caused by charges poured as the image supporter 110 and the charge roller 120 slide relatively.

The reason why the charge roller 120 is driven by the image supporter 110 is that the structure is simple and can be prepared at a low cost.

(6) The press force of the charge roller 120 against the image supporter 110 is 0.5–3.0 gf/mm.

If the press force is too large, the stress given to the image supporter 110 becomes too large; if the press force is too small, a stable abutment state against the image supporter 110 cannot be provided and the charge roller 120 cannot reliably be driven by the image supporter 110.

Then, in the embodiment, the press force is 0.5–3.0 gf/mm and more particularly 1.4 gf/mm.

(7) The charge roller 120 is chamfered at the ends like an R shape as described above; in addition, only both ends may be shaped like a camber.

(8) The charge roller 120 is provided with an attachment and detachment mechanism to and from the image supporter 110, and at the transport time, the charge roller 120 is detached from the image supporter 110.

The purpose is to prevent the image supporter 110 from becoming permanently deformed due to a creep characteristic.

(9) The electrode is installed by (i) pressing an electrode plate against the end face of the shaft 121;

(ii) putting the electrode on the peripheral surface of the shaft 121; or (iii) using a conductive member as the bearing member 122.

According to (i), the drive torque of the charge roller 120 can be decreased. According to (ii), the reliability is improved because of line contact.

For cleaner blade 132, (1) The cleaner blade 132 is fixed to a home position and has the tip pressed against the image supporter 110 by the elastic force of the cleaner blade 132 itself.

This structure is simple and can be prepared at a low cost.

(2) The cleaner blade 132 can also be of a rotatable or movable structure pressed against the image supporter 110 by means of a spring.

This structure enables the cleaner blade 132 to be pressed against the image supporter 110 at a constant pressure independently of the shape accuracy or rubber hardness of the blade.

It can also lessen pressure fluctuation and prevent the image supporter from filming.

(3) The blade is made of urethane rubber.

This material has excellent wear resistance and is inexpensive.

The blade has a hardness in the range of 60°–80° (JIS A).

If the blade is too hard, the image supporter 110 is worn heavily; if the blade is too soft, it is also worn heavily.

(4) The use edge line coarseness of the blade is Rmax 10 $\mu$m or less.

The purpose is to provide the blade with a cleaning ability.

(5) The press pressure of the blade against the image supporter 110 is 20–100 gf/cm.

If the press pressure is too large, the image supporter 110 is easily worn by friction with the blade and the life of the image supporter 110 is shortened. The drive torque and stress of the image supporter 110 also grow.

In contrast, if the press pressure is too small, the cleaning ability of the blade is degraded and it becomes difficult to prevent the image supporter from filming.

(6) The abutment angle of the blade against the image supporter 110 (the angle between the tangent lines of the blade and the image supporter 110 at the abutment part) is 5°–20°.

If the abutment angle is too large, the cleaning ability is degraded and the abutment pressure must be increased to enhance the cleaning ability.

In contrast, if the abutment angle is too small, the positional accuracy of the blade must be made strict so that the edge line of the blade reliably abuts the image supporter 110 in the range of the positional accuracy of the blade.

(7) The blade is provided with an attachment and detachment mechanism to and from the image supporter 110 and at the transport time, the blade is detached from the image supporter 110.

The purpose is to prevent the image supporter 110 from becoming deformed due to a creep characteristic.

For fur brush 131,

The fur brush 131 assists cleaning and is provided as required.

The reason why the fur brush 131 is provided is that if polymerization toner is used, blade cleaning is insufficient to clean the image supporter.

Known natural or synthetic fibers, such as polyester or nylon, can be used as the material of the fur brush 131.

A bias voltage is applied to the fur brush, whereby its cleaning ability can be enhanced.

Figure 7:
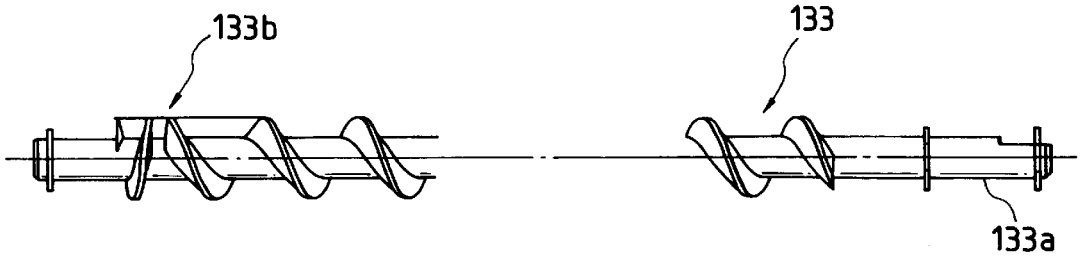
FIG. 7 is a partial front view of a toner transport screw 133.

For toner transport screw 133, (1) The blade twisting of the toner transport screw 133 is diverted at the waste toner discharge part **13*b*, as shown in FIG. 7**.

The purpose is to prevent waste toner press powder for reliably discharging toner.

(2) The rotation speed of the screw is 30–120 rpm.

If the rotation speed is too high, the drive system load grows and it becomes difficult to suppress vibration.

In contrast, if the rotation speed is too low, it becomes impossible to provide a sufficient waste toner transport amount; for example, it becomes difficult to reliably transport a comparatively large amount of waste toner occurring at the black solid printing time.

Then, in these embodiments, the rotation speed of the screw is 30–120 rpm and more particularly is 60 rpm.

For drive system, (1) In the image support apparatus shown in FIG. 2, the shafts 142*a* and 143*a* are rotated; in the image support apparatus shown in FIG. 13, the shaft 191 is fixed.

The image support apparatus shown in FIG. 2 can be prepared at a low cost because the side plates 142 and 143 and the shafts 142*a* and 143*a* can be formed in one piece.

According to the image support apparatus shown in FIG. 13, the bearings 192L and 192R can be installed on the side plates 193L and 193R, so that the rotation accuracy can be enhanced and the shaft 191 can be used as a positioning member to the main body.

(2) The bearing members such as 192L in the image support apparatus 100 are ball bearings.

The ball bearings have a small bearing loss and a long life.

However, journals can also be used as the bearing members.

By using journals, the rotation accuracy can be enhanced and the image support apparatus can be prepared at a low cost. The vibration damping effect can also be produced.

(3) The material of the drive gear 144 or 144' of the image supporter 110 is a resin having a small linear expansion coefficient such as polyacetal or glass fiber reinforced nylon.

By making the gear of polyacetal, the polyacetal provides the advantage of a high vibration damping ability as compared with metal. In addition, the gear can be manufactured by molding and the mold accuracy raised, thereby enabling higher accuracy than by metal cutting; also the polyacetal gear is inexpensive.

By making the gear of glass fiber reinforced nylon, the glass fiber reinforced nylon has a low linear expansion coefficient of $2.0\times10^5$ and is small in thermal expansion, thus can enhance the gear precision.

(4) The gear 144 has a module in the range of 0.5–1.0.

For jitter countermeasures, if the module is made too large, the contact gear ratio lessens and stable torque transmission is made impossible.

In contrast, if the module is made too small, the contact gear ratio changes largely with change in the wheel base between gears because of thermal expansion or member tolerance.

Then, in these embodiments, the gear 144 has a module in the range of 0.5–1.0 and more particularly 0.8.

(5) As shown in FIG. 8, torque is transmitted from the gear 144 of the image supporter 110 to the gear 311 of the drive roller 310 of the intermediate transfer belt 360 and the transmission portion is positioned downstream from the primary transfer portion (primary transfer roller 320 portion) in the circulation direction of the intermediate transfer belt 360.

According to such a composition, the intermediate transfer belt 360 can be wound around the drive roller 310 at a large angle and is driven stably.

The peripheral speed of the image supporter 110 is made lower than that of the intermediate transfer belt 360, whereby a stable tension can be applied to the intermediate transfer belt 360 between the drive roller 310 and the primary transfer section so that the intermediate transfer belt 360 can be driven furthermore stably.

(6) The reference pitch circle diameter of the gear 144 is made larger than the diameter of the image supporter 110.

According to such a composition, if the image supporter 110 and the drive roller 310 are placed apart, torque can be transmitted to the drive roller 310.

For attachment method of image support apparatus 100 to main body,

The shaft 191, etc., of the image support apparatus 100 is used as a positioning member to the main body.

Since the image support apparatus 100 is formed with the shaft 191, etc., as a reference, the shaft 191, etc., can be used as a positioning member to position the image support apparatus 100 to the main body with high accuracy.

The image support apparatus 100 and the main body can be fixed using a lever, etc.

Miscellaneous, (1) The subframe 180 (see FIG. 6) is formed with a light path of static elimination light L' from the static elimination light irradiation means 61.

Since the image support apparatus 100 is a replacement part, the static elimination light irradiation means 61 is provided in the main body, whereby the running cost can be decreased.

A light guide plate made of metal, such as stainless steel, is disposed in the light path, whereby the static elimination light is prevented from leaking to the charge position side, so that it can be prevented from causing the charge potential to decrease, and the transmission efficiency of the static elimination light to the image supporter 110 can be raised.

(2) At the shipment time of the image support apparatus 100, a powder lubricant (vinylidene resin fluoride) is applied between the proximity of the cleaner blade 132 position of the image supporter 110 and the neighborhood of the upstream half round, whereby sticking of the cleaner blade 132 onto the image supporter 110 occurring when the image supporter 110 is unused can be prevented and the drive torque of the image supporter 110 when use of the image supporter 110 is started can be decreased. No powder lubricant is applied between the cleaner blade 132 and the charge roller 120, whereby the charge roller 120 can be prevented from being contaminated with a powder lubricant.

For the image support apparatus,

Preferably, the radial position accuracy of the backup mechanism is about ±100 μm and the position accuracy in the circumferential direction (rotation direction of the image supporter 140) is within about ±1°.

Preferably, the abutment amount of the charge roller 220, the developing roller 310, or the transfer roller 230 against the image supporter 140 (recess amount of the image supporter 140) is 0.5 mm or less.

Although the present invention has been described in the embodiments and examples, it is to be understood that the invention is not limited to the embodiments or examples and the combination and arrangement of parts may be resorted to without departing from the spirit and the scope of the invention.

For example, in the embodiments, the image support apparatus is described as the image support apparatus, but the image support apparatus of the invention is not limited to the image support apparatus and can be formed as an intermediate transfer medium unit. In this case, the image support becomes an intermediate transfer medium shaped like a thin cylinder.

Figure 47:
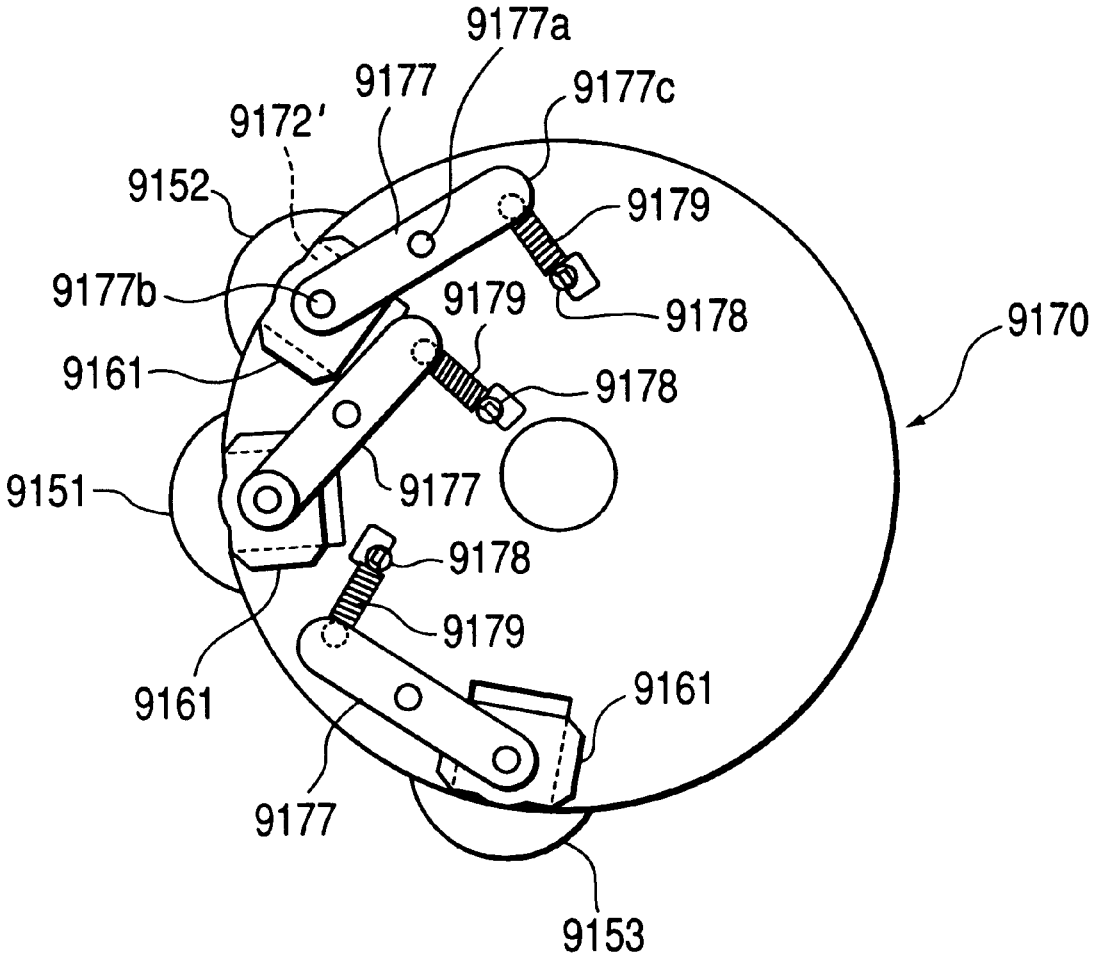
FIG. 47 is a side view to show a modified example of urging means.

Any appropriate configuration of the urging means can be adopted. For example, as shown in FIG. 47, a bearing member 9161 is attached slidably to an installation hollow 9172' of an attachment plate 9170', a lever 9177 is attached swingably with a shaft 9177*a* and is coupled at one end 9177*b* to the bearing member 9161, and a tension spring 9179 is disposed between an opposed end 9177*c* and a spring hook part 9178 of the installation plate for urging a backup roller 9151, (9152, 9153) outward in the radial direction.

Especially in the eighth and ninth embodiment, the tip face 2135*a* of the ring-like slider 2135 may be inclined as indicated by phantom line 2135*a*' in FIG. 28, thereby promoting deformation of the elastic ring 2124, 2134 toward the support member 2121, 2131. Similar modification can apply to the tenth, fourteenth and fifteenth embodiments.

Especially in the eleventh embodiment, the outer diameter D3 of the cylindrical face 4123, 4133 of the support member 4121, 4131 is made larger about 0.1%–3% than the inner diameter D2 of the image supporter 4140.

Especially in the thirteenth embodiment, the press and widening mechanisms is made up of the wedge-like slider 5135 and the screw 5136, but any appropriate configuration (for example, using a cam for widening both ends 5134*a* and 5134*a* of the elastic ring 5134) can also be adopted.

In this embodiment, both the slider 5135 and the ends 5134*a* of the elastic ring 5134 are tapered, but either the slider 5135 or the ends 5134*a* may be tapered; and they may be tapered in an opposite direction (direction in which the elastic ring is pressed and widened when the slider moves in the opposite direction to the arrow b).

What is claimed is:

1. An image support apparatus comprising:

a pair of rotatable, substantially disk shaped members;

a cylindrical member supported and fixed at both ends by the pair of disk shaped members;

an image supporter comprising a thin walled, flexible cylinder with a photosensitive layer forming an outer peripheral surface of the image supporter;

support members disposed on an outer peripheral surface of the cylindrical member for supporting the image supporter;

a charge roller abutting and uniformly charging the outer peripheral surface of the image supporter; and a frame for holding at least the disk shaped members, wherein a distance between each support member and an adjacent end of the charge roller is set to a length to prevent the image supporter, which is deformed as the charge roller abuts the image supporter, from being permanently deformed.

2. The image support apparatus according to claim 1, wherein the support members comprise spacers having elastic projections, and a spacing between the outer peripheral surface of the cylindrical member and an inner surface of the image supporter when the spacers support the image supporter is set smaller than a deformation amount of the image supporter which would destroy the image supporter when the image supporter is deformed.

3. The image support apparatus according to claim 2, wherein the spacers are equally spaced from each other in a circumferential direction of the cylindrical member.

4. The image support apparatus according to claim 3, wherein one of the pair of disk shaped members is slidably disposed within an inner peripheral surface of the cylindrical member.

5. The image support apparatus according to claim 1, wherein the charge roller is chamfered at outer peripheral end parts.

6. The image support apparatus according to claim 1, further comprising:

an exposure mechanism for selectively exposing the outer peripheral surface of the image supporter to form an electrostatic latent image;

a developing roller for developing the electrostatic latent image formed by the exposure mechanism; and a transfer mechanism for transferring the image developed by the developing roller.

7. An image support apparatus comprising:

a stationary shaft;

a pair of substantially disk shaped members attached rotatably to the shaft;

an image supporter comprising a thin walled, flexible cylindrical member with a photosensitive layer forming an outer peripheral surface of the image supporter, the image supporter being supported and fixed at both ends by the pair of disk shaped members and rotated together with the disk shaped members;

support members associated with the disk shaped members for supporting the image supporter at both ends thereof, the support members being arranged concentrically with the shaft;

fixation members facing the support members with the image supporter held therebetween, said fixation members extending in a circumferential direction of the cylindrical member;

an abutment member abutted against the image supporter from the outside thereof; and a backup mechanism attached to the shaft for supporting the image supporter from the inside thereof at a position where the abutment member is abutted against the image supporter.

8. The image support apparatus according to claim 7, wherein the abutment member is a cleaning member for removing a developer remaining on the outer peripheral surface of the image supporter.

9. The image support apparatus according to claim 7, wherein the backup mechanism is a rotatable roller.

10. The image support apparatus according to claim 7, wherein the image supporter is a photosensitive body, the image support apparatus comprising means for exposing a surface of the photosensitive body to form an electrostatic latent image at an exposure position, a developing roller disposed for movement toward and away from the photosensitive body, and wherein the backup mechanism supports the image supporter from the inside thereof at the exposure position.

11. The image support apparatus according to claim 10, wherein the backup mechanism supports the image supporter at the exposure position so that the image supporter is protruded outwardly from a rotation path of the image supporter where the backup mechanism does not exist.

12. The image support apparatus according to claim 7, comprising means for rotating the pair of disk shaped members at the same time.

13. The image support apparatus according to claim 12, comprising a gang mechanism for ganging together the pair of disk shaped members, the gang mechanism being disposed internally of the image supporter.

14. The image support apparatus according to claim 13, wherein the gang mechanism comprises a gang shaft in parallel with the stationary shaft and disposed internally of the image supporter, and a pair of gears fixed to the gang shaft at ends thereof and meshing with gears associated with the pair of disk shaped members.

15. The image support apparatus according to claim 14, wherein the gang mechanism comprises means for preventing backlash.

16. The image support apparatus according to claim 7, wherein the backup mechanism comprises a member in sliding contact with an inner peripheral surface of the image supporter.

17. The image support apparatus according to claim 16, wherein the image supporter is a photosensitive body, the image support apparatus comprising means for exposing a surface of the photosensitive body to form an electrostatic latent image at an exposure position, a developing roller disposed for movement toward and away from the photosensitive body, and wherein the backup mechanism supports the image supporter from the inside thereof at the exposure position.

18. The image support apparatus according to claim 17, wherein the backup mechanism supports the image supporter at the exposure position so that the image supporter is protruded outwardly from a rotation path of the image supporter where the backup mechanism does not exist.

19. The image support apparatus according to claim 16, wherein the backup mechanism comprises a rotatable roller.

20. The image support apparatus according to claim 19, further comprising means for urging the backup mechanism in a direction towards and away from the inner peripheral surface of the image supporter.

21. The image support apparatus according to claim 20, wherein the support members support the image supporter at both ends thereof from the inside and in the circumferential direction, and each of the support members has a cylindrical face and a truncated cone face adjoining the cylindrical face.

22. The image support apparatus according to claim 21, wherein an outer diameter of the cylindrical face is larger than an inner diameter of said image supporter before the image supporter is supported on the support members, and a diameter of the truncated cone face at a tip end is smaller than the inner diameter of said image supporter before the image supporter is supported on the support members.

23. The image support apparatus according to claim 21, further comprising positioning rollers for positioning the backup mechanism, said positioning rollers being disposed at ends of the backup mechanism.

24. The image support apparatus according to claim 7, further comprising:

a charge roller for uniformly charging the outer peripheral surface of the image supporter;

an exposure mechanism for selectively exposing the outer peripheral surface of the image supporter to form an electrostatic latent image;

a developing roller for developing the electrostatic latent image formed by the exposure mechanism; and a transfer mechanism for transferring the image developed by the developing roller.

25. An image support apparatus comprising:

a stationary shaft;

a pair of substantially disk shaped members attached rotatably to the shaft;

an image supporter comprising a thin walled, flexible cylindrical member with a photosensitive layer forming an outer peripheral surface of the image supporter, the image supporter being supported and fixed at both ends by the pair of disk shaped members and rotated together with the disk shaped members;

support members associated with the disk shaped members for supporting the image supporter at both ends thereof, the support members being arranged concentrically with the shaft;

fixation members facing the support members with the image supporter held therebetween, said fixation members extending in a circumferential direction of the cylindrical member;

means for deforming the fixation members such that ends of the image supporter are pressed by the fixation members;

an abutment member abutted against the image supporter from the outside thereof;

a backup mechanism attached to the shaft for supporting the image supporter from the inside thereof at or near a position where the abutment member is abutted against the image supporter; and an urging mechanism for urging the backup mechanism in a direction towards and away from the image supporter.

26. The image support apparatus according to claim 25, wherein the abutment member is a cleaning member for removing a developer remaining on an outer peripheral surface of the image supporter.

27. The image support apparatus according to claim 25, wherein the backup mechanism is a rotatable roller.

28. The image support apparatus according to claim 25, wherein the fixation members comprise elastic rings.

29. The image support apparatus according to claim 28, wherein the support members support the ends of the image supporter from the inside thereof, and the elastic rings are disposed facing the support members with the image supporter held therebetween.

30. The image support apparatus according to claim 29, wherein the elastic rings are deformed such that both ends of the image supporter are pressed from outside thereof by the elastic rings.

31. The image support apparatus according to claim 30, wherein the deforming means comprises:

press members pressing the elastic rings in an axial direction of the shaft; and regulators regulating deformation of the elastic rings in directions other than toward the support members, the regulators being disposed facing the support members with the elastic rings therebetween.

32. The image support apparatus according to claim 31, further comprising positioning rollers for positioning the backup mechanism, said positioning rollers being disposed at ends of the backup mechanism.

33. The image support apparatus according to claim 29, further comprising positioning rollers for positioning the backup mechanism, said positioning rollers being disposed at ends of the backup mechanism.

34. The image support apparatus according to claim 28, wherein the support members support the image supporter from the outside thereof, and the elastic rings are disposed facing the support members with the image supporter held therebetween.

35. The image support apparatus according to claim 34, wherein the elastic rings are deformed such that the ends of the image supporter are pressed from the inside thereof by the elastic rings.

36. The image support apparatus according to claim 35, wherein the deforming means comprises:

press members pressing the elastic rings in an axial direction of the shaft; and regulators regulating deformation of the elastic rings in directions other than toward the support members, the regulators being disposed facing the support members with the elastic rings therebetween.

37. The image support apparatus according to claim 25, wherein the fixation members are C-shaped elastic rings.

38. The image support apparatus according to claim 37, wherein the support members support the image supporter from the outside thereof, and the C-shaped elastic rings are disposed facing the support members with the image supporter held therebetween.

39. The image support apparatus according to claim 37, wherein a gap between open ends of the C-shaped elastic rings is increased or made smaller by the deforming means.

40. The image support apparatus according to claim 37, wherein the support members support the image supporter from the inside thereof, and the C-shaped elastic rings are disposed facing the support members with the image supporter held therebetween.

41. The image support apparatus according to claim 40, wherein a gap between open ends of the C-shaped elastic rings is increased or made smaller by the deforming means.

42. The image support apparatus according to claim 40, further comprising positioning rollers for positioning the backup mechanism, said positioning rollers being disposed at ends of the backup mechanism.

43. The image support apparatus according to claim 25, wherein the abutment member comprises a cleaning member for removing a developer remaining on the outer peripheral surface of the image supporter.

44. The image support apparatus according to claim 43, wherein the backup mechanism comprises rotatable rollers.

45. The image support apparatus according to claim 43, wherein the backup mechanism comprises rollers each formed as an elastic body.

46. The image support apparatus according to claim 43, further comprising positioning rollers for positioning the backup mechanism, said positioning rollers being disposed at ends of the backup mechanism.

47. The image support apparatus according to claim 43, wherein the backup mechanism comprises two or more backup mechanisms, and the abutment member comprises two or more abutment members, and the backup mechanisms abut the image supporter at or near positions where the abutment members abut against the image supporter.

48. The image support apparatus according to claim 47, wherein the backup mechanisms comprise rotatable backup rollers.

49. The image support apparatus according to claim 47, wherein one or more of the abutment members are developing rollers, and corresponding ones of the backup mechanisms are each formed as an elastic body.

50. The image support apparatus according to claim 48, further comprising positioning rollers for positioning the backup rollers, said positioning rollers being disposed at ends of the backup rollers.

51. The image support apparatus according to claim 25, further comprising:

an exposure mechanism for selectively exposing the outer peripheral surface of the image supporter to form an electrostatic latent image;

a developing roller for developing the electrostatic latent image formed by the exposure mechanism; and a transfer mechanism for transferring the image developed by the developing roller.

* * * * *